US007942593B2

(12) United States Patent
Yamaguchi et al.

(10) Patent No.: US 7,942,593 B2
(45) Date of Patent: May 17, 2011

(54) TAPE CASSETTE AND TAPE PRINTING APPARATUS

(75) Inventors: Koshiro Yamaguchi, Kakamigahara (JP); Akira Ito, Ashiya (JP); Takahiro Miwa, Konan (JP); Yoshio Kunieda, Nagoya (JP); Toshihide Fujikawa, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 838 days.

(21) Appl. No.: 11/885,728

(22) PCT Filed: Feb. 23, 2006

(86) PCT No.: PCT/JP2006/303283

§ 371 (c)(1),
(2), (4) Date: Nov. 26, 2007

(87) PCT Pub. No.: WO2006/100870

PCT Pub. Date: Sep. 28, 2006

(65) Prior Publication Data

US 2008/0279605 A1 Nov. 13, 2008

(30) Foreign Application Priority Data

Mar. 18, 2005 (JP) ..... 2005-080061
Jan. 24, 2006 (JP) ..... 2006-015080

(51) Int. Cl.
*B41J 29/38* (2006.01)
*B41J 15/04* (2006.01)

(52) U.S. Cl. ..... 400/76; 400/613

(58) Field of Classification Search ..... None
See application file for complete search history.

(56) References Cited

U.S. PATENT DOCUMENTS

| | | | | |
|---|---|---|---|---|
| 7,037,011 | B1 * | 5/2006 | Forest et al. | 400/208 |
| 2006/0171753 | A1 * | 8/2006 | Fessler et al. | 400/76 |
| 2008/0232886 | A1 * | 9/2008 | Kato et al. | 400/76 |
| 2008/0267685 | A1 * | 10/2008 | Moriyama et al. | 400/613 |
| 2008/0310904 | A1 * | 12/2008 | Yamaguchi et al. | 400/615.2 |
| 2009/0002746 | A1 * | 1/2009 | Niwa et al. | 358/1.15 |
| 2009/0041527 | A1 * | 2/2009 | Ohashi et al. | 400/613 |

FOREIGN PATENT DOCUMENTS

| | | | |
|---|---|---|---|
| JP | 08-268420 | | 10/1996 |
| JP | HO09 240066 | | 9/1997 |
| JP | 2002-002026 | | 1/2002 |
| JP | 2002-087412 | | 3/2002 |
| JP | 2004-130673 | | 4/2004 |
| JP | 2005047231 | A * | 2/2005 |
| JP | 2009096124 | A * | 5/2009 |

* cited by examiner

*Primary Examiner* — Daniel J Colilla
(74) *Attorney, Agent, or Firm* — Day Pitney LLP

(57) ABSTRACT

A CPU 81 displays a virtual tape 201 of a length obtained by subtracting a length (l1+l2) from an antenna 33 to a thermal head 9 from a data value of an "IC chip pitch length L" when it determines that a printing object tape 531 of type 1 is accommodated in a tape cassette 21. A "tape width" is displayed on the right side of the virtual tape 201. A tape length of the virtual tape 201 is displayed below it. A "tape type" is displayed below it. Then, the CPU 81 displays a print area 202 on the virtual tape 201 from a data value of the "print area" while a right side portion thereof serves as a non-print area. It displays the print data inputted into the print area 202 and waits for the return key 4 to be pressed.

2 Claims, 47 Drawing Sheets

FIG. 13

| DATA TYPE | DATA CONTENT |
|---|---|
| TAPE WIDTH | 12mm |
| TAPE TYPE | HEAT SENSITIVE TAPE (WITH ADHESIVE AGENT) |
| TAPE LENGTH | 8m |
| IC CHIP PITCH LENGTH L | 100mm |
| PRINT RANGE | RANGE OF 25 TO 90mm FROM SENSOR MARK POSITION (LEFT) |
| SENSOR MARK = IC CHIP CENTER POSITION I3 | 95mm |
| PRINT COLOR | BLACK |

FIG. 14

| DATA TYPE | DATA CONTENT |
|---|---|
| TAPE WIDTH | 12mm |
| TAPE TYPE | HEAT SENSITIVE TAPE (WITH ADHESIVE AGENT) |
| TAPE LENGTH | 8m |
| IC CHIP PITCH LENGTH L | 100mm |
| PRINT RANGE | RANGE OF 35 TO 100mm FROM SENSOR MARK POSITION (LEFT) |
| SENSOR MARK = IC CHIP CENTER POSITION l3 | 30mm |
| PRINT COLOR | BLACK |

FIG. 15

| DATA TYPE | DATA CONTENT |
|---|---|
| TAPE WIDTH | 12mm |
| TAPE TYPE | HEAT SENSITIVE TAPE (WITH ADHESIVE AGENT) |
| TAPE LENGTH | 8m |
| IC CHIP PITCH LENGTH L | 100mm |
| PRINT RANGE | RANGE OF 25 TO 57.5mm, 67.5 TO 100mm FROM SENSOR MARK POSITION (LEFT) |
| SENSOR MARK = IC CHIP CENTER POSITION I3 | 62.5mm |
| PRINT COLOR | BLACK |

TAPE CASSETTE AND TAPE PRINTING APPARATUS

TECHNICAL FIELD

The present invention relates to a tape cassette which accommodates a long tape and a tape printing apparatus comprising a tape feeding means for feeding a tape and a printing means for printing on the tape with the tape cassette loaded thereon detachably.

BACKGROUND ART

Conventionally, various tape printing apparatuses have been proposed which comprises a tape cassette accommodating a long tape, a tape feeding means for feeding this tape and a tape printing apparatus for printing on the tape, such that the tape cassette can be loaded detachably.

As the tape printing apparatus which contains a print head and has a printing means for printing data of a given text to a tape as a print medium, for example, there has been known a tape printing apparatus including a mark which is printed on the tape together with a predetermined format and serves as a reference for positioning the print head at a print starting position with respect to the format, and a control means for controlling so as to determine the print starting position of the print head to the predetermined format according to the mark as a reference (see, for example, patent document 1).

In the tape printing apparatus having such a structure, the control means controls so as to determine the print starting position of the print head to the predetermined format based on the mark printed on the tape preliminarily. Consequently, printing can always be made at an appropriate position with respect to the format printed on the tape preliminarily.

PATENT DOCUMENT 1: Japanese Patent Application Laid-Open No. 9 (1997)-240066 (paragraph 0014-0064, FIGS. 1-22)

DISCLOSURE OF THE INVENTION

However, in the above-mentioned conventional tape printing apparatus, the print head is positioned at the print starting position with respect to a predetermined format and thus, there exists such a problem that a user cannot confirm whether or not all print data can be printed within a print area of the predetermined format unless he or she tries to print once. If wireless information circuit elements each having an IC circuit portion which stores predetermined information and an IC circuit antenna connected to the IC circuit portion for transmitting and receiving information are provided at a predetermined pitch in the longitudinal direction of the printing object tape, a portion including this wireless information circuit element is constructed in a convex shape and thus, there exists a problem that if that portion is printed, the print is blurred or disabled.

Accordingly, the present invention has been achieved to solve the above-mentioned problems and an object of the invention is to provide a tape cassette and a tape printing apparatus which enable a user to input print data while confirming a print area excluding the wireless information circuit element when the wireless information circuit elements are provided at a predetermined pitch in the longitudinal direction of a printing object tape, so that a high quality printed label tape can be created.

Means for Solving the Problems

In order to achieve the above object, according to the invention, there is provided a tape cassette for use in a tape printing apparatus having a tape feeding means for feeding a long tape and a printing means for printing on the tape, and for being detachably to a cassette accommodating portion of the tape printing apparatus accommodating the tape, the tape cassette comprising: a cassette information specifying means for specifying predetermined cassette information about the tape cassette, provided on a tape cassette main body; a tape spool on which a printing object tape to be printed by the printing means is wound and provided rotatably; a wireless information circuit element including an IC circuit portion disposed at a predetermined pitch in the longitudinal direction of the printing object tape for storing a predetermined information and an IC circuit side antenna connected to the IC circuit portion for transmitting and receiving information; a sensor mark formed at the same pitch as the predetermined pitch in the longitudinal direction of one face of the printing object tape; and a print area provided at the same pitch as the predetermined pitch on a portion excluding the wireless information circuit element between the respective sensor marks of the printing object tape, wherein the sensor mark, the wireless information circuit element and the print area are provided apart from one another at a predetermined distance repeatedly in the longitudinal direction of the printing object tape, and the predetermined cassette information includes a print area information which is constituted of a distance data indicating a relative distance between the front end portion in the feeding direction of the print area and the sensor mark disposed on immediately before an upstream side in the tape feeding direction of the print area and a length data indicating the length in the feeding direction of the print area.

In the tape cassette according to the invention, preferably, the predetermined cassette information includes a circuit element position information indicating a relative distance between the wireless information circuit element and the sensor mark disposed immediately before on the upstream side in the feeding direction of the wireless information circuit element.

According to the invention, there is further provided: a tape printing apparatus including a tape feeding means for feeding a long tape, an input means, a display means for displaying a print data inputted or edited by the input means, and a print means for printing a print data displayed on the display means to the tape, and on which a tape cassette accommodating the tape is loaded detachably, wherein the tape cassette comprises: a cassette information specifying means for specifying predetermined cassette information concerning the tape cassette provided on a tape cassette main body; a tape spool on which the printing object tape to be printed by the printing means is wound and provided rotatably; a wireless information circuit element including an IC circuit portion disposed at a predetermined pitch in the longitudinal direction of the printing object tape for storing a predetermined information and an IC circuit side antenna connected to the IC circuit portion for transmitting and receiving information; a sensor mark formed at the same pitch as the predetermined pitch in the longitudinal direction of one face of the printing object tape; a print area provided at the same pitch as the predetermined pitch on a portion excluding the wireless information circuit element between the respective sensor marks of the printing object tape, wherein the sensor mark, the wireless information circuit element and the print area are provided apart from one another at a predetermined distance repeatedly in the longitudinal direction of the printing object tape, and the predetermined cassette information includes a print area information which is constituted of a distance data indicating a relative distance between the front end portion in the feeding direction of the print area and the sensor mark disposed on immediately before the upstream side in the tape feeding direction of the print area and a length data indicating the length in the feeding direction of the print area, and the tape printing apparatus comprises: a detection sensor for detecting the sensor mark of a printed tape sent from the tape cassette; a thermal head disposed at a position a predetermined first distance apart from the detection sensor on the upstream side in the tape feeding direction; a cutting means for cutting the printed tape sent from the tape cassette disposed at a position a predetermined second distance, which is smaller than the predetermined first distance, apart from the detection sensor on the upstream side in the tape feeding direction; a cassette information reading means for reading the predetermined cassette information in cooperation with the cassette information specifying means; and a virtual tape display control means which creates a virtual tape indicating a print area on the printing object tape based on the print area information read through the cassette information reading means, displays on the display means and controls the display so as to display a condition in which the print data is printed in the print area.

In the tape printing apparatus according to the invention, preferably, the predetermined cassette information includes a circuit element position information indicating a relative distance between the wireless information circuit element and the sensor mark disposed immediately before on the upstream side in the feeding direction of the wireless information circuit element.

The tape printing apparatus according to the invention preferably comprises: an apparatus side antenna disposed so as to be opposite to the detection sensor across a printed tape; and a reading and writing means for reading and writing the predetermined information from the wireless information circuit element by wireless communication through the apparatus side antenna.

Effect of the Invention

In the tape cassette of the present invention, the wireless information circuit elements are disposed at a predetermined pitch in the longitudinal direction of a printing object tape which is wound around the tape spool. The sensor marks are formed at the same pitch as the predetermined pitch of the respective wireless information circuit elements in the longitudinal direction of one side face of this printing object tape. Further, the print areas are provided at the same pitch as the predetermined pitch at a portion excluding the wireless information circuit element between the sensor marks of the printing object tape. Then, the sensor mark, the wireless information circuit element and the print area are provided apart from one another at a predetermined distance repeatedly in the longitudinal direction of the printing object tape. The tape cassette main body is provided with a cassette information specifying means for specifying predetermined cassette information concerning the tape cassette. Then, this cassette information includes a print area information constituted of a distance data indicating a relative distance between the front end portion in the feeding direction of each print area and the sensor mark disposed immediately before on the upstream side in the tape feeding direction of the print area and a length data indicating the length in the feeding direction of the print area.

Consequently, the distance data indicating the relative distance between the front end portion in the feeding direction of the print area and the sensor mark disposed immediately before on the upstream side in the tape feeding direction of the print area and the length data indicating the length in the feeding direction of the print area can be obtained through this cassette information specifying means, so that the print areas provided at the same pitch as the predetermined pitch, excluding the wireless information circuit element between the respective sensor marks of the printing object tape can be printed accurately, thereby preventing the convex portion including the wireless information circuit element of the printing object tape from being printed and producing a high quality printed label tape.

Because in the tape cassette of the present invention, the circuit element position information indicating the relative distance between the wireless information circuit element and the sensor mark disposed immediately before on the upstream side in the tape feeding direction of the wireless information circuit element can be obtained through the cassette information specifying means, an arrangement position of the wireless information circuit element on the upstream side in the feeding direction can be specified with respect to the sensor mark, thereby preventing the convex portion including the wireless information circuit element of the printing object tape from being printed securely and producing a high quality printed label tape.

In the tape printing apparatus of the present invention, the tape cassette is loaded detachably. In this tape cassette, the wireless information circuit elements are disposed at a predetermined pitch in the longitudinal direction of the printing object tape wound around the tape spool. Further, the sensor marks are formed at the same pitch as the predetermined pitch of the wireless information circuit elements in the longitudinal direction of one side face of this printing object tape. The print areas are provided at the same pitch as the predetermined pitch at the portion excluding the wireless information circuit element between the sensor marks of the printing object tape. Then, the sensor marks, the wireless information circuit elements and the print areas are provided a predetermined distance apart from one another repeatedly in the longitudinal direction of the printing object tape. The tape cassette main body is provided with the cassette information specifying means for specifying the predetermined cassette information concerning the tape cassette. This cassette information includes a print area information constituted of a distance data indicating the relative distance between the front end portion in the feeding direction of the print area and the sensor mark disposed immediately before on the upstream side in the tape feeding direction of the print area and the length data indicating the length in the feeding direction of the print area.

A thermal head is disposed at a position a predetermined first distance apart from the detection sensor on the upstream side in the tape feeding direction for detecting the sensor mark of the printed tape. A cutting means is disposed at a position a predetermined second distance, which is smaller than the predetermined first distance, apart from this detection sensor on the upstream side in the tape feeding direction. Further, the cassette information reading means for reading a predetermined cassette information in cooperation with the cassette information specifying means provided on the tape cassette main body is provided. Then, the tape printing apparatus reads a print area information from the cassette information specifying means provided on the tape cassette through the cassette information reading means. Subsequently, the tape printing apparatus creates a virtual tape indicating the print area on the printing object tape based on the distance data indicating the relative distance between the front end portion in the feeding direction of the print area and the sensor mark disposed immediately before on the upstream side in the tape feeding direction of the print area and the length data indicating the length in the feeding direction of the print area, constituting the print area information, displays it on a display means and displays a condition in which the print data inputted through an input means is printed in the print area.

Consequently, a user can input the print data while confirming the print area excluding the wireless information circuit element of the virtual tape, so that he or she can input the print data which can be printed in the print area excluding the wireless information circuit element of the printing object tape. Further, the convex portion including the wireless information circuit element of the printing object tape can be prevented from being printed, thereby making it possible to product a high quality printed label tape. Even if the printing object tape is fed by the first distance after the sensor mark of the printing object tape is detected and the margin at the front end portion is cut off, the entire print area can be left securely in the printed tape.

The tape printing apparatus of the present invention can obtain not only the distance data indicating a relative distance between the front end portion in the feeding direction of the print area and the sensor mark disposed immediately before on the upstream side in the tape feeding direction of the print area and the length data indicating the length in the feeding direction of the print area, constituting the print area information, but also a circuit element position information indicating a relative distance between a position of the wireless information circuit element and a position of the sensor mark disposed immediately before on the upstream side in the tape feeding direction of the wireless information circuit element by the cassette information specifying means provided at the tape cassette through the cassette information reading means.

Consequently, the tape printing apparatus can specify the print area and the arrangement position of the wireless information circuit element on the upstream side in the feeding direction with respect to the sensor mark, thereby preventing the convex portion including the wireless information circuit element of the printing object tape from being printed and producing a high quality printed label tape.

Further, the tape printing apparatus of the present invention can read a predetermined information from the wireless information circuit element through the apparatus side antenna, and write a predetermined information into the wireless information circuit element by feeding the printing object tape over the predetermined distance after the sensor mark of the printing object tape is detected.

BRIEF DESCRIPTION OF DRAWINGS

FIG. 13 is a diagram showing an example of a cassette information stored in a memory portion of a wireless tag circuit element provided on the tape cassette accommodating the printing object tape of type 1 of this embodiment.

FIG. 14 is a diagram showing an example of a cassette information stored in a memory portion of a wireless tag circuit element provided on the tape cassette accommodating the printing object tape of type 2 of this embodiment.

FIG. 15 is a diagram showing an example of a cassette information stored in a memory portion of a wireless tag circuit element provided on the tape cassette accommodating the printing object tape of type 3 of this embodiment.

EXPLANATION OF REFERENCES

Figure 1:
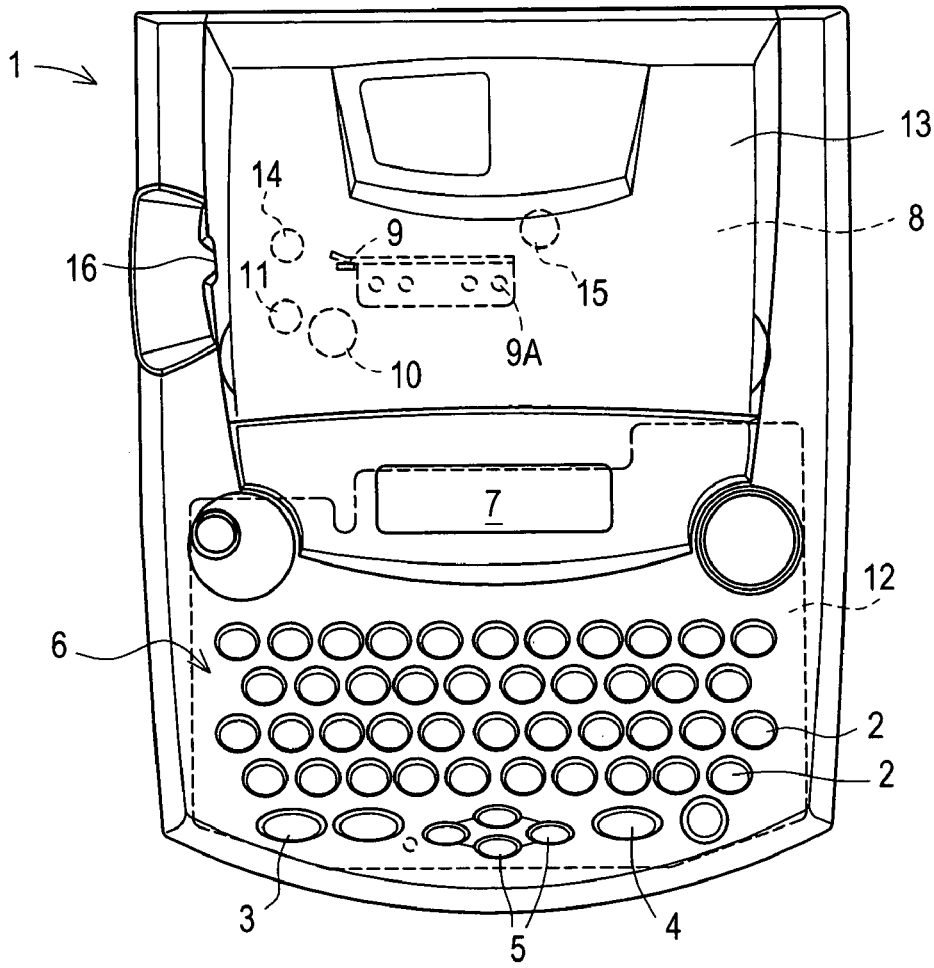
FIG. 1 is a schematic top view of a tape printing apparatus according to this embodiment.

1 tape printing apparatus
6 keyboard
7 liquid crystal display
8 cassette accommodating portion
8A side wall portion
9 thermal head
10 platen roller
11 tape sub-roller
14 tape drive roller shaft
16 label discharge port
24 outer peripheral side wall face
21 tape cassette
25, 32 wireless tag circuit element
26, 33, 68 antenna
28 printed label tape
27 tape discharge port
30 cutter unit
35 reflection type sensor
63 tape feeding roller
65 sensor mark
67 circuit portion
80 control circuit portion
81 CPU
83 ROM
85 RAM
84 flash memory
92 tape feeding motor
93 read and write module
125 memory portion
201, 204, 207 virtual tape
202, 205 print area
208 first print area
209 second print area

BEST MODE FOR CARRYING OUT THE INVENTION

Hereinafter, a tape cassette and a tape printing apparatus of the present invention will now be described in details based on an embodiment with reference to the drawings.

Embodiment

First, the schematic structure of the tape printing apparatus of this embodiment will be described with reference to FIGS. 1 to 4.

Figure 2:
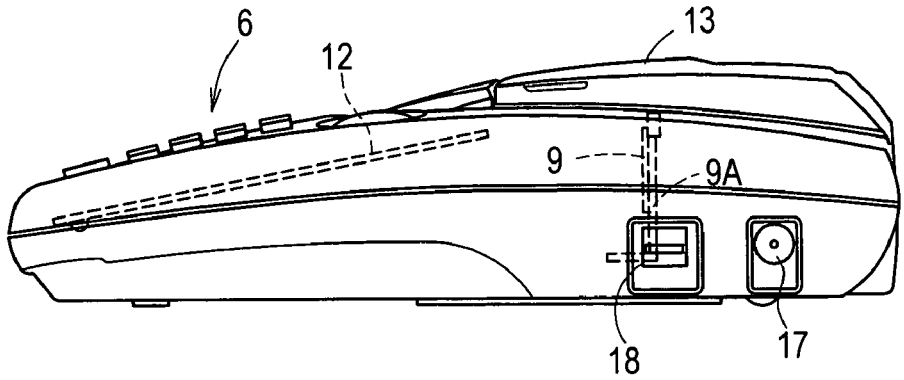
FIG. 2 is a schematic right side view of the tape printing apparatus of this embodiment.
Figure 3:
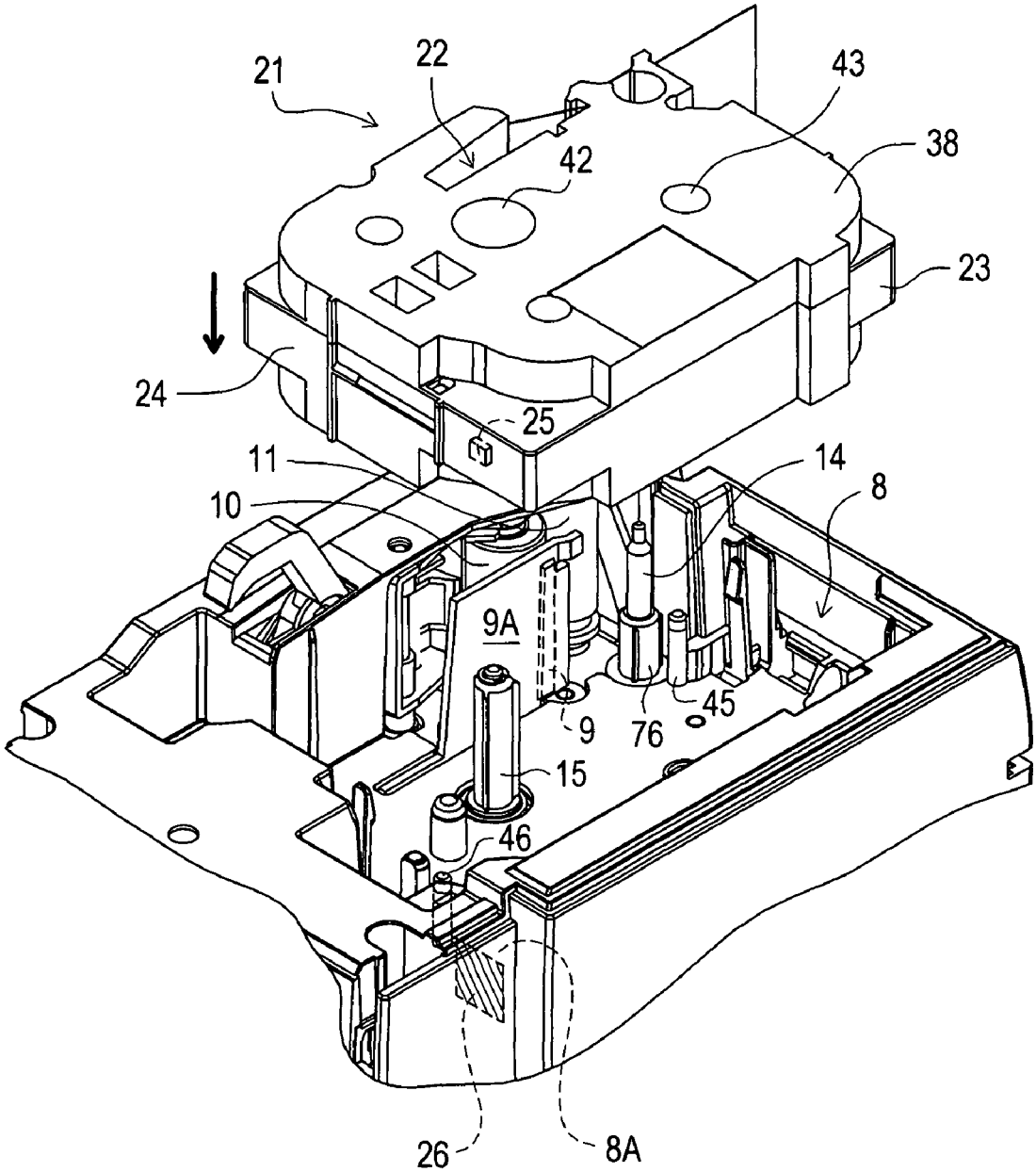
FIG. 3 is a major portion enlarged perspective view showing a condition in which a tape cassette is loaded on a cassette accommodating portion of the tape printing apparatus of this embodiment.

As shown in FIGS. 1 to 3, in the tape printing apparatus 1 of this embodiment, a keyboard 6 provided with character input keys 2 for creating a text composed of document data, a print key 3 for instructing printing of the text or the like, a return key 4 which executes a line feed instruction and various processings and instructs a selection, and cursor keys 5 for moving a cursor up and down and to the right and left on a liquid crystal display (LCD) 7 which displays characters such as letters over a plurality of lines, and a cassette accommodating portion 8 for accommodating the tape cassette 21, which is covered with an accommodating cover 13, are disposed. A control board 12 in which a control circuit portion is constituted is disposed under the keyboard 6. A label discharge port 16 from which a printed tape is discharged is formed in the left side face portion of the cassette accommodating portion 8. An adaptor insertion port 17 to which a power adapter is to be attached and a connector 18 to which a USB cable for connecting with a personal computer (not shown) are provided on the right side face of the cassette accommodating portion 8.

In this cassette accommodating portion 8, not only a thermal head 9, a platen roller 10 opposite to this thermal head 9, a tape sub-roller 11 in the downstream of this platen roller 10 and a metallic tape drive roller shaft 14 opposite to this tape sub-roller 11 are disposed, but also if an ink ribbon is accommodated in the tape cassette 21, a ribbon winding shaft 15 and the like for feeding this ink ribbon is disposed.

This thermal head 9 is a flat sheet of substantially rectangular shape with a vertical longer side as seen in a front view and a predetermined quantity of heat generating elements R1-Rn (n is, for example, 128 or 256) are arranged and formed on the left edge portion of the front face in line. The thermal head 9 is fixed, by means of an adhesive or the like, to the left edge portion on the front face of a heat radiator plate 9A substantially square in its front view, formed of a plated steel plate or stainless steel plate such that the arrangement direction of the respective heat generating elements R1 to Rn is in parallel to the side of the left edge portion of the heat radiator plate 9A. The heat radiator plate 9A is attached to the bottom portion of the cassette accommodating portion 8 with screws such that the arrangement direction of the respective heat generating elements R1 to Rn is substantially perpendicular to the feeding direction of a heat sensitive printing object tape 53 (see FIG. 4) in an opening portion 22 of the tape cassette 21.

The ribbon winding shaft 15 is rotated by a tape feeding motor 92 (see FIG. 10) constituted of a stepping motor and the like described later through an appropriate drive mechanism. The tape drive roller shaft 14 is rotated through an appropriate transmission mechanism by the tape feeding motor 92 so as to rotate a tape feeding roller 63 (see FIG. 4) made of conductive resin.

Figure 4:
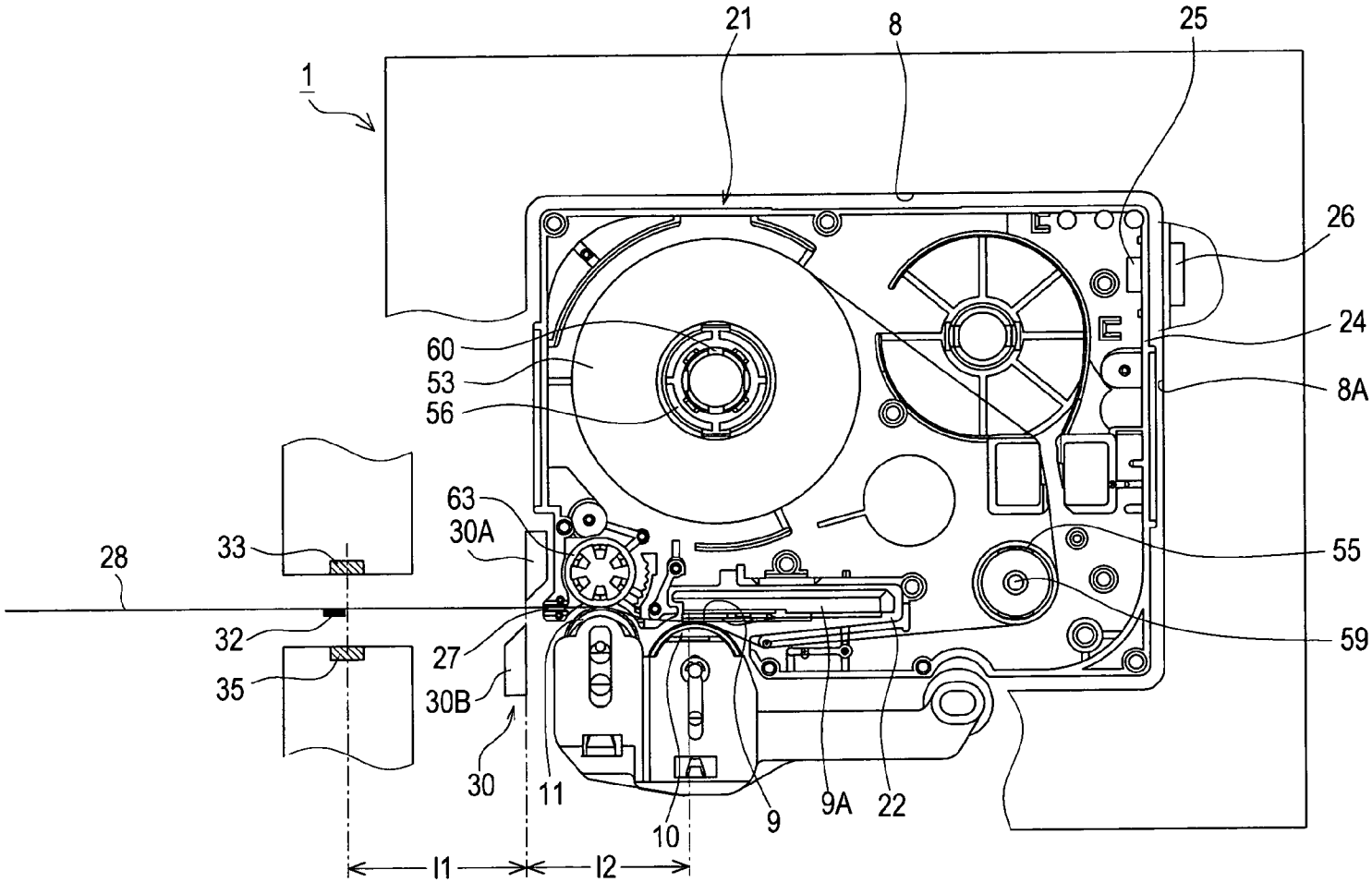
FIG. 4 is a major portion enlarged plan view in case where a top case of a tape cassette is removed with the tape cassette loaded in a cassette accommodating portion of the tape printing apparatus of this embodiment.

As shown in FIGS. 3 and 4, a wireless tag circuit element 25 which stores a cassette information about the tape cassette 21 is disposed at a central position in the height direction of the tape cassette 21 on an outer peripheral side wall face 24 of a lower case 23 of the tape cassette 21, which is to be loaded to the cassette accommodating portion 8 from above. An antenna 26 for transmitting and receiving a signal with respect to the wireless tag circuit element 25 by wireless communication using high frequency wave such as UHF band wave is provided on a side wall portion 8A opposite to the wireless tag circuit element 25 in the cassette accommodating portion 8.

As shown in FIG. 4, a scissors type cutter unit 30 as a tape cutting unit for cutting a printed label tape 28 to a predetermined length at a predetermined timing so as to generate a wireless tag label (whose detail will be described later) is disposed in the vicinity of a tape discharge port 27 of the tape cassette 21. This cutter unit 30 is constituted of a fixed blade 30A and a movable blade 30B which is moved relative to the fixed blade 30A by a cutting motor 54 described later so as to cut the printed label tape 28.

An antenna 33 which transmits and receives a signal relative to the wireless tag circuit element 32 provided on the printed label tape 28 described later by wireless communication using high frequency wave such as UHF band wave is provided in the downstream of the tape discharge direction of the cutter unit 30. Further, a reflection sensor 35 for optically detecting a sensor mark 65 (see FIG. 6) printed on the back face portion of the printed label tape 28 as described later is provided on an opposite side to this antenna 33 across the printed label tape 28. In this context, the antenna 33 and the reflection sensor 35 are disposed at a position a distance l1 apart from the cutter unit 30 in the tape feeding direction. Further, the cutter unit 30 and the thermal head 9 are disposed at a position a distance l2 apart from each other in the tape feeding direction.

As shown in FIGS. 3 and 4, the tape cassette 21 has an upper case 38 and a lower case 23. A supporting hole 42 in which the ribbon winding shaft 15 is to be inserted is formed in this tape cassette 21 (if the ink ribbon is accommodated, this supporting hole 42 supports an ink ribbon winding spool which feeds and winds up the ink ribbon). Additionally, a supporting hole 43 for supporting a tape spool 56 rotatably, on which the heat sensitive printing object tape 53 having sensor marks 65 printed on the back face side of a peeling paper 53C at a predetermined pitch as described later and provided with the wireless tag circuit element 32 at a predetermined pitch with the peeling paper 53C (see FIG. 5) facing outward is formed.

Although in FIG. 3, only the supporting holes 42 and 43 formed in the upper case 38 are represented, the supporting holes 42, 43 are formed in the lower case 23 also opposite to the respective supporting holes 42 and 43 in the upper case 38.

As shown in FIG. 3, two positioning pins 45 and 46 are installed in a standing manner in the same height dimension on the bottom face portion of the cassette accommodating portion 8. Pin holes (not shown) whose bottom face portion is contacted by the top end portion of each of the respective positioning pins 45 and 46, are provided symmetrically in a vertical direction from both faces in the tape cassette 21. Consequently, when the tape cassette 21 is loaded in the cassette accommodating portion 8, the cassette can be positioned appropriately in the cassette accommodating portion 8 through the positioning pins 45 and 46 and the pin holes 47 and 48 in any case of front loading and bottom loading. Further, it is so constructed that the wireless tag circuit element 25 is always opposite to the antenna 26 even if the tape width of the heat sensitive printing object tape 53 accommodated in the tape cassette 21 is different.

As shown in FIG. 4, the heat sensitive type printing object tape 53 is wound around the tape spool 56 within the tape cassette 21 and fitted to a cassette boss 60 installed in a standing manner from the bottom face of the lower case 23 rotatably so that it is accommodated. A substantially cylindrical reel 55 is fitted to a reel boss 59 installed in a standing manner on the bottom face rotatably and obliquely in the downward direction of the cassette boss 60 (obliquely downward to the right in FIG. 4). The heat sensitive type printing object tape 53 extracted from this tape spool 56 is guided along the outer peripheral face of the reel 55 and enters the opening portion 22 in which the thermal head 9 is to be inserted, and passes between the thermal head 9 and the platen roller 10. After that, the printing object tape 53 which is printed via the thermal head 9 passes between a tape feeding roller 63, which is provided rotatably lower left side of the tape cassette 21 (bottom left side in FIG. 4) and rotated by receiving a drive by a tape feeding motor 92, and a tape sub-roller 11 disposed opposite to this tape feeding roller 63, and is fed out of the tape cassette 21 from the tape discharge port 27 as the printed label tape 28 and then, discharged from the label discharge port 16 of the tape printing apparatus 1 via the cutter unit 30, the antenna 33 and the reflection type sensor 35.

In this context, the schematic structure of this heat sensitive type printing object tape 53 will be described with reference to FIG. 5.

Figure 5:
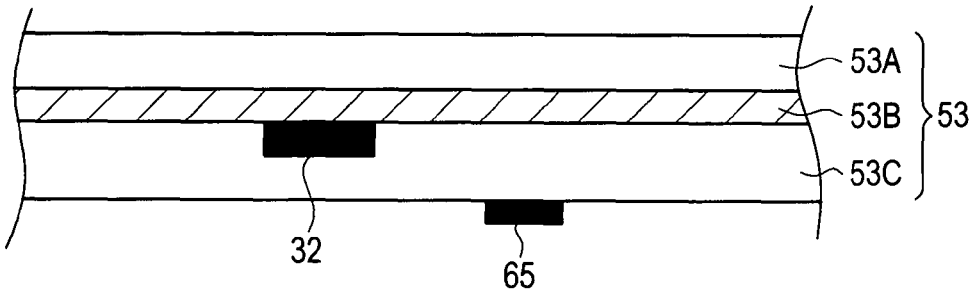
FIG. 5 is a longitudinal direction side sectional view of a printing object tape of the tape cassette of this embodiment.

As shown in FIG. 5, the printing object tape 53 is constructed in a three-layer structure with a heat sensitive coloring layer formed on the front surface of a base tape 53A and the peeling paper 53C affixed removably to the back face via an adhesive agent layer 53B. The wireless tag circuit element 32 is provided on the back side (bottom side in FIG. 5) of the adhesive agent layer 53B at a predetermined pitch as described later and covered with the peeling paper 53C. When attaching the printed label tape 28 finally completed in a label fashion to a specific product or the like, the peeling paper 53C enables the printed label tape 28 to be attached to that product with the adhesive agent layer 53B by peeling this. The sensor mark 65 is printed to the back face of the peeling paper 53C at a predetermined pitch L as described later (see FIG. 6).

Next, the positional relationship between the sensor mark 65 to be printed on the back face portion of the peeling paper 53C of the printing object tape 53 and the wireless tag circuit element 32 will now be described with reference to FIGS. 6 to 9.

Figure 6:
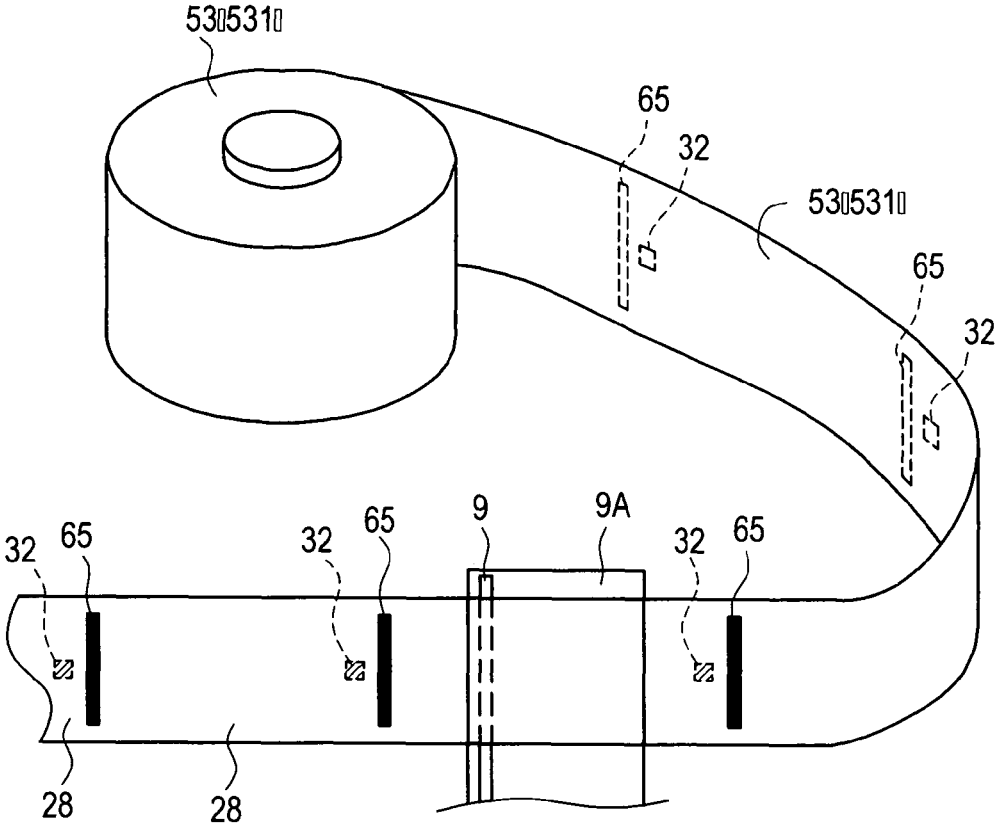
FIG. 6 is a diagram showing schematically a condition in which the printing object tape of the tape cassette of this embodiment is printed.
Figure 7:
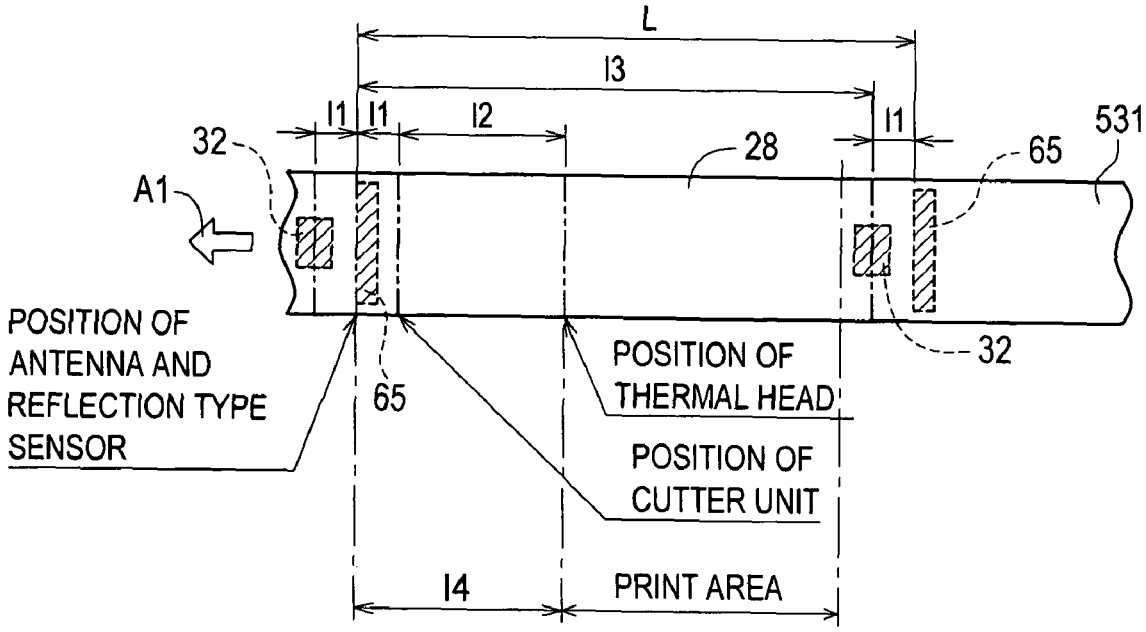
FIG. 7 is a diagram showing schematically a positional relation between a sensor mark to be printed on the back face of the printing object tape of type 1 accommodated in the tape cassette of this embodiment and the wireless tag circuit element incorporated in the printing object tape.

In this context, as the printing object tape 53 of this embodiment, three types thereof, that is, a printing object tape 531 of type 1, a printing object tape 532 of type 2 and a printing object tape 533 of type 3, being different in the positional relationship between a position of the sensor mark 65 and a position of the wireless tag circuit element 32, are provided, and first, the positional relationship between a position of the sensor mark 65 and a position of the wireless tag circuit element 32 of the printing object tape 531 of type 1 will be described with reference to FIGS. 6 and 7.

As shown in FIGS. 6 and 7, each sensor mark 65 of elongated rectangle having a longer side in the tape width direction as seen in its front view is printed at a predetermined pitch L along a tape feeding direction perpendicularly and symmetrically with respect to a center line in the tape width direction on the back face portion of the peeling paper 53C of the printing object tape 531. Further, as for the printing object tape 531, each wireless tag circuit element 32 is disposed at a position equal to a distance l1 in the tape discharge direction (direction of arrow A1) from the sensor mark 65 between the respective sensor marks 65 on the center line in the tape width direction. That is, the wireless tag circuit element 32 is disposed at a position equal to a distance l3=(L−l1) in the upstream in the tape feeding direction with respect to the tape discharge direction (direction of the arrow A1) from the sensor mark 65. Thus, the wireless tag circuit elements 32 are loaded preliminarily at the predetermined pitch L along the tape feeding direction on the center line in the tape width direction. In addition, even if the tape width of the printing object tape 531 is different, the wireless tag circuit element 32 is disposed on the center line in the tape width direction.

On the other hand, the antenna 33 and the reflection type sensor 35 are disposed at a position the distance l1 apart from the cutter unit 30 in the tape feeding direction (see FIG. 4). The cutter unit 30 and the thermal head 9 are disposed at a position the distance of l2 apart from each other in the tape feeding direction (see FIG. 4).

Consequently, when the sensor mark 65 on the printed label tape 28 reaches a position opposite to the antenna 33 and the reflection type sensor 35, the cutter unit 30 becomes opposite to a position corresponding to the tape length l1 on the tape cassette 21 side from the sensor mark 65, that is, in the upstream side in the feeding direction. The thermal head 9 is located at a position corresponding to a tape length l4=(l1+l2) in the upstream side in the feeding direction from this sensor mark 65, opposite to a front end portion of a print area of the printing object tape 531. When the wireless tag circuit element 32 of the printed label tape 28 reaches a position opposite to the antenna 33 and the reflection type sensor 35, the side edge portion in the tape discharge direction (direction of the arrow A1) of the sensor mark 65 becomes opposite to the cutter unit 30. The print area is provided in the downstream side in the feeding direction of the wireless tag circuit element 32.

Next, the positional relationship between the sensor mark 65 and the wireless tag circuit element 32 of the printing object tape 532 of type 2 will be described based on FIG. 8.

Figure 8:
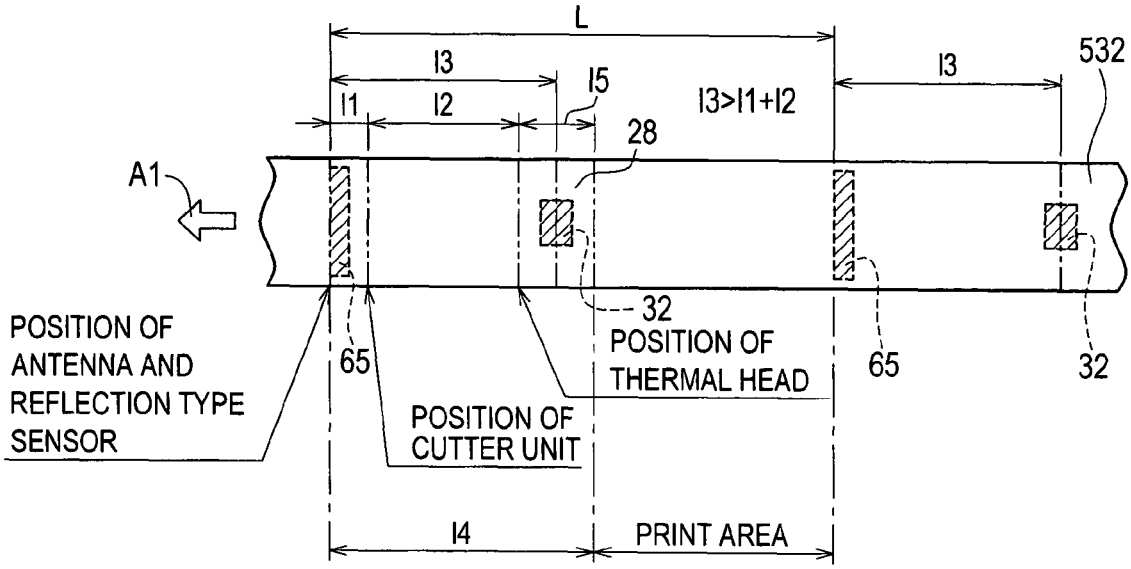
FIG. 8 is a diagram showing schematically a positional relation between a sensor mark to be printed on the back face of the printing object tape of type 2 accommodated in the tape cassette of this embodiment and the wireless tag circuit element incorporated in the printing object tape.

As shown in FIG. 8, the sensor mark 65 of elongated rectangle having a longer side along the width direction as seen in its front view is printed preliminarily at a predetermined pitch L along the tape feeding direction perpendicularly and symmetrically to the center line in the tape width direction on the back face portion of the peeling paper of the printing object tape 532. The wireless tag circuit element 32 is disposed at a position equal to the distance l3 (l3>l1+l2) to an opposite direction to the tape discharge direction (direction of the arrow A1), that is, in the upstream in the tape feeding direction from each sensor mark 65, between the sensor marks 65 on the center line in the tape width direction. The length in the tape longitudinal direction of a non-print area including the wireless tag circuit element 32 is l5, while l3=(l1+l2+l5/2).

The wireless tag circuit elements 32 are loaded preliminary at a predetermined pitch L along the tape feeding direction on the center line in the tape width direction of the printing object tape 532. The antenna 33 and the reflection type sensor 35 are disposed the distance l1 apart from the cutter unit 30 in the tape feeding direction (see FIG. 4). Further, the cutter unit 30 and the thermal head 9 are disposed at positions the distance l2 apart from each other in the tape feeding direction (see FIG. 4). The distance l3 between a position of the sensor mark 65 and a position of the wireless tag circuit element 32 is set larger than a sum (l1+l2) of the distance l1 and the distance l2.

Thus, when the sensor mark 65 of the printed label tape 28 reaches a position opposite to the antenna 33 and the reflection type sensor 35, the cutter unit 30 becomes opposite to a position corresponding to the tape length l1 on the tape cassette 21 side from the sensor mark 65. Further, the thermal head 9 is located at a position corresponding to the tape length (l1+l2) on the tape cassette 21 side, that is, in the upstream side in the tape feeding direction from the sensor mark 65 opposite to the antenna 33 and the reflection type sensor 35, thereby being opposite to the non-print area of the printing object tape 532. When the sensor mark 65 of the printed label tape 28 is fed by a distance (l1+l2) from a position opposite to the antenna 33 and the reflection type sensor 35, the wireless tag circuit element 32 is disposed at a position corresponding to a tape length (l3−(l1+l2)) on the thermal head 9 side from the antenna 33 and the reflection type sensor 35. When the sensor mark 65 of the printed label tape 28 is fed by a distance l4 (l4>l3) from a position opposite to the antenna 33 and the reflection type sensor 35, it comes that the thermal head 9 becomes opposite to a front edge portion of the print area of the printing object tape 532. The print area is provided in the upstream in the feeding direction of each wireless tag circuit element 32.

Subsequently, the positional relation between the sensor mark 65 and the wireless tag circuit element 32 of the printing object tape 533 of type 3 will now be described with reference to FIG. 9.

Figure 9:
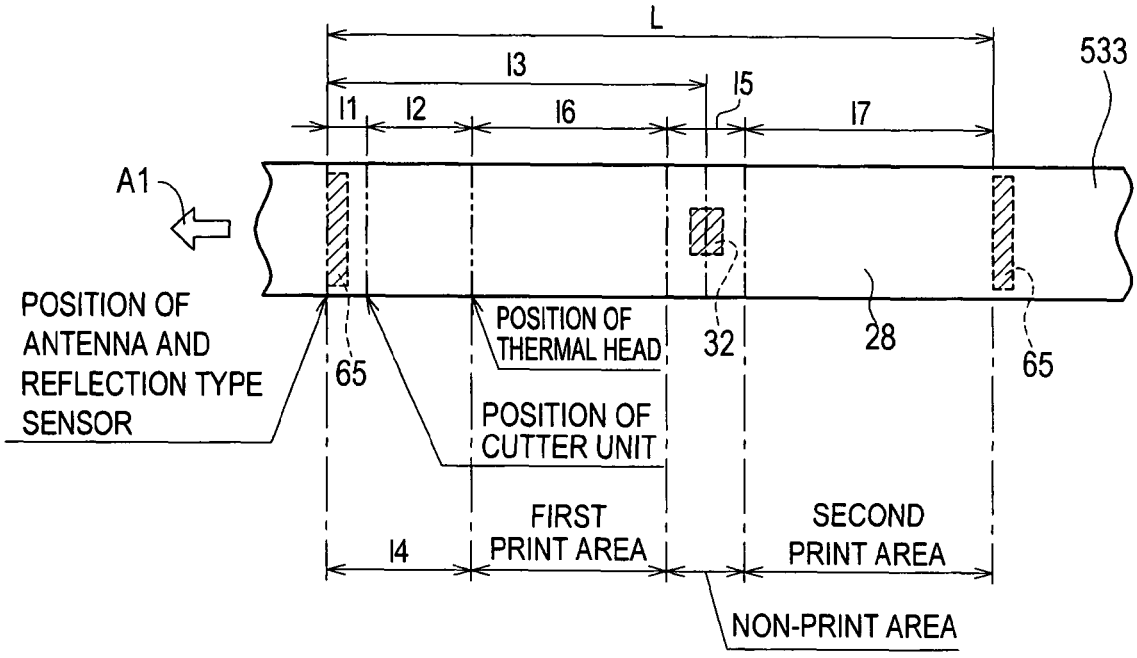
FIG. 9 is a diagram showing schematically a positional relation between a sensor mark to be printed on the back face of the printing object tape of type 3 accommodated in the tape cassette of this embodiment and the wireless tag circuit element incorporated in the printing object tape.

As shown in FIG. 9, the sensor mark 65 of elongated rectangle having a longer side along the width direction as seen in its front view is printed preliminarily at a predetermined pitch L along the tape feeding direction perpendicularly and symmetrically to the center line in the tape width direction on the back face portion of the peeling paper of the printing object tape 533. Further, the wireless tag circuit element 32 is disposed at a position equal to the distance l3 (for example, l3=(L3+(l1+l2)/2), that is, a central position in the tape longitudinal direction in a printable area) in a reverse direction to the tape discharge direction (direction of the arrow A1), that is, in the upstream in the tape feeding direction from the sensor mark 65. Thus, the wireless tag circuit elements 32 are loaded preliminarily at the predetermined pitch L along the tape feeding direction on the center line in the tape width direction of the print object tape 533. The length in the tape longitudinal direction of the non-print area including the wireless tag circuit element 32 is l5 and a first print area of length l6 in the tape longitudinal direction is provided in the downstream in the feeding direction across the non-print area in which this wireless tag circuit element 32 is disposed while a second print area of length l7 in the tape longitudinal direction is provided in the upstream in the feeding direction.

In addition, the distance l3 in the reverse direction to the tape discharge direction (direction of the arrow A1), that is, in the upstream in the tape feeding direction from the sensor mark 65 may be of a dimension in a range of (l1+l2)+l5/2+a≦l3<L−l5/2-a when it is assumed that the length in the tape longitudinal direction in the non-print area in which the wireless tag circuit element 32 is disposed is l5 and that the minimum print width is a, instead of l3=(L+(l1+l2)/2, the first print area may be provided in the downstream in the feeding direction across the non-print area in which the wireless tag circuit element 32 is disposed while the second print area may be provided in the upstream in the feeding direction.

When the sensor mark 65 of the printed label tape 28 reaches a position opposite to the antenna 33 and the reflection type sensor 35, the cutter unit 30 becomes opposite to a position corresponding to the tape length l1 on the tape cassette 21 side from this sensor mark 65. The thermal head 9 is located at a position corresponding to the tape length l4=(l1+l2) on the tape cassette 21 side, that is, in the upstream in the tape feeding direction from the sensor mark 65 opposite to the antenna 33 and the reflection type sensor 35, being opposite to the front edge portion of the first print area of the printing object tape 533. When the sensor mark 65 of the printed label tape 28 is fed by a distance of (l1+l2) from a position opposite to the antenna 33 and the reflection type sensor 35, the wireless tag circuit element 32 is disposed at a position corresponding to a tape length (l3−(l1+l2)) on the thermal head 9 side from the antenna 33 and the reflection type sensor 35.

Next the control structure of the tape printing apparatus 1 will now be described with reference to FIG. 10.

Figure 10:
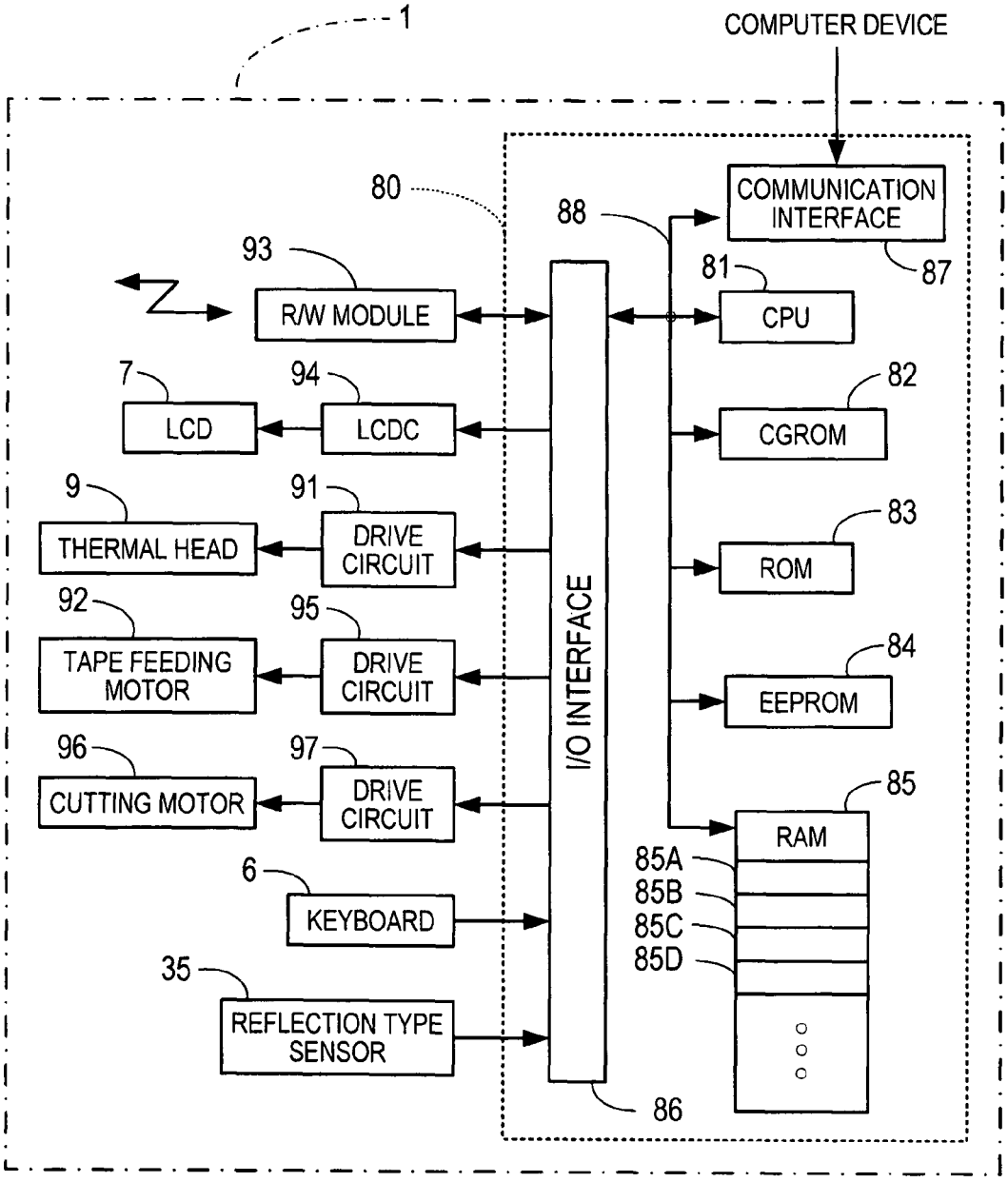
FIG. 10 is a block diagram showing the control configuration of the tape printing apparatus of this embodiment.

As shown in FIG. 10, a control circuit portion 80 formed on a control board 12 of the tape printing apparatus 1 comprises a CPU 81, a CG (character generator) ROM 82, a ROM 83, a flash memory (EEPROM) 84, a RAM 85, an I/O interface (I/F) 86, a communication interface (I/F) 87 and the like. Further, the CPU 81, the CGROM 82, the ROM 83, the flash memory 84, the RAM 85, the I/O interface (I/F) 86 and the communication interface (I/F) 87 are connected to one another through a bus line 88 so as to exchange data.

A dot pattern data corresponding to each character is stored in the CGROM 82, and is read out from the CGROM 82, and the dot pattern is displayed on the liquid crystal display (LCD) 7 based on its dot pattern data.

The ROM 83 stores various kinds of programs and as described later, a program for reading out the cassette information about the tape cassette 21 from the wireless tag circuit element 25 of the tape cassette 21 and displaying a virtual tape which indicates the print area of the printing object tape 531, 532, 533, processing program for setting a print condition, and a processing program for writing a predetermined information in the wireless tag circuit element 32 of the printed label tape 28 and after that cutting this printed label tape 28 and the like are stored preliminarily.

The CPU 81 executes various kinds of arithmetic operations based on various kinds of programs stored in the ROM 83. The ROM 83 stores a print dot patterns data, about a plurality of characters for printing characters such as alphabetic letters, numerals, symbols and the like, classified depending on each font (Gothic type face, Ming-style type face), corresponding to print sizes of a plurality of kinds (dot sizes, for example, 16, 24, 32, 48) of each font and a cord data. Further, a graphic pattern data for printing a graphic image containing gradation expression is also stored. In this ROM 83, various kinds of programs necessary for control of the tape printing apparatus 1, such as a display control program for controlling a liquid crystal display controller (LCDC) 94 corresponding to the cord data of characters such as letters and numerals inputted via the keyboard 6, a print drive control program for reading data of a print buffer 85A and driving the thermal head 9 and the tape feeding motor 92.

The flash memory 84 stores data about cassette information read from the wireless tag circuit element 25 of the tape cassette 21 through the read and write module 93, a print data received from an external computer or the like through the connector 18, and a dot pattern data about various graphic data and the like with each registration number, and maintains these memory contents even when the power of the tape printing apparatus 1 is turned OFF.

The RAM 85 stores results of various kinds of arithmetic operations performed by the CPU 81 temporarily. The RAM 85 includes various kinds of memory areas, for example, a print buffer 85A, an edit input area 85B, a display image buffer 85C, a work area 85D. This print buffer 85A stores a print dot pattern such as a plurality of letters and symbols as a dot pattern data and the thermal head 9 performs dot-printing following the dot pattern data stored in the print buffer 85A. The edit input area 85B stores an edit text such as a document data inputted through the keyboard 6, as a print data. The display image buffer 85C stores a graphic data and the like to be displayed on the liquid crystal display 7.

The keyboard 6, the reflection type sensor 35, the read and write module (R/W module) 93 for reading and writing information of the respective wireless tag circuit elements 25 and 32 through the antennas 25 and 33, a display controller (LCDC) 94 having a video RAM for outputting a display data to a liquid crystal display (LCD) 7, a drive circuit 91 for driving the thermal head 9, a drive circuit 95 for driving the tape feeding motor 92 and a drive circuit 97 for driving a cutting motor 96 are connected to the I/F 86.

The communication I/F 87 is constituted of, for example, a USB (Universal Serial Bus) or the like and connected to an external computer through a USB cable and the like so as to enable bidirectional data communication.

When letters are inputted through character keys of the keyboard 6, the text (document data) is stored sequentially in the edit input area 85B and a dot pattern corresponding to letters and the like inputted through the keyboard 6 based on the dot pattern generation control program and the display drive control program is displayed on the liquid crystal display (LCD) 7. The thermal head 9 is driven through the drive circuit 91 so as to print the dot pattern data stored in the print buffer area 85A and the tape feeding motor 92 controls tape feeding through the drive circuit 95 synchronously therewith. The print data inputted through the communication I/F 87 from an external computer is stored sequentially by the edit input area 85B and stored in the print buffer area 85A based on the dot pattern generation control program as the dot pattern data and then, printed to the heat sensitive type printing object tapes 531, 532 and 533 through the thermal head 9.

Next, the functional configuration of the read and write module (R/W module) 93 will now be described with reference to FIG. 11.

Figure 11:
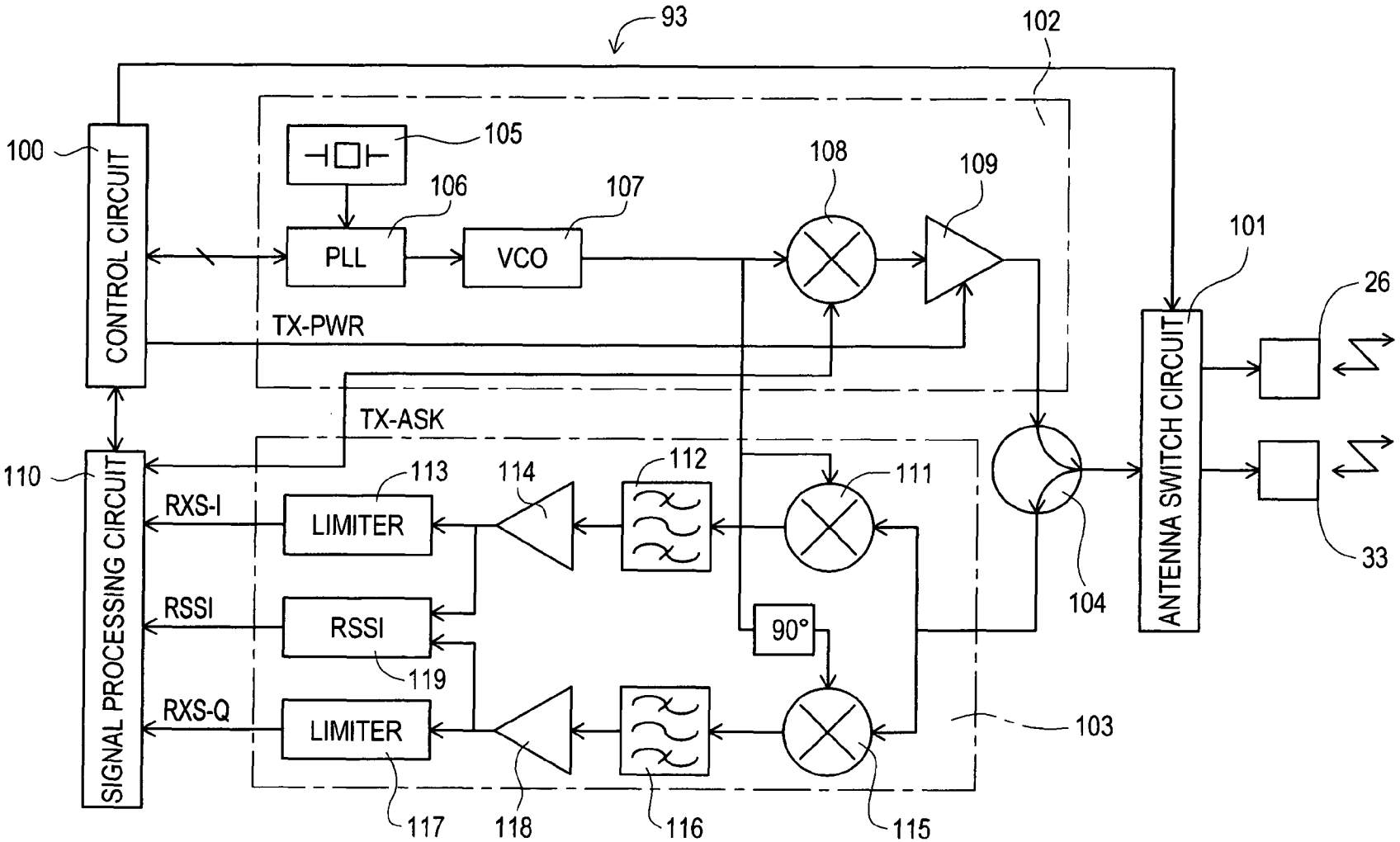
FIG. 11 is a functional block diagram showing the detailed function of the read and write module (R/W module) of the tape printing apparatus of this embodiment.

As shown in FIG. 11, the read and write module 93 comprises an antenna switch (selection) circuit 101 which is switched by a control circuit 100, a transmitting portion 102 for transmitting a signal to the wireless tag circuit elements 25 and 32 through the antennas 26 and 33 via this antenna switch circuit 101, a receiving portion 103 in which a reflected wave from the wireless tag circuit elements 25 and 32 received by the antennas 26 and 33 is inputted and a transmission and receiving separator 104.

This antenna switch circuit 101 is a switch circuit using a known high frequency FET or a diode and connects either of the antennas 26 or 33 to the transmission and receiving separator 104 by a selection signal from the control circuit 100.

The transmitting portion 102 comprises a crystal oscillator 105 for generating a carrier for accessing (reading and writing) the wireless tag information of the IC circuit portion 67 in the respective wireless tag circuit elements 25, 32, a PLL (Phase Locked Loop) 106, a VCO (Voltage Controlled Oscillator) 107, a transmission multiplexing circuit 108 (for amplitude modulation, an amplification factor variable amplifier or the like may be used) for modulating the carrier generated based on a signal supplied from a signal processing circuit 111 in order to process a signal read out from the wireless tag circuit elements 25 and 32, and a transmission amplifier 109 for amplifying (in this example, amplification whose amplification factor is determined by a "TX_PWR" signal from the control circuit 100) the modulation wave modulated by the transmission multiplexing circuit 108. Preferably, the generated carrier uses a frequency in a UHF band, and an output of the transmission amplifier 109 is transmitted to any of the antennas 26 and 33 through the transmission and receiving separator 104 and supplied to the IC circuit portion 67 of the wireless tag circuit elements 25, 32.

The receiving portion 103 comprises a receiving first multiplexing circuit 111 which multiplexes a reflected wave from the wireless tag circuit elements 25, 32 received by the antennas 26, 33 with the generated carrier, a first band-pass filter 112 for fetching out only a signal of necessary band from an output of the receiving first multiplexing circuit 111, a receiving first amplifier 114 which amplifies an output of the first band-pass filter 112 and supplies to a first limiter 113, a receiving second multiplexing circuit 115 which multiplexes a reflected wave from the wireless tag circuit elements 25 and 32 received by the antennas 26 and 33 with the carrier shifted by 90° in phase after the above-described generation, a second band-pass filter 116 for fetching out only a signal of a necessary band from an output of the receiving second multiplexing circuit 115, and a receiving second amplifier 118 in which the output of the second band-pass filter 116 is inputted and amplified so as to be supplied to the second limiter 117. The signal "RXS-I" outputted from the first limiter 113 and the signal "RXS-Q" outputted from the second limiter 117 are inputted to the signal processing circuit 110 and processed therein.

Outputs of the receiving first amplifier 114 and the receiving second amplifier 118 are inputted to an RSSI (Received Signal Strength Indicator) circuit 119 and the signal "RSSI" indicating the strength of the signal is inputted to the signal processing circuit 110. In this way, in the read and write module 93 of this embodiment, demodulation of the reflected wave from the wireless tag circuit elements 25, 32 is carried out by I-Q orthogonal demodulation.

Next, the functional configuration of the wireless tag circuit elements 25 and 32 will now be described with reference to FIG. 12. In addition, because the functional configurations of the wireless tag circuit element 25 and the wireless tag circuit element 32 are substantially same, the functional configuration of the wireless tag circuit element 32 will be described.

Figure 12:
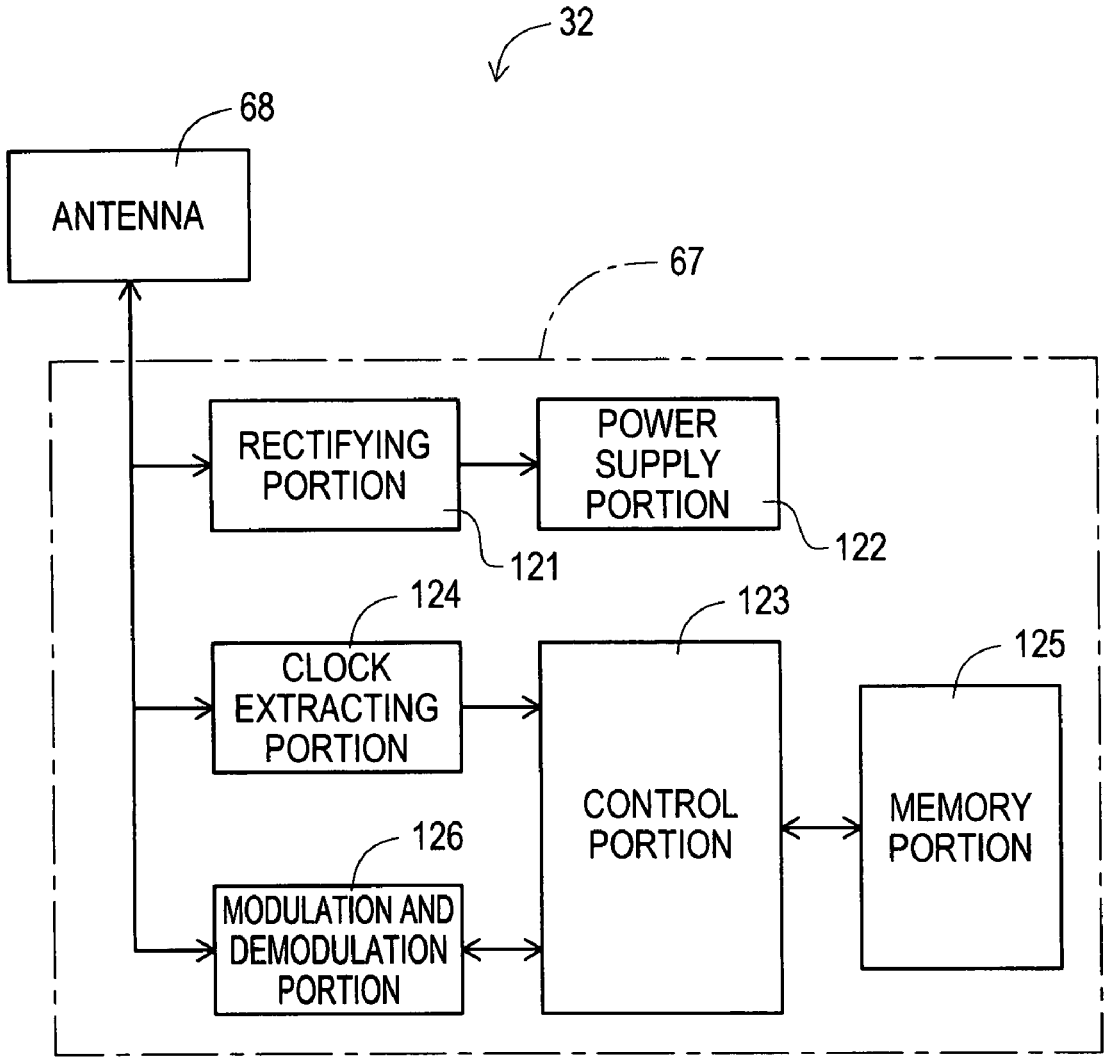
FIG. 12 is a functional block diagram showing the functional configuration of the tape printing apparatus of this embodiment.

As shown in FIG. 12, the wireless tag circuit element 32 comprises the antenna (IC circuit side antenna) 68 for transmitting and receiving a signal in non-contact state with respect to the antenna 33 on the read and write module 93 side using high frequency such as a UHF band wave and the IC circuit portion 67 connected to this antenna 68.

The IC circuit portion 67 comprises a rectifying portion 121 for rectifying a carrier received by the antenna 68, a power supply portion 122 for accumulating energy of the carrier rectified by this rectifying portion 121 and using it as a drive power supply, a clock extracting portion 124 for extracting a clock signal from the carrier received by the antenna 68 and supplying it to a control portion 123, a memory portion 125 for functioning as an information memory means capable of storing a predetermined information signal, a modulation and demodulation portion 126 connected to the antenna 68, and the control portion 123 for controlling an operation of the wireless tag circuit element 32 through the rectifying portion 121, the clock extracting portion 124 and the modulation and demodulation portion 126 and the like.

The modulation and demodulation portion 126 demodulates a wireless communication signal from the antenna 33 of the read and write module 93 received by the antenna 68, and modulates and reflects the carrier received by the antenna 68 based on a response signal from the control portion 123.

The control portion 123 executes basic control by interpreting a reception signal demodulated by the modulation and demodulation portion 126, generating a return signal based on information signal stored in the memory portion 125 and sending back by this modulation and demodulation portion 126 and the like.

Although detailed illustration is omitted, the wireless tag circuit element 25 provided on the tape cassette 21 has the same structure as the wireless tag circuit element 32 and is provided with the IC circuit 67 (not shown), the antenna 68 (not shown) and the like.

Next, an example of the cassette information stored in the memory portion 125 of the wireless tag circuit element 25 provided on the tape cassette 21 in which the printing object tape 531 of type 1 is accommodated will now be described with reference to FIG. 13.

As shown in FIG. 13, the memory portion 125 of the wireless tag circuit element 25 provided on the tape cassette 21 is constituted of a "data type" and a "data content" corresponding to this "data type".

The "tape width" indicating a tape width of the accommodated printing object tape 531 is stored in the "data type", and "12 mm" is stored as the "data content" corresponding to this "data width". The "tape type" indicating the tape type of the accommodated printing object tape 531 is stored in the "data type" and "heat sensitive tape (with adhesive agent)" is stored as the "data content" corresponding to this "tape type". Further, "tape length" indicating the length of the accommodated tape is stored in the "data type", and "8 m" is stored as the "data content" corresponding to this "data length". A predetermined pitch length in which the wireless tag circuit element 32 is disposed, that is, "IC chip pitch length L" indicating the length of the predetermined pitch in which the sensor mark 65 is disposed is stored in the "data type", and "100 mm" is stored as "data content" corresponding to this "IC chip pitch length L". "Print range" indicating the print area is stored in the "data type" and "range of 25 to 90 mm from the sensor mark position (left)" indicating the length in the longitudinal direction of the print area from the sensor mark 65 on the feeding direction side is stored as the "data content" corresponding to the "print range". Consequently, l4=25 mm. "Sensor mark=IC chip center position l3" indicating a distance l3 (see FIG. 7) from the sensor mark 65 on the feeding direction side to the wireless tag circuit element 32 in the upstream in the feeding direction is stored in the "data type", and "95 mm" is stored as the "data content" corresponding to this "sensor mark=IC chip center position l3". A "print color" indicating the color of letters and the like to be printed on the printing object tape 531 is stored in the "data type", and "black" is stored as the "data content" corresponding to this "print color".

Next, an example of the cassette information to be stored in the memory portion 125 of the wireless tag circuit element 25 provided on the tape cassette 21 in which the printing object tape 532 of type 2 is accommodated will now be described with reference to FIG. 14.

As shown in FIG. 14, the memory portion 125 of the wireless tag circuit element 25 provided on the tape cassette 21 is constituted of the "data type" and the "data content" corresponding to each "data type".

The "tape width" indicating the tape width of the accommodated printing object tape 532 is stored in the "data type", and "12 mm" is stored as the "data content" corresponding to this "tape width". The "tape type" indicating the tape type of the accommodated printing object tape 532 is stored in the "data type", and "heat sensitive tape (with adhesive agent)" is stored as the "data content" corresponding to this "tape type". Further, the "tape length" indicating the length of an accommodated tape is stored in the "data type", and "8 m" is stored as the "data content" corresponding to this "tape length". "IC chip pitch length L" indicating a predetermined pitch length by which the wireless tag circuit element 32, that is, a predetermined pitch length by which the sensor mark 65 is disposed is stored in the "data type", and "100 mm" is stored as the "data content" corresponding to this "IC pitch length L". The "print range" indicating a print area is stored in the "data type" and a "range of 35 to 100 mm from the sensor mark position (left)" indicating the length in the longitudinal direction of the print area from the sensor mark 65 on the feeding direction side is stored as the "data content" corresponding to this "print range". Consequently, l4=35 mm. Further, the "sensor mark=IC chip center position l3" indicating the distance l3 from the sensor mark 65 on the feeding direction side to the wireless tag circuit element 32 in the upstream in the feeding direction is stored in the "data type", and "30 mm" is stored as the "data content" corresponding to this "sensor mark=IC chip center position l3". The "print color" indicating the color of letters or the like to be printed on the printing object tape 532 is stored in the "data type", and "black" is stored as the "data content" corresponding to this "print color".

Next, an example of the cassette information stored in the memory portion 125 of the wireless tag circuit element 25 provided on the tape cassette 21 in which the printing object tape 533 of type 3 is accommodated will now be described with reference to FIG. 15.

As shown in FIG. 15, the memory portion 125 of the wireless tag circuit element 25 provided on the tape cassette 21 is constituted of the "data type" and the "data content" corresponding to this "data type".

The "tape width" indicating the tape width of the accommodated printing object tape 533 is stored in the "data type", and "12 mm" is stored as the "data content" corresponding to this "tape width". Further, the "tape type" indicating the tape type of the accommodated printing object tape 533 is stored in the "data type", and "heat sensitive tape (with adhesive agent) is stored as the "data content" corresponding to this "tape type". Further, the "tape length" indicating the length of an accommodated tape is stored in the "data type", and "8 m" is stored as the "data content" corresponding to this "tape length". The "IC chip pitch length L" indicating a predetermined pitch length by which the wireless tag circuit element 32 is disposed, that is, the predetermined pitch length by which the sensor mark 65 is disposed is stored in the "data type", and "100 mm" is stored as the "data content" corresponding to this "IC chip pitch length L". The "print range" indicating the first print area and the second print area is stored in the "data type", and "range of 25 to 57.5 mm, 67.5 to 100 mm from the sensor mark position (left)" indicating the length in the longitudinal direction of the first print area and second print area from the sensor mark 65 on the feeding direction side is stored as the "data content" corresponding to this "print range". Consequently, the length in the longitudinal direction of the tape from the sensor mark 65 to the front edge portion of the first print area of the printing object tape 533 is l4=25 mm, the length in the longitudinal direction of the tape in the non-print area is l5=10 mm, the length in the tape longitudinal direction in the first print area is l6=32.5, and the length in the tape longitudinal direction of the second print area is l7=32.5 mm. Further, "sensor mark=IC chip center position l3" indicating the distance l3 (see FIG. 9) from the sensor mark 65 on the feeding direction side to the wireless tag circuit element 32 in the upstream in the feeding direction is stored in the "data type", and "62.5 mm" is stored as the "data content" corresponding to this "sensor mark=IC chip center position l3". "Print color" indicating the color of letters to be printed on the printing object tape 533 is stored in the "data type", and "black" is stored as the "data content" corresponding to this "print color".

In this embodiment, the types of the "tape width" of the printing object tape 53 to be accommodated in the tape cassette 21 have total 8 types, that is, 3.5 mm, 6 mm, 9 mm, 12 mm, 18 mm, 24 mm, 36 mm and 48 mm. The types of the "tape type" of the printing object tape 53 to be accommodated in the tape cassette 21 have total 4 types, that is, a receptor tape (with adhesive agent), a heat sensitive tape (with adhesive agent), a receptor tape (without adhesive agent) and a heat sensitive tape (without adhesive agent). The type of the "tape length" of the printing object tape 53 to be accommodated in the tape cassette 21 have total 3 types, 5 m, 8 m and 16 m. The types of the "print color" indicating the color of letter for the printing object tape 53 to be accommodated in the tape cassette 21 include black, red, blue, green, yellow, magenta, cyan and the like.

When the "tape type" of the printing object tape 53 is the receptor tape (without adhesive agent) or the heat sensitive tape (without adhesive agent), the wireless tag circuit element 32 and the sensor mark 65 are provided on the back face of the base tape.

Next, control processing for creating the printed label tape for the tape printing apparatus 1 having such a structure will now be described with reference to FIGS. 16 to 63.

Figure 16:
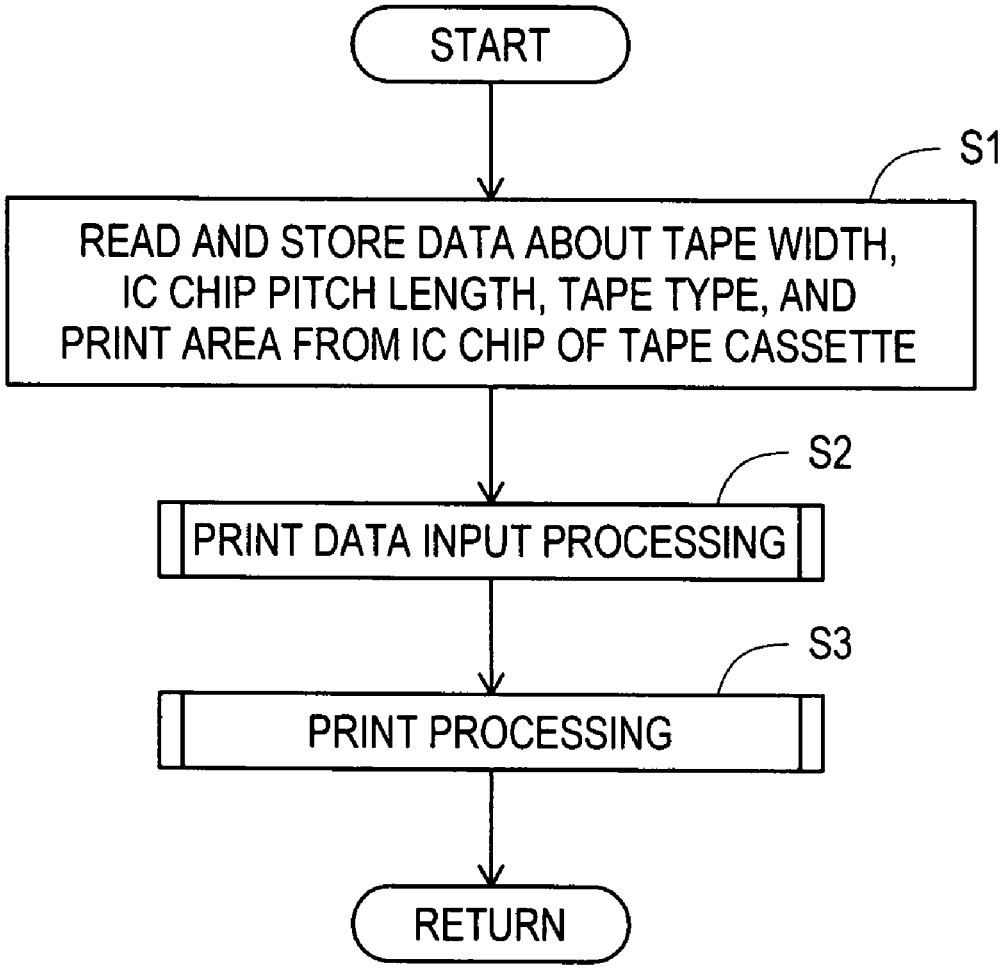
FIG. 16 is a main flow chart showing control processing of producing a printed label tape of the tape printing apparatus of this embodiment.

As shown in FIG. 16, first, in step (hereinafter abbreviated as S) 1, the CPU 81 of the tape printing apparatus 1 reads respective data about "tape width", "tape type", "tape length", "IC chip pitch length L", "print range", "sensor mark=IC chip center position l3", and "print color" to be stored in the memory portion 125 of the wireless tag circuit element 25 from the wireless tag circuit element 25 provided on the tape cassette 21 through the read and write module 93 when the CPU 81 is started or the tape cassette 21 is loaded, and stores into the RAM 85.

In S2, the CPU 81 executes sub-processing of print data input processing.

Subsequently, in S3, the CPU 81 terminates the processing after the sub-processing of the print processing is executed.

Next, the sub-processing of the print data input processing will now be described with reference to FIGS. 17 to 23.

Figure 17:
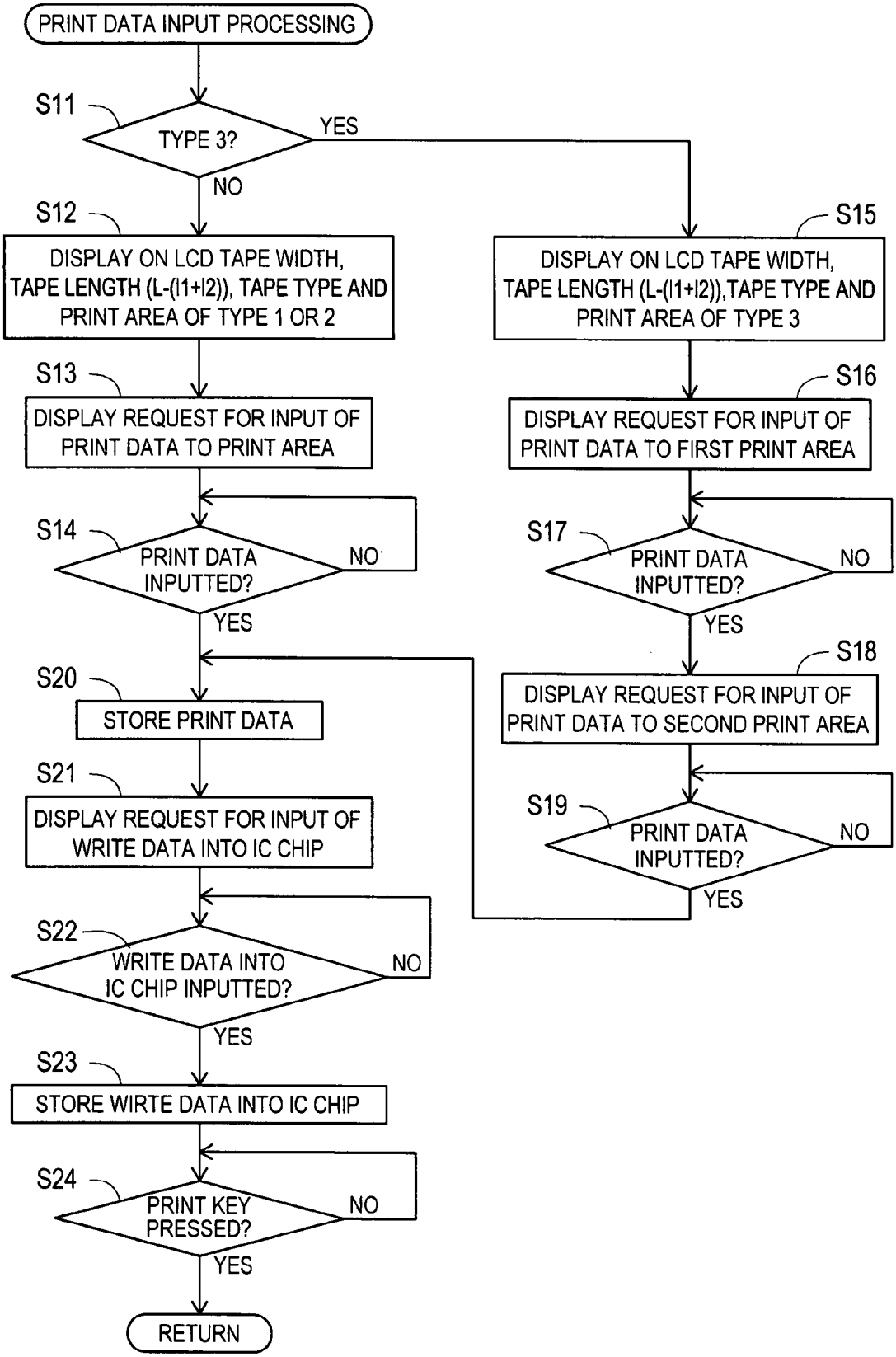
FIG. 17 is a sub-flow chart showing sub-processing of print data input processing in the tape printing apparatus of this embodiment.

As shown in FIG. 17, in S11, the CPU 81 executes determination processing of determining whether or not the printing object tape 533 of type 3 is accommodated in the tape cassette 21. More specifically, the CPU 81 reads out data of the "print range" from the RAM 85 and if the "print range" is constituted of two print range data, it is determined that the printing object tape 533 of type 3 is accommodated in the tape cassette 21. On the other hand, if this read out the "print range" is constituted of one print range data, the CPU 81 determines that the printing object tape 531 of type 1 or the printing object tape 532 of type 2 is accommodated in the tape cassette 21.

Then, if it is determined that no printing object tape 533 of type 3 is accommodated in the tape cassette 21 (S11: NO), in S12, the CPU 81 reads out data of the "IC chip pitch length L" and the "print range" from the RAM 85 and creates and displays a virtual tape indicating a print area containing no wireless tag circuit element 32 on the printing object tape 53 on the liquid crystal display 7. In other words, a portion including the wireless tag circuit element 32 on the print tape 53 turns into a non-print area.

Figure 18:
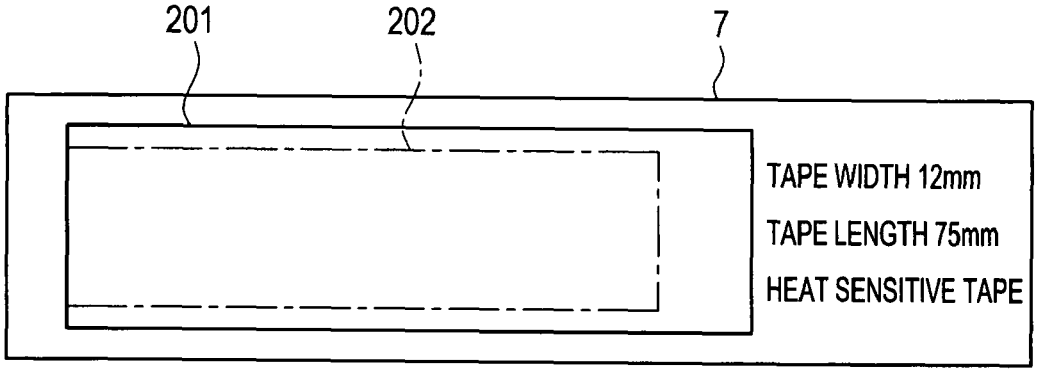
FIG. 18 is a diagram showing an example of a display on the screen of data input request to be displayed on a liquid crystal display when a tape cassette accommodating the printing object tape of type 1 is loaded at the time of input of print data into the tape printing apparatus of this embodiment.

For example, if the CPU 81 determines that the printing object tape 531 of type 1 is accommodated in the tape cassette 21 as shown in FIG. 18 (for example, if the "print range" data is read out from the RAM 85 and the right end side data of the "print range" is equal to or smaller than the data of the "IC chip pitch length L" by a predetermined width (for example, about 10 mm), it is determined that the printing object tape 531 of type 1 is accommodated in the tape cassette 21), a virtual tape 201 having a length determined by subtracting a length (l1+l2) that means the distance from the antenna 33 to the thermal head 9 from a data value of the "IC chip pitch length L" is displayed. The "tape width" is displayed on the right side to the virtual tape 201. Further, the tape length of the virtual tape 201 is displayed below it. The "tape type" is displayed below it. Then, the CPU 81 displays a print area 202 on the virtual tape 201 from the data value of the "print range", and the right side area serves as a non-print area.

Figure 19:
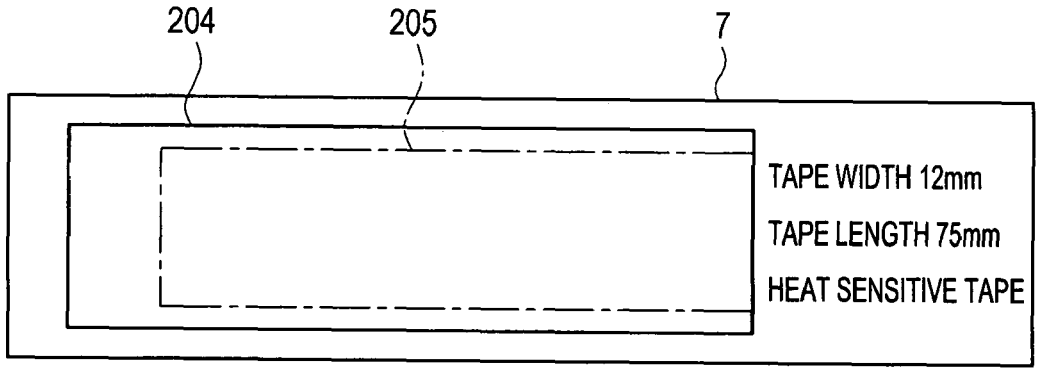
FIG. 19 is a diagram showing an example of a display on the screen of data input request to be displayed on a liquid crystal display when a tape cassette accommodating the printing object tape of type 2 is loaded at the time of input of print data into the tape printing apparatus of this embodiment.

As shown in FIG. 19, if the CPU 81 determines that the printing object tape 532 of type 2 is accommodated in the tape cassette 21 (for example, data of "print range" is read out from the RAM 85 and if the right end side data of the "print range" is almost equal to the data of the "IC chip pitch length L", it is determined that the printing object tape 532 of type 2 is accommodated in the tape cassette 21), a virtual tape 204 of a length determined by subtracting a length (l1+l2) that means the distance from the antenna 33 to the thermal head 9 from the data value of the "IC chip pitch length L" is displayed. The "tape width" is displayed on the right of the virtual tape 204. The "tape length" of the virtual tape 204 is displayed below it. Further, the "tape type" is displayed below it. Then, the CPU 81 displays a print area 205 on the virtual tape 204 from the data value of the "print range", and a left side portion serves as a non-print area.

Subsequently, in S13, the CPU 81 requests for inputting a print data to the print area. For example, a cursor mark is displayed by blinking in the print areas 202 and 205.

Figure 21:
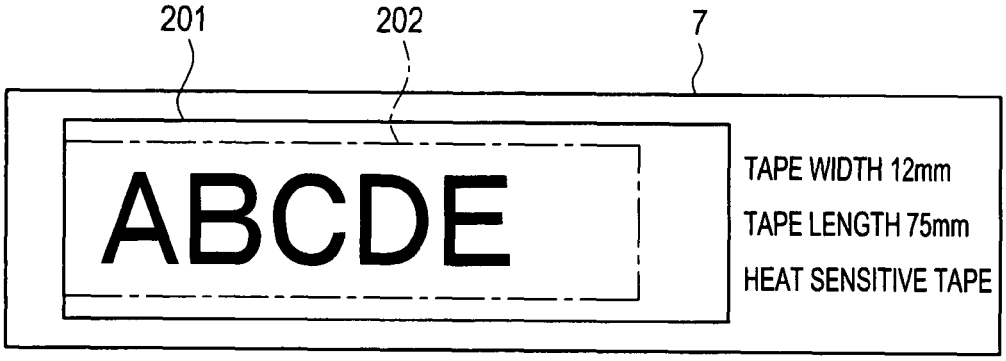
FIG. 21 is a diagram showing an example of a display on the screen at the time of character data input, displayed on the liquid crystal display 7 when a tape cassette accommodating the printing object tape of type 1 is loaded at the time of input of print data into the tape printing apparatus of this embodiment.
Figure 22:
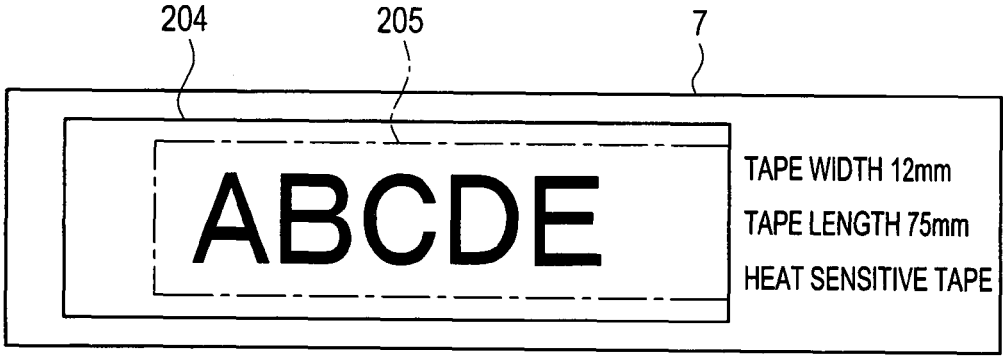
FIG. 22 is a diagram showing an example of a display on the screen at the time of character data input, displayed on the liquid crystal display 7 when a tape cassette accommodating the printing object tape of type 2 is loaded at the time of input of print data into the tape printing apparatus of this embodiment.

In S14, the CPU 81 displays print data inputted through the keyboard 6 in a print area, and waits for all print data to be inputted and the return key 4 to be pressed (S14: NO). For example, as shown in FIG. 21, it displays a print data "ABCDE" in the print area 202 and waits for the return key 4 to be pressed. Further, as shown in FIG. 22, it displays a print data "ABCDE" in the print area 205 and waits for the return key 4 to be pressed.

On the other hand, if it is determined that the printing object tape 533 of type 3 is accommodated in the tape cassette 21 (S11: YES), in S15, the CPU 81 reads out data about the "IC chip pitch length L" and the "print range" from the RAM 85, and creates and displays a virtual tape indicating the first print area and the second print area on both sides across the wireless tag circuit element 32 on the printing object tape 53 in the liquid crystal display 7. That is, the portion containing the wireless tag circuit element 32 on the print tape 53 serves as a non-print area.

Figure 20:
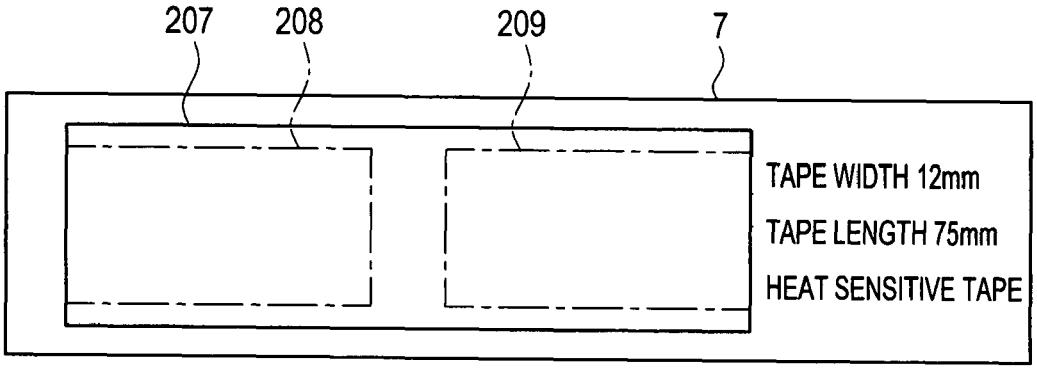
FIG. 20 is a diagram showing an example of a display on the screen of data input request to be displayed on a liquid crystal display when a tape cassette accommodating the printing object tape of type 3 is loaded at the time of input of print data into the tape printing apparatus of this embodiment.

For example, as shown in FIG. 20, if the CPU 81 determines that the printing object tape 533 of type 3 is accommodated in the tape cassette 21, it displays a virtual tape 207 of length determined by subtracting a length (l1+l2) that means the distance from the antenna 33 to the thermal head 9 from data value of "IC chip pitch length L". Further, the "tape width" is displayed on the right of the virtual tape 201. The tape length of the virtual tape 201 is displayed below it. Additionally, the "tape type" is displayed below it. Then, the CPU 81 displays a first print area 208 and a second print area 209 across the non-print area in the central portion on the virtual tape 207 from the data value of the "print range".

Subsequently, in S16, the CPU 81 requests for inputting a print data to the first print area. For example, it displays the cursor mark by blinking in the first print area 208.

In S17, the CPU 81 displays print data inputted through the keyboard 6 in the first print area, and waits for all print data to be inputted and the return key 4 to be pressed (S17: NO).

When the return key 4 is pressed (S17: YES), in S18, the CPU 81 requests for inputting a print data into the second print area. For example, the cursor mark is displayed by blinking in the second print area 209.

In S19, the CPU 81 displays print data inputted through the keyboard 6 in the second print area, and waits for all print data to be inputted and the return key 4 to be pressed (S19: NO).

Figure 23:
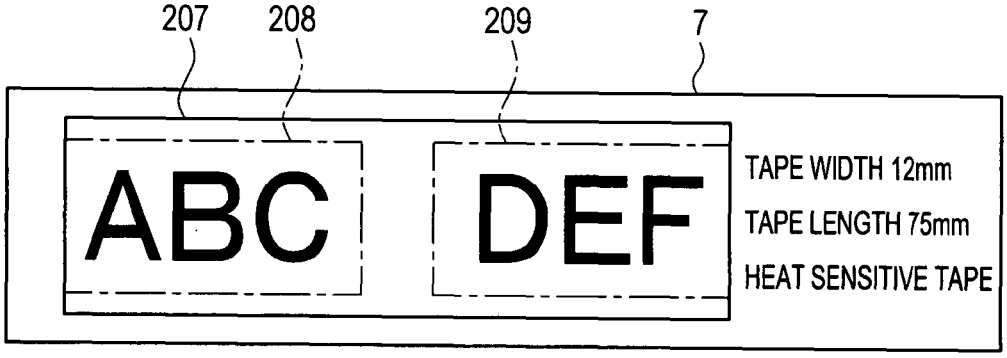
FIG. 23 is a diagram showing an example of a display on the screen at the time of character data input, displayed on the liquid crystal display 7 when a tape cassette accommodating the printing object tape of type 3 is loaded at the time of input of print data into the tape printing apparatus of this embodiment.

As shown in FIG. 23, the print data "ABC" is displayed in the first print area 208, the print data "DEF" is displayed in the second print area 209 and it waits for the return key 4 to be pressed.

When the return key 4 is pressed after the print data is inputted (S14: YES, S19: YES), in S20, the CPU 81 stores this print data in the edit input area 85B as the print data of a label tape.

Subsequently, in S21, the CPU 81 displays a request for inputting the write data to be written into the wireless tag circuit element 32 on the liquid crystal display 7. This write data includes data about product price, recommended expiration date, manufacturing date, manufacturing workshop, and file data about product information which is inputted from an external computer unit through the communication interface 87 and stored preliminarily in the RAM 85.

In S22, the CPU 81 waits for input of write data to be written into the wireless tag circuit element 32 (S22: NO). When data about product price and the like and file name about product information are inputted through the keyboard 6 (S22: YES), in S23, the CPU 81 stores data about product price and the like and file data about a product information inputted through this keyboard 6 as a write data to be stored into the memory portion 125 of the wireless tag circuit element 32.

After that, in S24, the CPU 81 waits for the print key 3 to be pressed (S24: NO). Then, when the print key 3 is pressed (S24: YES), the CPU 81 terminates the sub-processing and returns to the main flowchart.

Next, the sub-processing of the "print processing" will now be described with reference to FIG. 24.

Figure 24:
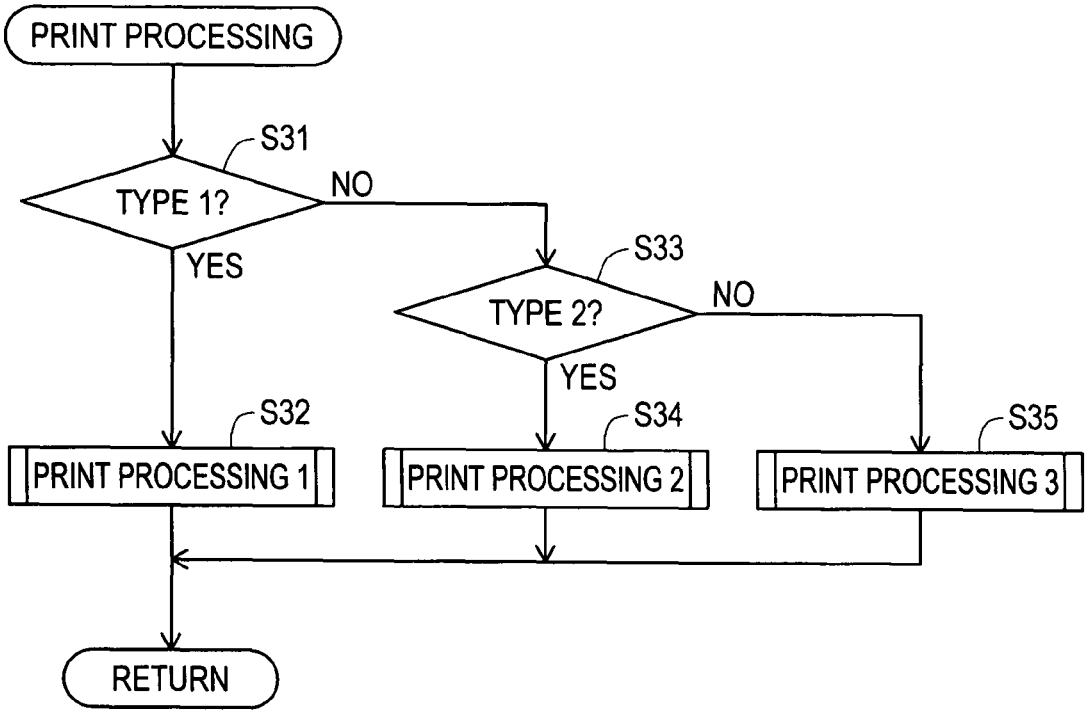
FIG. 24 is a sub-flow chart showing sub-processing of print processing of the tape printing apparatus of this embodiment.

As shown in FIG. 24, in S31, the CPU 81 executes a determination processing of determining whether or not the printing object tape 531 of type 1 is accommodated in the tape cassette 21. More specifically, when data of the "print range" is read out, the "print range" is constituted of data of a single print range and the right end side data of the "print range" is smaller than data of the "IC chip pitch length L" by the predetermined width, the CPU 81 determines that the printing object tape 531 of type 1 is accommodated in the tape cassette 21. The predetermined width refers to a width, for example, falls under 10 mm or more to 20 mm or less in a case where the wireless tag circuit element 32 exists on the right end side of the "print range". The reason why it is 20 mm or less in this context is that a case where a portion left by removing the width of the wireless tag circuit element 32 is equal to or less than a minimum length required for printing is assumed.

When it is determined that the printing object tape 531 of type 1 is accommodated in the tape cassette 21 (S31: YES), in S32, the CPU 81 executes sub-processing of the "print processing 1" and after that, completes the sub-processing and returns to the main flowchart.

On the other hand, if it is determined that the printing object tape 531 of type 1 is not accommodated in the tape cassette 21 (S31: NO), in S33, the CPU 81 executes determination processing of determining whether or not the printing object tape 532 of type 2 is accommodated in the tape cassette 21. More specifically, the CPU 81 reads out the data of the "print range" from the RAM 85 and if the "print range" is constituted of data of a single print range and the right end side data of the "print range" is substantially equal to data of the "IC chip pitch length L", it is determined that the printing object tape 532 of type 2 is accommodated in the tape cassette 21.

Then, when it is determined that the printing object tape 532 of type 2 is accommodated in the tape cassette 21 (S33: YES), in S34, the CPU 81 executes sub-processing of the "print processing 2" and after that, completes the sub-processing and returns to the main flowchart.

On the other hand, when it is determined that the printing object tape 532 of type 2 is not accommodated in the tape cassette 21, that is, when it is determined that the printing object tape 533 of type 3 constituted of data including two "print ranges" is accommodated in the tape cassette 21 (S33: NO), in S35, the CPU 81 executes the sub-processing of the "print processing 3" and after that, completes the sub-processing and returns to the main flowchart.

Next, the sub-processing of the "print processing 1" will now be described with reference to FIGS. 25 to 30.

Figure 25:
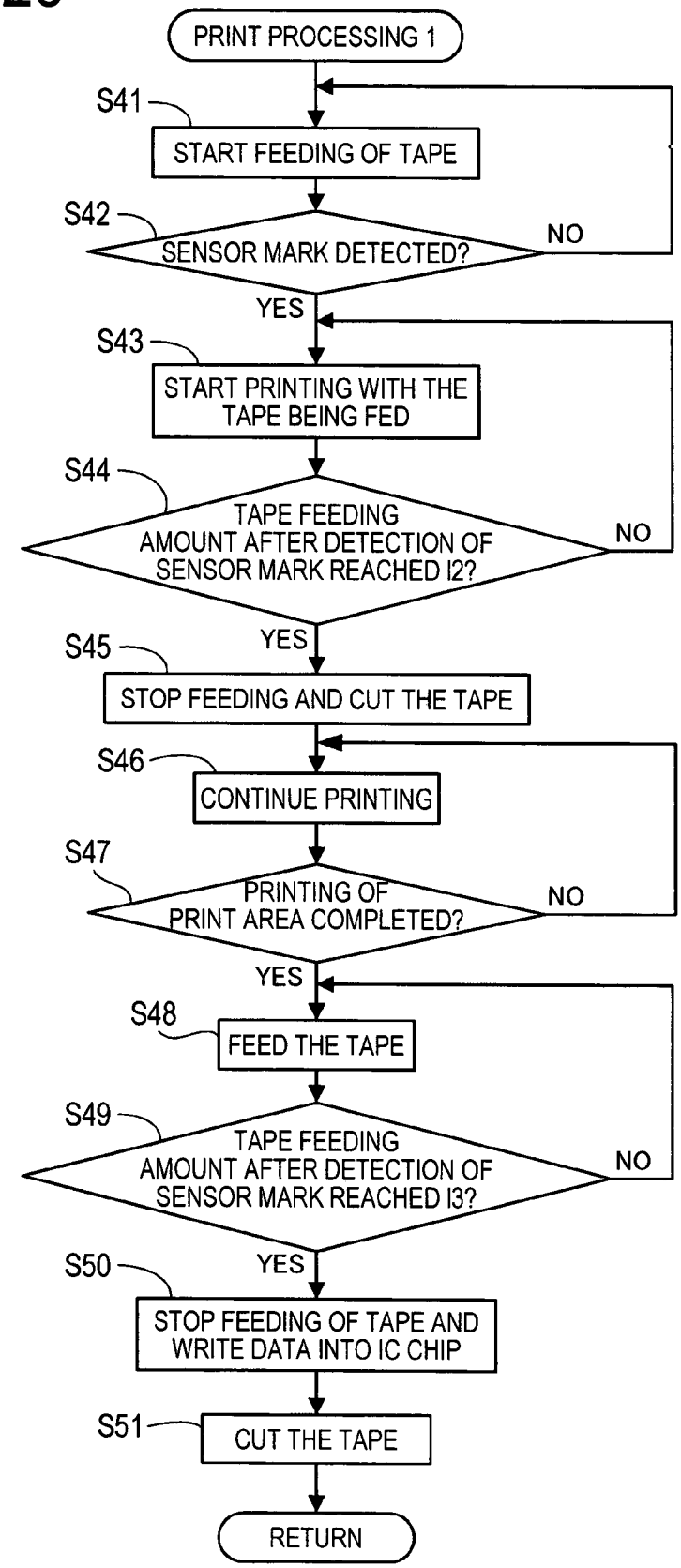
FIG. 25 is a sub-flow chart showing sub-processing of print processing 1 of the tape printing apparatus of this embodiment.
Figure 26:
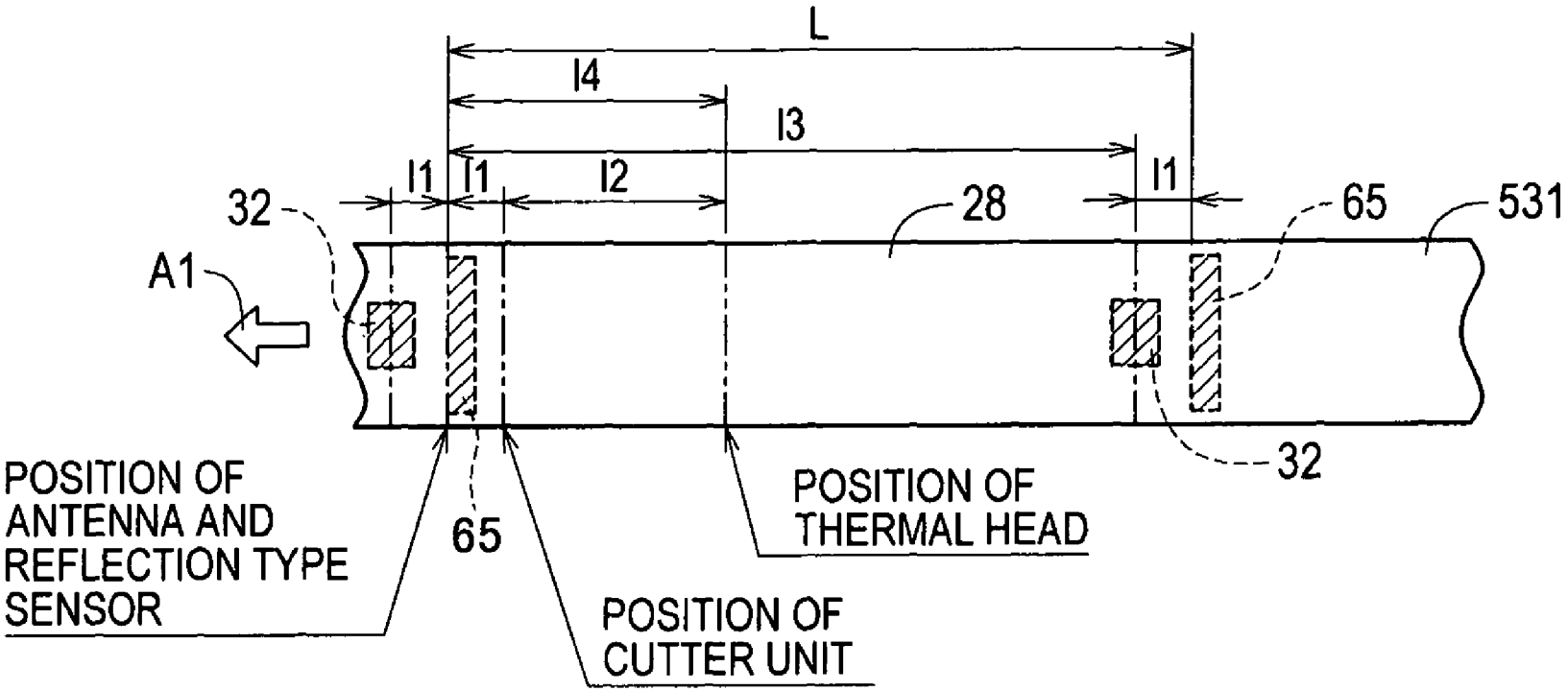
FIG. 26 is a diagram for explaining schematically an example of the printing object tape of type 1 of this embodiment, and a diagram showing schematically a positional relationship between the sensor mark and the wireless tag circuit element.

As shown in FIG. 25, in S41, the CPU 81 drives the tape feeding motor 92 so as to rotate the tape feeding roller 63 so that feeding of the printed label tape 28 is started by the tape feeding roller 63 and the tape sub-roller 11.

In S42, determination processing of determining whether or not the sensor mark 65 printed on the back face portion of the printed label tape 28 is detected through the reflection type sensor 35 is executed. Then, when the sensor mark 65 is not detected through the reflection type sensor 35 (S42: NO), the CPU 81 executes a processing following S41 again. On the other hand, when a front end portion in the feeding direction of the sensor mark 65 is detected through the reflection type sensor 35 (S42: YES), in S43, the CPU 81 drives the tape feeding motor 92 continuously and feeds the printed tape 531 and starts printing of a print data through the thermal head 9.

Figure 27:
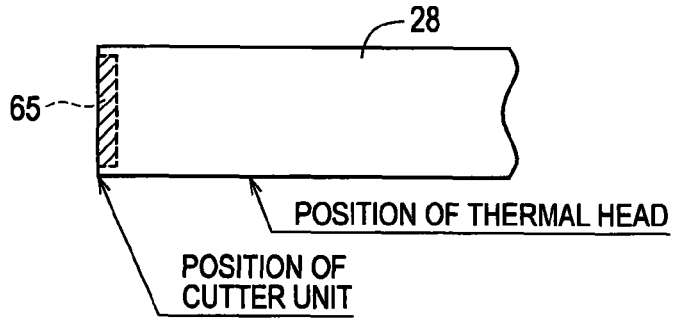
FIG. 27 is a diagram for explaining schematically an example of production of the printed label tape of the tape printing apparatus on which the tape cassette accommodating the printing object tape of type 1 is loaded, according to this embodiment, and a diagram showing a condition of the printed label tape in a waiting condition.
Figure 28:
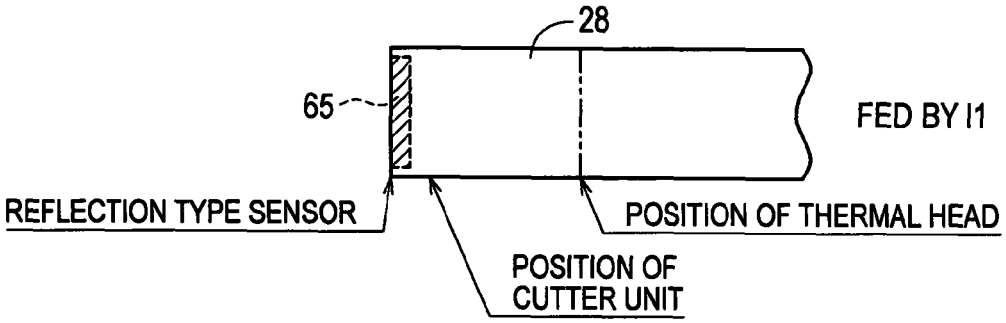
FIG. 28 is a diagram showing the condition of the printed label tape at the time of printing start, continued from FIG. 27.

For example, if a front end portion in the feeding direction of the sensor mark 65 is opposite to the cutter unit 30 when the print key 3 is pressed as shown in FIGS. 27 to 28, the tape feeding motor 92 is driven so as to rotate the tape feeding roller 63, so that feeding of the printed label tape 28 is started by the tape feeding roller 63 and the tape sub-roller 11. Then, when the feeding amount of the printed label tape 28 reaches the feeding direction distance l1 between a position of the antenna 33 and the reflection type sensor 35 and a position of the cutter unit 30, the front end portion in the feeding direction of the sensor mark 65 is detected by the reflection type sensor 35 and then, printing of the print data is started through the thermal head 9.

Subsequently, in S44, the CPU 81 reads out the feeding direction distance l2 between the cutter unit 30 and the thermal head 9 from the ROM 83, and executes a determination processing of determining whether or not a tape feeding amount after the front end portion in the feeding direction of the sensor mark 65 is detected through the reflection type sensor 35 reaches the feeding direction distance l2. When the tape feeding amount after the front end portion in the feeding direction of the sensor mark 65 is detected does not reach the feeding direction distance l2 (S44: NO), the processing subsequent to S43 is executed again.

On the other hand, when the tape feeding amount reaches the feeding direction distance l2 after the front end portion in the feeding direction of the sensor mark 65 is detected (S44: YES), in S45, the CPU 81 stops the tape feeding motor 92 and stops feeding of the printed label tape 28 and after the thermal head 9 is stopped, the cutting motor 96 is driven to cut the front end side in the feeding direction of the printed label tape 28. That is, the edge portion on the front end side of the print area 202 (see FIG. 18) is cut off.

Consequently, a margin at the front end portion in the feeding direction of the printed label tape 28 corresponding to the feeding direction distance (l1+l2) between a position of the antenna 33 and the reflection type sensor 35 and a position of the thermal head 9 can be automatically cut off, so that a user does not need to cut the margin at the front end portion in the feeding direction after the printed label tape 28 is created, thereby improving working efficiency.

Figure 29:
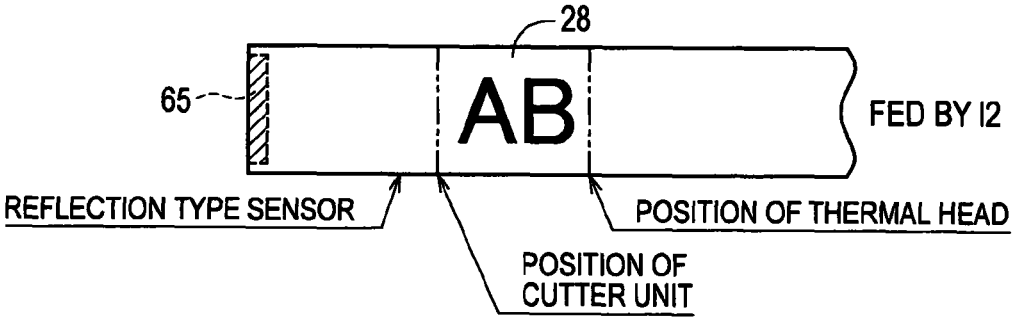
FIG. 29 is a diagram showing a condition of the printed label tape when the front end side is cut off, continued from FIG. 28.

For example, as shown in FIG. 29, when characters "AB" are printed after printing on the printing object tape 531 through the thermal head 9 is started, the feeding amount of the printed tape 531, that is, the feeding amount of the printed label tape 28 reaches the feeding direction distance l2 between the cutter unit 30 and the thermal head 9 from a position of print starting, that is, when the edge portion on the front end side of the print area 202 becomes opposite to the cutter unit 30, the tape feeding motor 92 is stopped and the thermal head 9 is also stopped. After that, the cutting motor 96 is driven so as to cut the margin at the front end portion in the feeding direction of the printed label tape 28.

In S46, after the CPU 81 cuts the front end side in the feeding direction of the printed label tape 28, it continues to drive the tape feeding motor 92 and continues printing through the thermal head 9.

Subsequently, in S47, the CPU 81 executes determination processing of determining whether or not printing of the printing area 202 (see FIG. 18) is completed. Then, when printing of the print area 202 is not completed (S47: NO), the CPU 81 executes processing subsequent to S46 again. Consequently, print data is printed in the print area 202 of the printing object tape 531.

On the other hand, when printing of the print area 202 is completed (S47: YES), the CPU 81 proceeds to processing in S48. In S48, the CPU 81 stops driving of the thermal head 9 and continues driving of the tape feeding motor 92 to feed the printed label tape 28.

In S49, the CPU 81 reads out data of the "IC chip center position l3 from the sensor mark" indicating the distance l3 between a position of the sensor mark 65 and a position of the wireless tag circuit element 32 from the RAM 85, and executes determination processing of determining whether or not the tape feeding amount after the front end portion in the feeding direction of the sensor mark 65 is detected through the reflection type sensor 35 reaches the distance l3 indicated by "the IC chip center position l3 from the sensor mark", that is, whether or not the tape feeding amount after the margin of the front end portion in the feeding direction of the printed label tape 28 is cut off reaches (l3−(l1+l2)). Then, when the tape feeding amount after the front end portion in the feeding direction of the sensor mark 65 is detected through the reflection type sensor 35 does not reach the distance l3 indicated by "the IC chip center position l3 from the sensor mark" (S49: NO), the CPU 81 executes processing subsequent to S48 again.

On the other hand, when the tape feeding amount after the front end portion in the feeding direction of the sensor mark 65 is detected through the reflection type sensor 35 reaches the distance l3 indicated by "the IC chip center position l3 from the sensor mark" (S49: YES), in S50, the CPU 81 stops the tape feeding motor 92 to stop feeding the printed label tape 28, and after that, reads a write data from the RAM 85 and stores the write data into the memory portion 125 of the wireless tag circuit element 32 through the read and write module 93.

After that, in S51, the CPU 81 cuts a rear end side in the feeding direction of the printed label tape 28 by driving the cutting motor 96 and after that, completes the sub-processing and returns to the main flowchart. Consequently, a print data is printed in the print area 202 excluding a portion in which the wireless tag circuit element 32 is disposed of the printed tape 531, and a label tape 28 in which data about product price and the like is stored in the wireless tag circuit element 32 is created.

Figure 30:
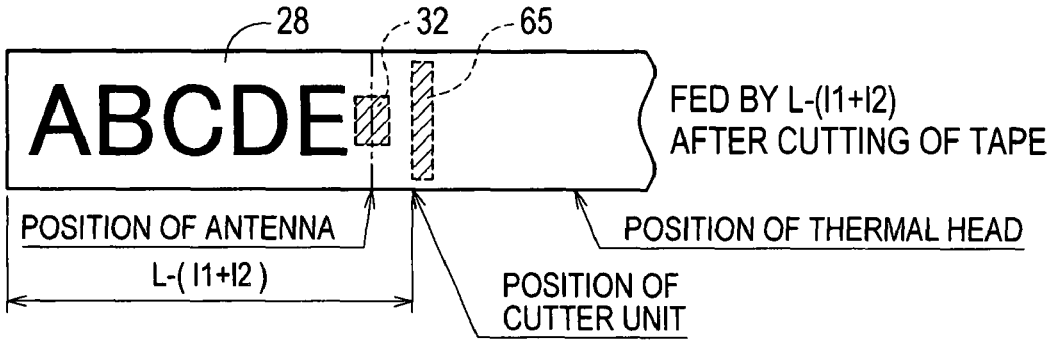
FIG. 30 is a diagram showing a condition of the printed label tape when the rear end side is cut off, continued from FIG. 29.

When as shown in FIG. 30, the tape feeding amount after the front end portion in the feeding direction of the sensor mark 65 is detected through the reflection type sensor 35 reaches the distance l3 (for example, 95 mm), the CPU 81 stops the tape feeding motor 92, reads out a write data from the RAM 85 and stores this write data into the memory portion 125 of the wireless tag circuit element 32 through the read and write module 93. In this case, the antenna 33 is opposite to the wireless tag circuit element 32 across a space. After that, the cutting motor 96 is driven so as to cut off the rear end side in the feeding direction of the printed label tape 28, that is, cut off along the front end portion in the feeding direction of the sensor mark 65 and the printed label tape 28 is discharged from the label discharge port 16.

Next, the sub-processing of the "print processing 2" will now be described with reference to FIGS. 31 to 38.

Figure 31:
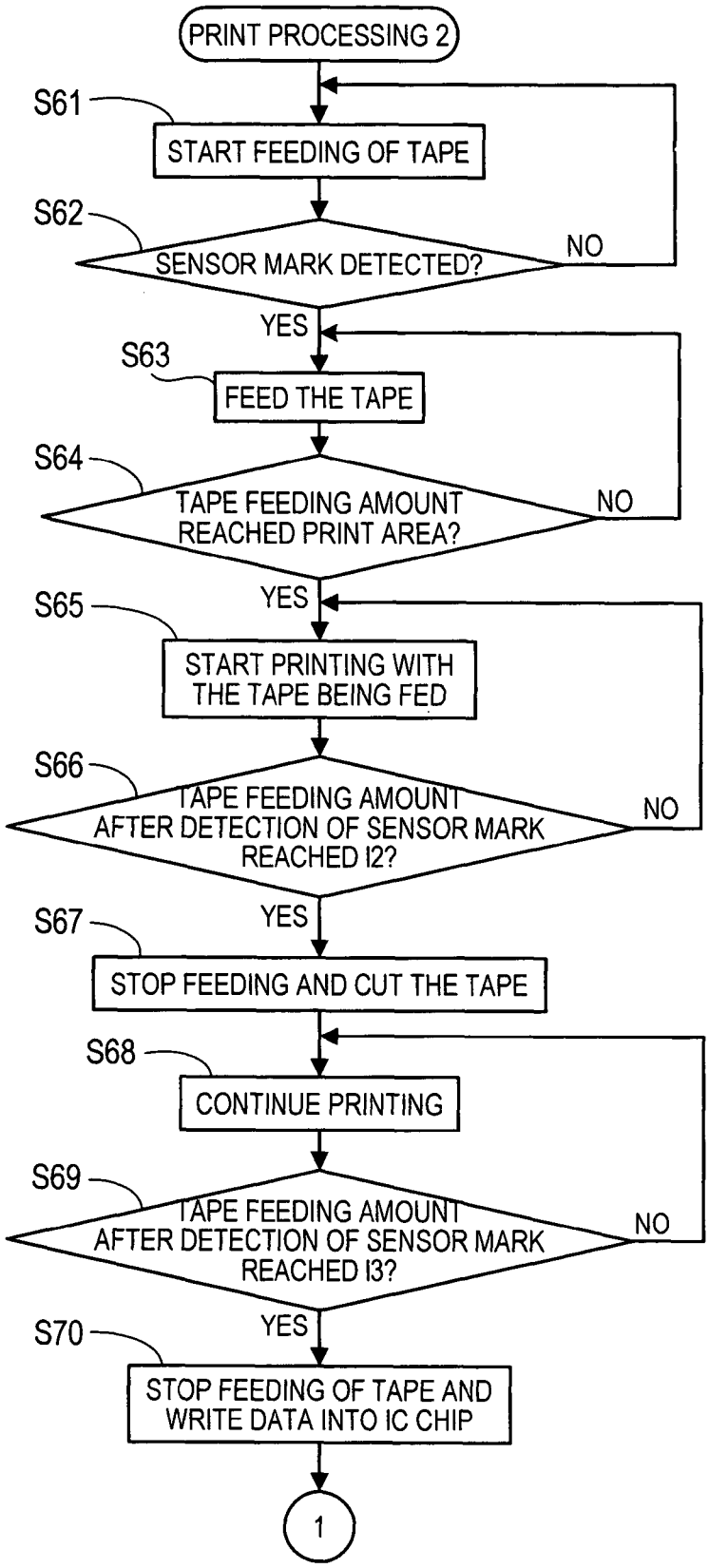
FIG. 31 is a sub-flow chart showing sub-processing of print processing 2 of the tape printing apparatus of this embodiment.
Figure 32:
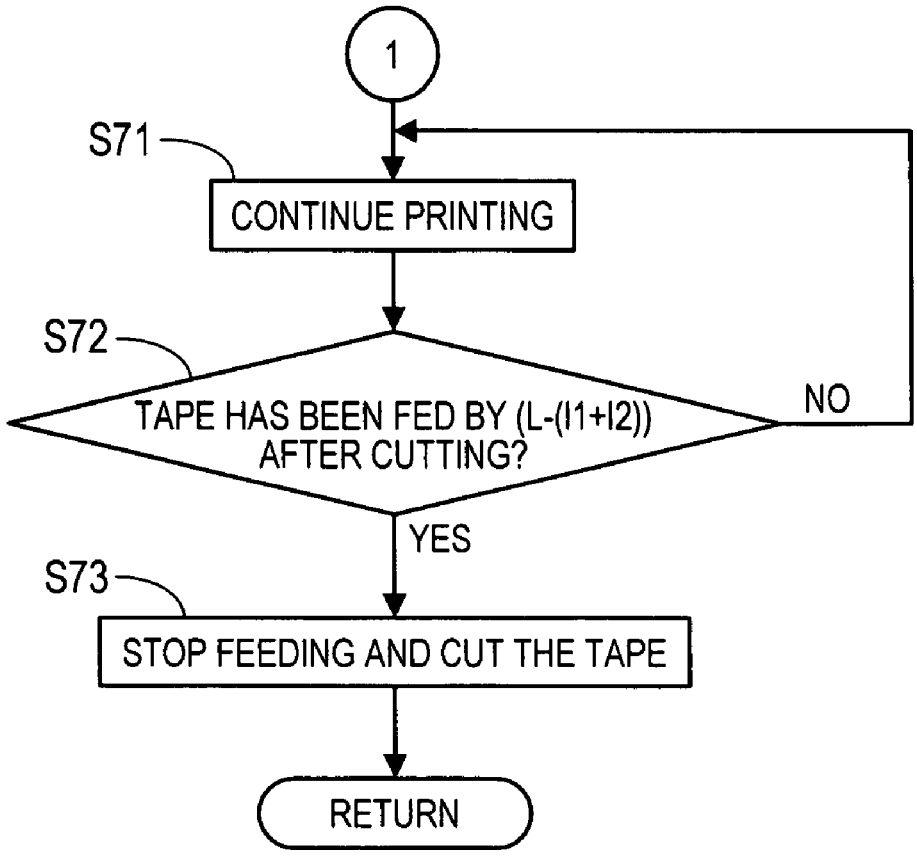
FIG. 32 is a sub-flow chart showing sub-processing of print processing 2 of the tape printing apparatus of this embodiment.
Figure 33:
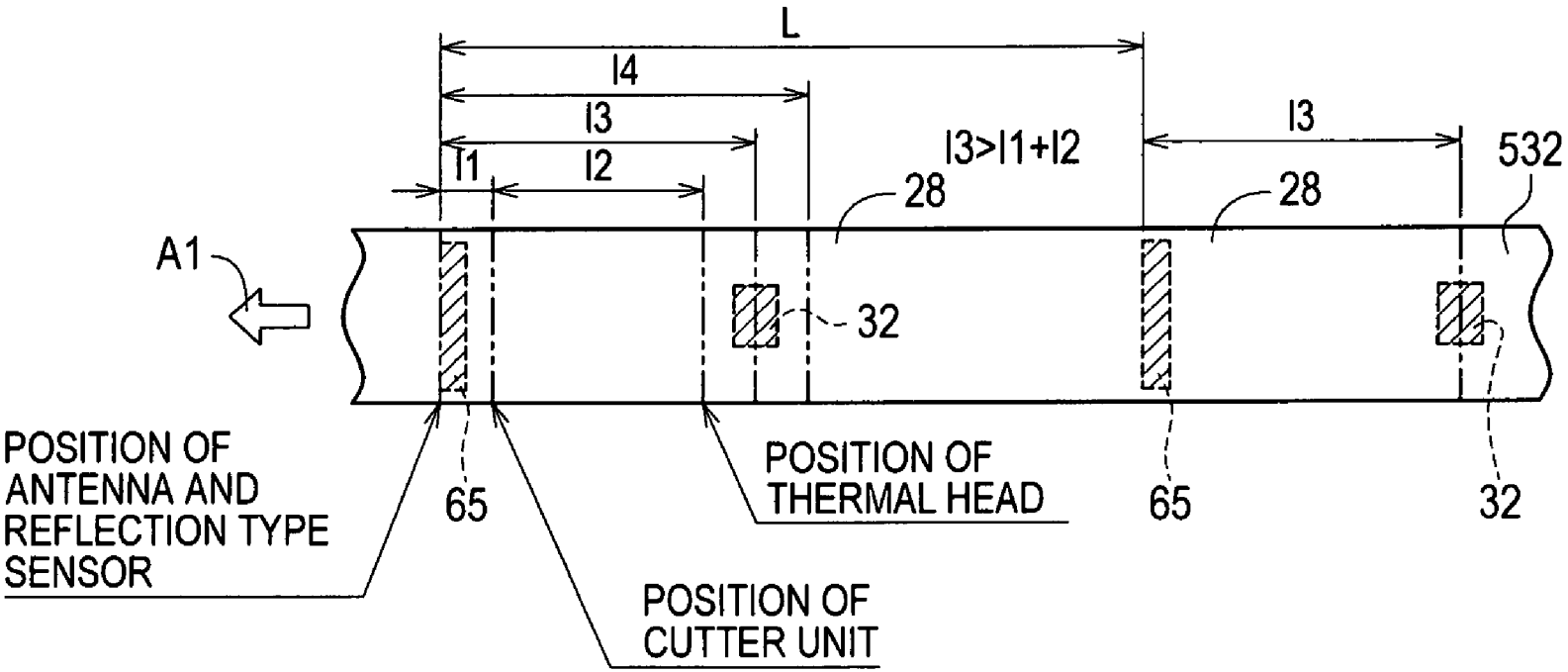
FIG. 33 is a diagram for explaining schematically an example of the printing object tape of type 2 of this embodiment, and a diagram showing schematically a positional relationship between the sensor mark and the wireless tag circuit element.

As shown in FIGS. 31 and 32, in S61, the CPU 81 drives the tape feeding motor 92 to rotate the tape feeding roller 63, so that feeding of the printed label tape 28 is started by the tape feeding roller 63 and the tape sub-roller 11.

In S62, the determination processing of determining whether or not the sensor mark 65 printed on the back face portion of the printed label tape 28 is detected through the reflection type sensor 35 is executed. Then, when the sensor mark 65 is not detected through the reflection type sensor 35 (S62: NO), the CPU 81 executes processing subsequent to S61 again.

On the other hand, when the front end portion in the feeding direction of the sensor mark 65 is detected through the reflection type sensor 35 (S62: YES), in S63, the CPU 81 continues driving of the tape feeding motor 92 to feed the printed label tape 28.

In S64, the CPU 81 executes determination processing of determining whether or not the feeding amount after the sensor mark 65 is detected reaches a distance l4 (see FIG. 33) from the sensor mark 65 to the edge portion on the front end side of the print area 205 (see FIG. 19). As described above, this distance l4 is a length data of the front end side of the "print range" to be stored in the memory portion 125 of the wireless tag circuit element 25 provided on the tape cassette 21.

Figure 34:
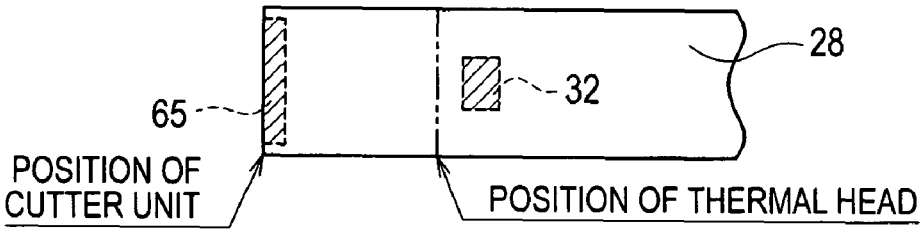
FIG. 34 is a diagram for explaining schematically an example of production of the printed label tape of the tape printing apparatus on which the tape cassette accommodating the printing object tape of type 2 is loaded, according to this embodiment, and a diagram showing a condition of the printed label tape in a waiting condition.
Figure 35:
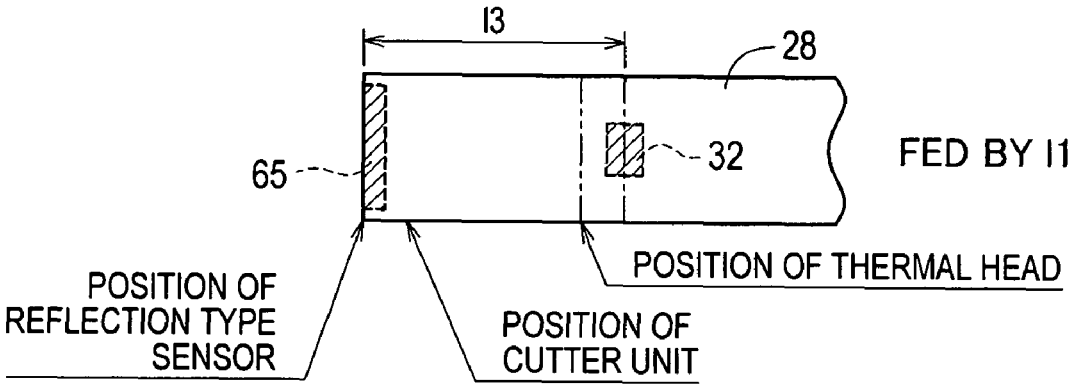
FIG. 35 is a diagram showing the condition of the printed label tape at the time of printing start, continued from FIG. 34.

If the front end portion in the feeding direction of the sensor mark 65 is opposite to the cutter unit 30 when the print key 3 is pressed as shown in FIGS. 34 and 35, the tape feeding motor 92 is driven to rotate the tape feeding roller 63, so that feeding of the printed label tape 28 is started by the tape feeding roller 63 and the tape sub-roller 11. Then, when the feeding amount of the printed label tape 28 reaches the feeding direction distance l1 between a position of the antenna 33 and the reflection type sensor 35 and a position of the cutter unit 30, the front end portion in the feeding direction of the sensor mark 65 is detected by the reflection type sensor 35.

When the feeding amount after the sensor mark 65 is detected does not reach the distance l4 from the sensor mark 65 to the edge portion on the front end side of the print area 205 (S64: NO), the CPU 81 executes processing subsequent to S63 again.

On the other hand, when the feeding amount after the sensor mark 65 is detected reaches the distance l4 from the sensor mark 65 to the edge portion on the front end side of the print area 205 (S64: YES), in S65, the CPU 81 drives the tape feeding motor 92 continuously to feed the printing object tape 532, so that printing of print data is started by the thermal head 9.

Next, in S66, the CPU 81 reads out the feeding direction distance l2 between a position of the cutter unit 30 and a position of the thermal head 9 from the ROM 83, and executes determination processing of determining whether or not the tape feeding amount after the front end portion in the feeding direction of the sensor mark 65 is detected through the reflection type sensor 35 reaches the feeding direction distance l2. When the tape feeding amount after the front end portion in the feeding direction of the sensor mark 65 is detected does not reach the feeding direction distance l2 (S66: NO), it executes processing subsequent to S65 again.

On the other hand, when the tape feeding amount after the front end portion in the feeding direction of the sensor mark 65 is detected reaches the feeding direction distance l2 (S66: YES), in S67, the CPU 81 stops the tape feeding motor 92 to stop feeding of the printed label tape 28 and stops the thermal head 9. After that, the cutting motor 96 is driven to cut off the printed label tape 28 at the front end side in the feeding direction.

Consequently, the margin of the front end portion in the feeding direction of the printed label tape 28 corresponding to the feeding direction distance (l1+l2) between a position of the antenna 33 and the reflection type sensor 35 and a position of the thermal head 9 can be automatically cut off, so that user does not need to cut off the margin of the front end portion in the feeding direction after the printed label tape 28 is created, thereby improving working efficiency.

Figure 36:
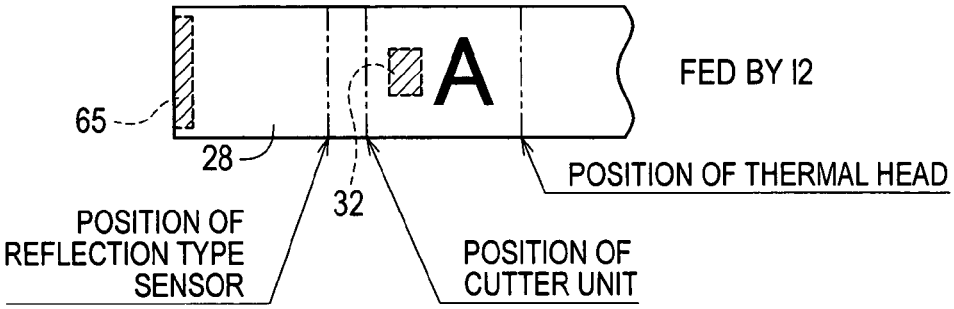
FIG. 36 is a diagram showing a condition of the printed label tape when the front end side is cut off, continued from FIG. 35.

For example, as shown in FIG. 36, when printing onto the printing object tape 532 through the thermal head 9 is started to print a character "A", and the feeding amount of the printing object tape 532, that is, the feeding amount of the printed label tape 28 reaches the feeding direction distance l2 between the cutter unit 30 and the thermal head 9 from a detection position of the sensor mark 65, the tape feeding motor 92 is stopped and the thermal head 9 is also stopped. After that, the cutting motor 96 is driven to cut off the margin of the front end portion in the feeding direction of the printed label tape 28. Further, the wireless tag circuit element 32 can be left in the printed label tape 28.

In S68, after the CPU 81 cuts off the printed label tape 28 at the front end side in the feeding direction, it continues driving of the tape feeding motor 92 again, and continues printing of print data through the thermal head 9.

In S69, the CPU 81 reads out data of "the IC chip center position l3 from the sensor mark" indicating the distance l3 from the sensor mark 65 to the wireless tag circuit element 32 from the RAM 85, and executes determination processing of determining whether or not the tape feeding amount after the front end portion in the feeding direction of the sensor mark 65 is detected through the reflection type sensor 35 reaches the distance l3 indicated by "the IC chip center position l3 from the sensor mark". Then, when the tape feeding amount after the front end portion in the feeding direction of the sensor mark 65 is detected does not reach the distance l3 (S69: NO), it executes processing subsequent to S68 again.

On the other hand, when the tape feeding amount after the front end portion in the feeding direction of the sensor mark 65 is detected reaches the distance l3 (S69: YES), in S70, the CPU 81 stops the tape feeding motor 92 to stop feeding of the printed label tape 28, and at the same time stops the driving of the thermal head 9. After that, a write data is read out from the RAM 85 and this write data is stored into the memory portion 125 of the wireless tag circuit element 32 through the read and write module 93.

Figure 37:
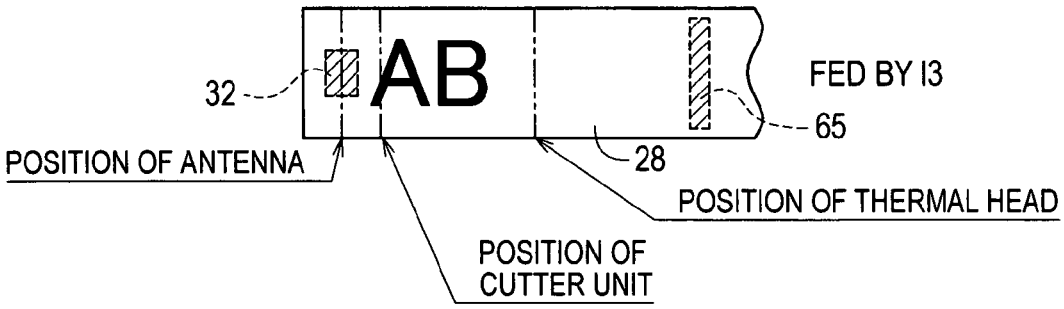
FIG. 37 is a diagram showing a condition of the printed label tape at the time of writing information into the wireless tag circuit element, continued from FIG. 36.

For example, as shown in FIG. 37, when the tape feeding amount after the front end portion in the feeding direction of the sensor mark 65 is detected through the reflection type sensor 35 reaches the distance l3 (for example, 30 mm), the CPU 81 stops the tape feeding motor 92 and stops the driving of the thermal head 9. Then, the CPU 81 reads out a write data from the RAM 85 and stores this write data into the memory portion 125 of the wireless tag circuit element 32 through the read and write module 93. In this case, the antenna 33 and the wireless tag circuit element 32 are opposite to each other across a space.

Subsequently, in S71, the CPU 81 starts driving of the tape feeding motor 92 again, and continues printing of a print data through the thermal head 9.

In S72, the CPU 81 reads out the feeding direction distance l1 between a position of the antenna 33 and a reflection type sensor 35 and a position of the cutter unit 30 from the ROM 83, and reads out the feeding direction distance l2 between a position of the cutter unit 30 and a position of the thermal head 9 from the ROM 83, and reads out a data value L of the "IC chip pitch length L" from the RAM 85. Then, the CPU 81 executes determination processing of determining whether or not the tape feeding amount reaches (L−(l1+l2)) after the margin of the front end portion in the feeding direction of the printed label tape 28 is cut off. Then, when the tape feeding amount does not reach the (L−(l1+l2)) after the margin of the front end portion in the feeding direction of the printed label tape 28 is cut off (S72: NO), the CPU 81 executes processing subsequent to S71 again.

On the other hand, when the tape feeding amount reaches (L−(l1+l2)) after the margin of the front end portion in the feeding direction of the printed label tape 28 is cut off (S72: YES), in S73, the CPU 81 stops the tape feeding motor 92 to stop feeding of the printed label tape 28, and at the same time stops driving of the thermal head 9. After that, the rear end side in the feeding direction of the printed label tape 28, that is, the rear end side of the print area 205 is cut by driving the cutting motor 96, the sub-processing is completed and it returns to the main flowchart. Consequently, a printed label tape 28 is created by printing a print data in the print area 205 excluding a portion in which the wireless tag circuit element 32 is to be disposed on of the printing object tape 532 and storing data about product price and the like in the wireless tag circuit element 32.

Figure 38:
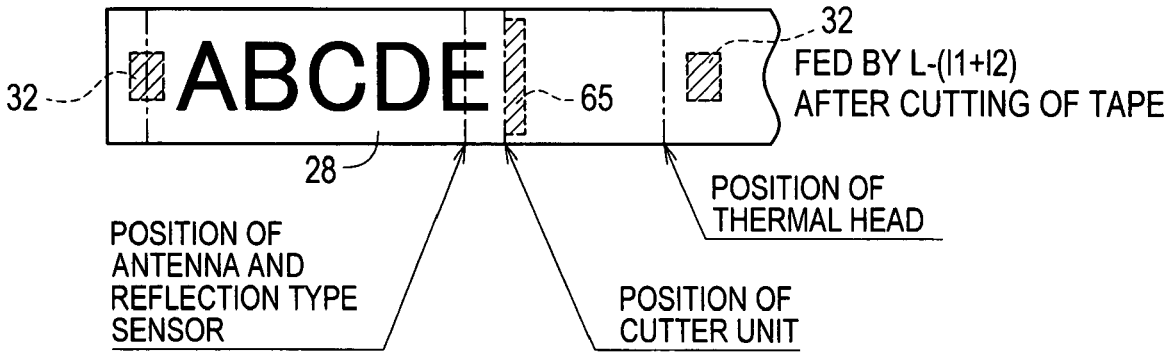
FIG. 38 is a diagram showing a condition of the printed label tape when the rear end side is cut off, continued from FIG. 37.

For example, as shown in FIG. 38, when the tape feeding amount reaches (L−(l1+l2)) after the margin of the front end portion in the feeding direction of the printed label tape 28 is cut off as shown in FIG. 38, the CPU 81 stops the tape feeding motor 92 and then stops the driving of the thermal head 9. After that, the cutting motor 96 is driven so as to cut off the printed label tape 28 at the rear end side in the feeding direction, that is, along the front edge in the feeding direction of the sensor mark 65, and the printed label tape 28 is discharged from the label discharge port 16.

Next, the sub-processing of the "print processing 3" will now be described with reference to FIGS. 39 to 63.

Figure 39:
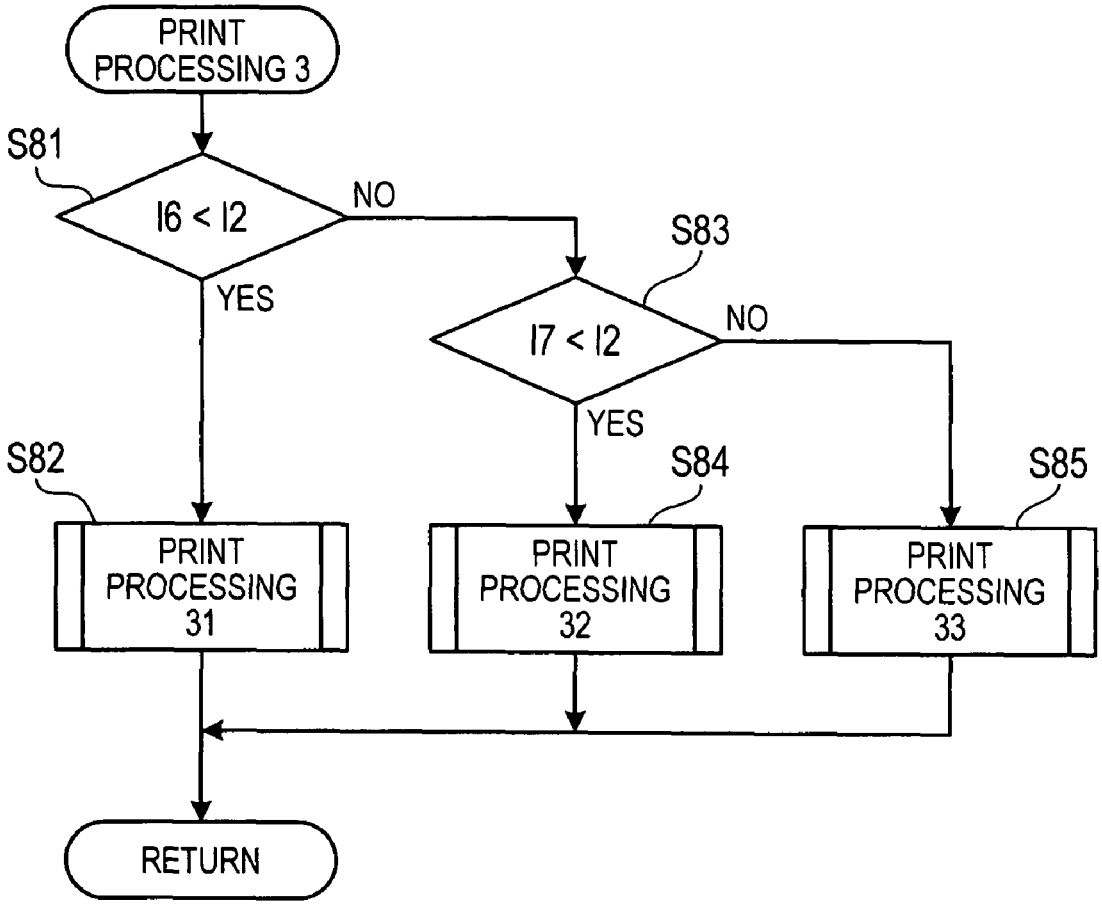
FIG. 39 is a sub-flow chart showing sub-processing of print processing 3 of the tape printing apparatus of this embodiment.

As shown in FIG. 39, in S81, the CPU 81 executes determination processing of determining whether or not the length l6 in the tape feeding direction of the first print area 208 is smaller than the feeding direction distance l2 between a position of the cutter unit 30 and a position of the thermal head 9. More specifically, the CPU 81 reads out the data of the "print range" from the RAM 85 and adopts the length of a first (left) print range (see FIGS. 9 and 15) as a tape feeding direction length l6 of the first print area 208. Then, the CPU 81 reads out the feeding direction distance l2 between a position of the cutter unit 30 and a position of the thermal head 9 from the ROM 83 and determines whether or not the tape feeding direction length l6 of the first print area 208 is smaller than the feeding direction distance l2.

If it is determined that the tape feeding direction length l6 of the first print area 208 is smaller than the feeding direction distance 12 (S81: YES), in S82, the CPU 81 executes the sub-processing of the "print processing 31", terminates the sub-processing and then returns to the sub-processing of the "print processing".

On the other hand, when it is determined that the tape feeding direction length l6 of the first print area 208 is equal to or more than the feeding direction distance l2 (S81: NO), the CPU 81 moves to processing of S83. In S83, the CPU 81 executes determination processing of determining whether or not a tape feeding direction length l7 of the second print area 209 is smaller than the feeding direction distance l2. More specifically, the CPU 81 reads out the data of the "print range" from the RAM 85 and adopts the length of a second (right) print range (see FIGS. 9 and 15) as the tape feeding direction length l7 of the second print area 209. Then, the CPU 81 reads out the feeding direction distance l2 between a position of the cutter unit 30 and a position of the thermal head 9 from the ROM 83 and determines whether or not the tape feeding direction length l7 of the second print area 209 is smaller than the feeding direction distance l2.

When it is determined that the tape feeding direction length l7 of the second print area 209 is smaller than the feeding direction distance l2 (S83: YES), in S84, the CPU 81 executes the sub-processing of the "print processing 32" and completes the sub-processing and then, returns to the sub-processing of "print processing".

On the other hand, when it is determined that the tape feeding direction length l7 of the second print area 209 is equal to or more than the feeding direction distance l2 (S83: NO), in S85, the CPU 81 executes the sub-processing of the "print processing 33", completes the sub-processing and returns to the sub-processing of the "print processing".

Next, the sub-processing of the "print processing 31" will now be described with reference to FIGS. 40 to 47.

Figure 40:
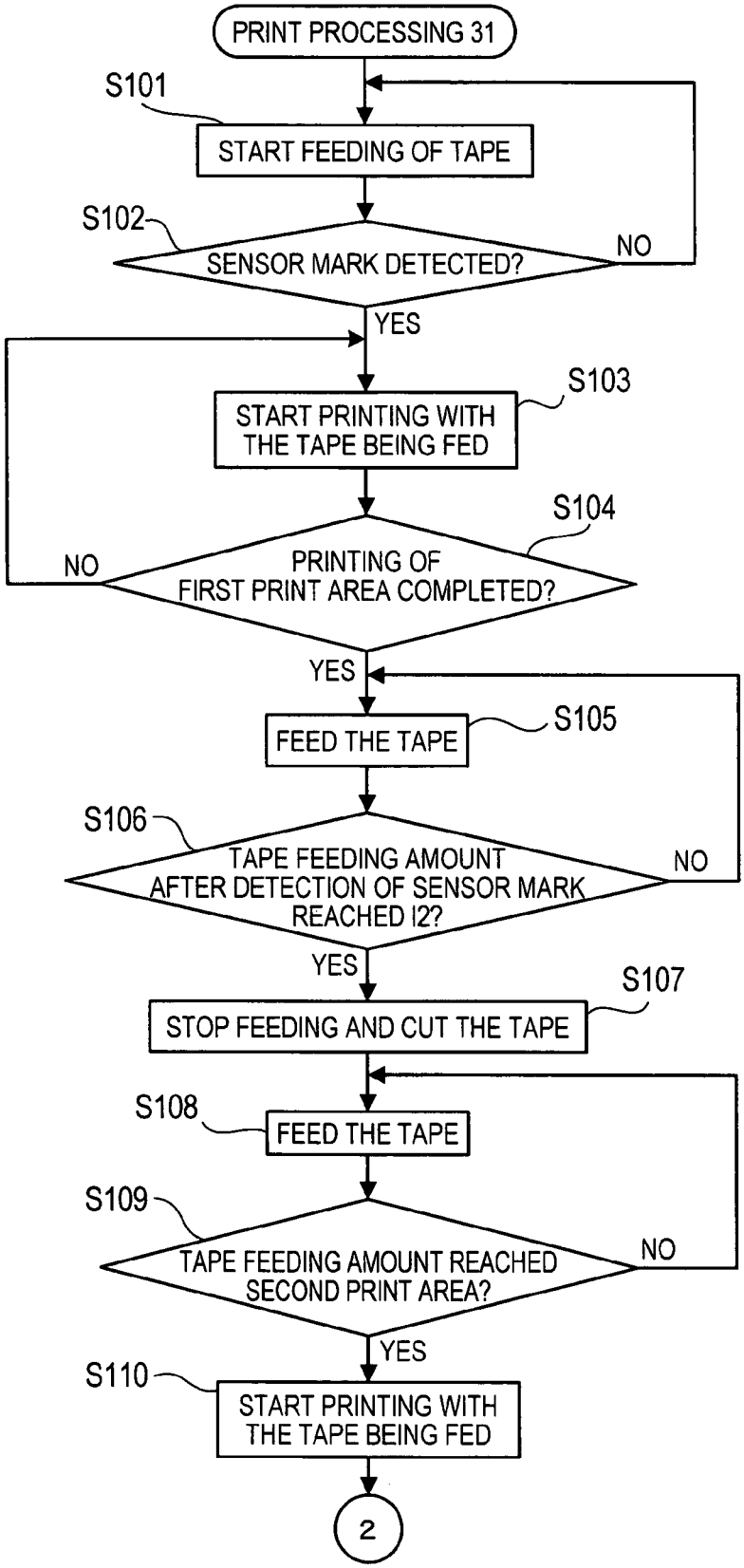
FIG. 40 is a sub-flow chart showing sub-processing of print processing 31 of the tape printing apparatus of this embodiment.
Figure 41:
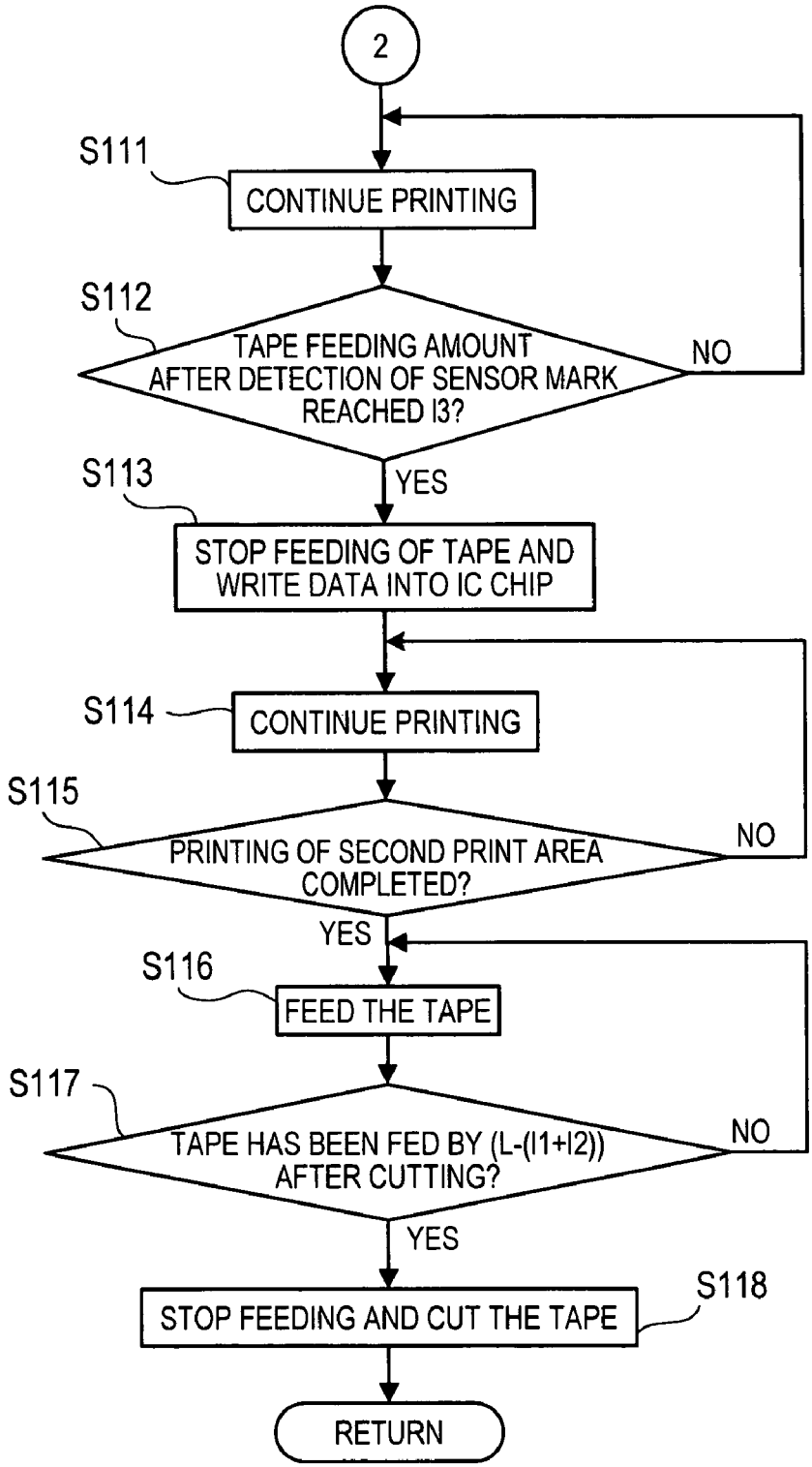
FIG. 41 is a sub-flow chart showing sub-processing of print processing 31 of the tape printing apparatus of this embodiment.
Figure 42:
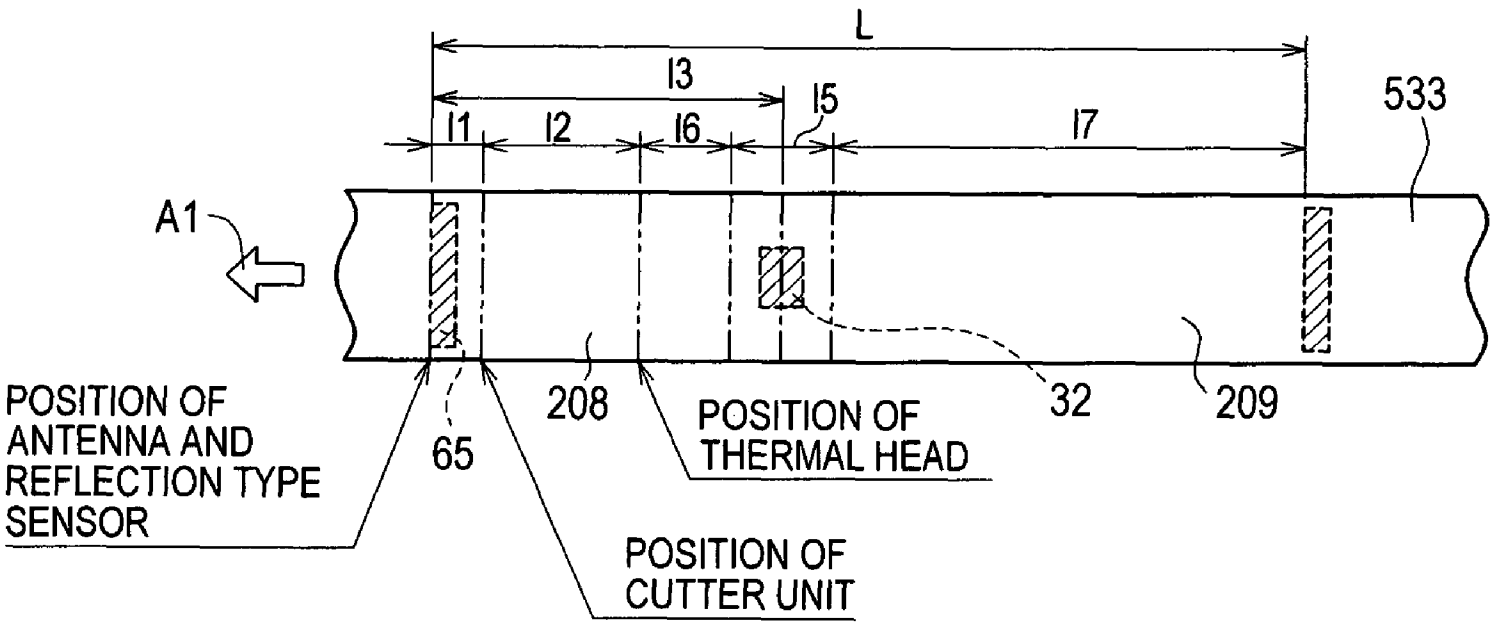
FIG. 42 is a diagram for explaining schematically an example of a printing object tape in which the tape feeding direction length l6 of the first print area is smaller than the feeding direction distance l2 between the cutter unit and the thermal head in the printing object tape of type 3 of this embodiment, and also showing schematically the positional relationship between the sensor mark and the wireless tag circuit element.

As shown in FIGS. 40 and 41, in S101, the CPU 81 drives the tape feeding motor 92 to rotate the tape feeding roller 63 so that feeding of the printed label tape 28 is started by the tape feeding roller 63 and the tape sub-roller 11.

In S102, the CPU 81 executes determination processing of determining whether or not the sensor mark 65 printed on the back face portion of the printed label tape 28 is detected through the reflection type sensor 35. When the sensor mark 65 is not detected through the reflection type sensor 35 (S102: NO), the CPU 81 executes processing subsequent to S101 again.

On the other hand, if the front end portion in the feeding direction of the sensor mark 65 is detected through the reflection type sensor 35 (S102: YES), in S103, the CPU 81 continues driving of the tape feeding motor 92 to feed the printed object tape 533 and starts printing of the print data in the first print area 208 (see FIG. 20) through the thermal head 9.

Figure 43:
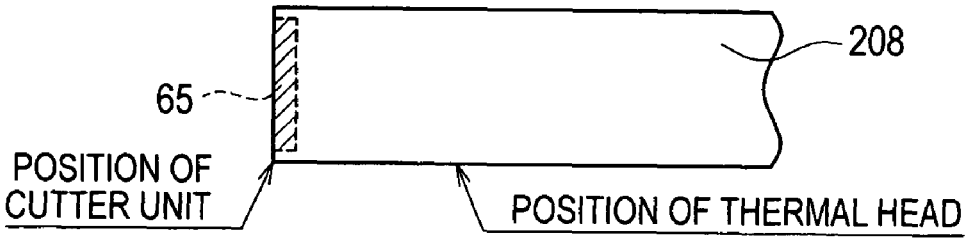
FIG. 43 is a diagram for explaining schematically an example of production of the printed label tape of the tape printing apparatus provided with a tape cassette accommodating a printing object tape in which the tape feeding direction length l6 of the first print area is smaller than the feeding direction distance l2 between the cutter unit and the thermal head in the printing object tape of type 3 of this embodiment, and also showing a condition of the printed label tape in a waiting condition.
Figure 44:
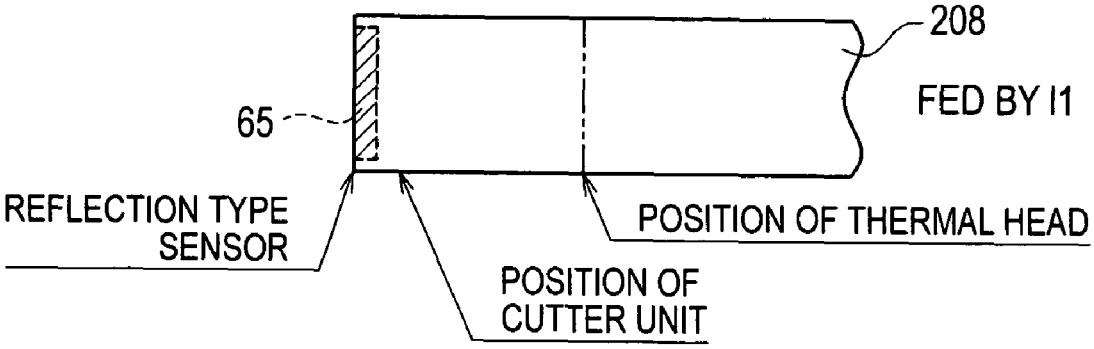
FIG. 44 is a diagram showing the condition of the printed label tape at the time of printing start, continued from FIG. 43.

For example, as shown in FIGS. 43 and 44, if the front end portion in the feeding direction of the sensor mark 65 is opposite to the cutter unit 30 when the print key 3 is pressed, the tape feeding motor 92 is driven to rotate the tape feeding roller 63 so that feeding of the printed label tape 28 is started by the tape feeding roller 63 and the tape sub-roller 11. Then, when the feeding amount of the printed label tape 28 reaches the feeding direction distance l1 between a position of the antenna 33 and the reflection type sensor 35 and a position of the cutter unit 30, the front end portion in the feeding direction of the sensor mark 65 is detected by the reflection type sensor 35 and then, printing of a print data in the first print area 208 (see FIG. 20) through the thermal head 9 is started.

In S104, the CPU 81 executes determination processing of determining whether or not printing in the first print area 208 (see FIG. 20) is completed. Then, unless printing of the first print area 208 is completed (S104: NO), the CPU 81 executes processing subsequent to S103 again. Consequently, the print data is printed in the first print area 208 of the printing object tape 533.

On the other hand, when the printing of the first print area 208 is completed (S104: YES), the CPU 81 moves to processing of S105. In S105, the CPU 81 stops driving of the thermal head 9 and continues driving of the tape feeding motor 92 to feed the printed label tape 28.

Subsequently, in S106, the CPU 81 reads out the feeding direction distance l2 between a position of the cutter unit 30 and a position of the thermal head 9 from the ROM 83 and executes determination processing of determining whether or not the tape feeding amount after the front end portion in the feeding direction of the sensor mark 65 is detected through the reflection type sensor 35 reaches the feeding direction distance l2. When the tape feeding amount after the front end portion in the feeding direction of the sensor mark 65 is detected does not reach the feeding direction distance l2 (S106: NO), it executes processing subsequent to S105 again.

On the other hand, when the tape feeding amount after the front end portion in the feeding direction of the sensor mark 65 reaches the feeding direction distance l2 (S106: YES), in S107, the CPU 81 stops the tape feeding motor 92 to stop feeding of the printed label tape 28 and stops the thermal head 9. After that, the cutting motor 96 is driven to cut off the printed label tape 28 at the front end side in the feeding direction. That is, the edge portion on the front end side of the first print area 208 (see FIG. 20) is cut off.

Consequently, the margin at the front end portion in the feeding direction of the printed label tape 28 corresponding to the feeding direction distance (l1+l2) between a position of the antenna 33 and the reflection type sensor 35 and a position of the thermal head 9 can be automatically cut, so that a user does not need to cut off the margin at the front end portion in the feeding direction thereby improving working efficiency.

Figure 45:
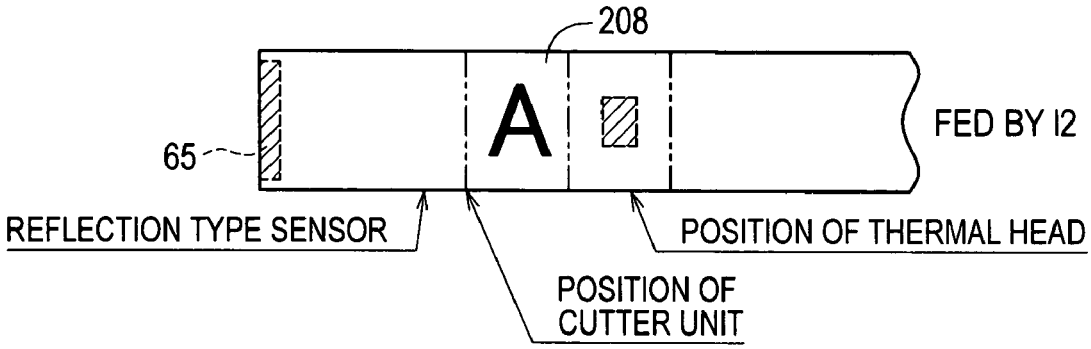
FIG. 45 is a diagram showing a condition of the printed label tape when the front end side is cut off, continued from FIG. 44.

For example, as shown in FIG. 45, when a letter of print data "A" in the first print area 208 is printed after printing on the printing object tape 533 through the thermal head 9 is started, and the feeding amount of the printing object tape 533, that is, the feeding amount of the printed label tape 28 reaches the feeding direction distance l2 between a position of the cutter unit 30 and a position of the thermal head 9 from a print starting position, that is, when the edge portion of the front end side of the first print area 208 is opposite to the cutter unit 30, the tape feeding motor 92 is stopped and the thermal head 9 is stopped. After that, the cutting motor 96 is driven to cut the margin of the front end portion in the feeding direction of the printed label tape 28.

In S108, the CPU 81 stops the thermal head 9 and continues driving of the tape feeding motor 92 to feed the printed label tape 28.

In S109, the CPU 81 executes determination processing of determining whether or not the thermal head 9 reaches the edge portion on the front end side in the feeding direction of the second print area 209 (see FIG. 20). In this determination, the CPU 81 reads out the data of the "print range" from the RAM 85 to obtain a length data of the front end side from data of the print range of the second print area 209, and determines whether or not the feeding amount of the printed label tape 28 after the sensor mark 65 is detected reaches this length data. Then, when the thermal head 9 does not reach the edge portion on the front end side in the feeding direction of the second print area 209 (S109: NO), the CPU 81 executes processing subsequent to S108 again.

On the other hand, when the thermal head 9 reaches the edge portion on the front end side in the feeding direction of the second print area 209 (S109: YES), in S110, the CPU 81 continues driving of the tape feeding motor 92 to feed the printed tape 533 and starts printing of a print data in the second print area 209 through the thermal head 9.

In S111, the CPU 81 drives the tape feeding motor 92 to continue printing of a print data in the second print area 209 through the thermal head 9.

In S112, the CPU 81 reads out data of the "from the sensor mark to the IC chip center position l3" indicating the distance l3 between a position of the sensor mark 65 and a position of the wireless tag circuit element 32 from the RAM 85 and executes determination processing of determining whether or not the tape feeding amount after the front end portion in the feeding direction of the sensor mark 65 is detected through the reflection type sensor 35 reaches the distance l3 indicated by the data of "from the sensor mark to the IC chip center position l3". Then, when the tape feeding amount after the front end portion in the feeding direction of the sensor mark 65 is detected does not reach the distance l3 (S112: NO), it executes processing subsequent to S111 again.

On the other hand, when the tape feeding amount after the front portion in the feeding direction of the sensor mark 65 is detected reaches the distance l3 (S112: YES), in S113, the CPU 81 stops the tape feeding motor 92 to stop feeding of the printed label tape 28 and stops driving of the thermal head 9. After that, it reads out a write data from the RAM 85 and stores this write data into the memory portion 125 of the wireless tag circuit element 32 through the read and write module 93.

Figure 46:
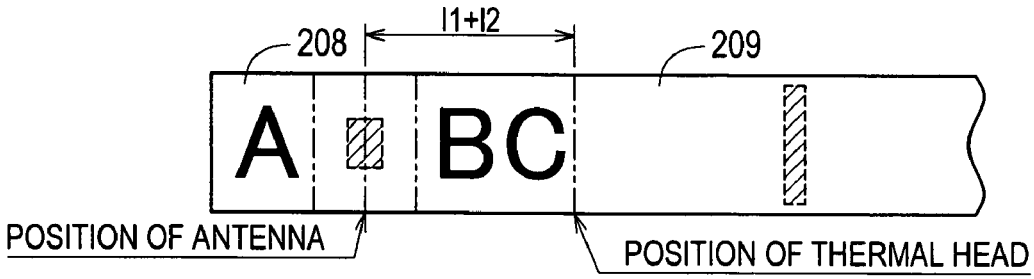
FIG. 46 is a diagram showing a condition of the printed label tape at the time of writing information into the wireless tag circuit element, continued from FIG. 45.

For example, as shown in FIG. 46, when the tape feeding amount after the front end portion in the feeding direction of the sensor mark 65 is detected through the reflection type sensor 35 reaches the distance l3 (for example, 40.5 mm), the CPU 81 stops the tape feeding motor 92 to stop feeding of the printed label tape 28 and stops driving of the thermal head 9. It reads out a write data from the RAM 85 and stores this write data into the memory portion 125 of the wireless tag circuit element 32 through the read and write module 93. In this case, the antenna 33 and the wireless tag circuit element 32 are opposite to each other across a space. The print data "A" in the first print area 208 of the printing object tape 533 and the print data "BC" of the print data "BCDEF" in the second print area 209 are printed.

Subsequently, in S114, the CPU 81 starts the driving of the tape feeding motor 92 again and continues printing of print data in the second print area 209 through the thermal head 9.

In S115, the CPU 81 executes determination processing of determining whether or not printing of the second print area 209 is completed. Then, when printing of the second print area 209 is not completed (S115: NO), the CPU 81 executes processing subsequent to S114 again. Consequently, the print data continues to be printed in the second print area 209 of the printing object tape 533.

On the other hand, when printing in the second print area 209 is completed (S115: YES), the CPU 81 moves to processing of S116. In S116, the CPU 81 stops driving of the thermal head 9 and continues driving of the tape feeding motor 92 to feed the printed label tape 28.

In S117, the CPU 81 reads out the feeding direction distance l1 between a position of the antenna 33 and the reflection type sensor 35 and a position of the cutter unit 30 from the ROM 83, and reads out the feeding direction distance l2 between a position of the cutter unit 30 and a position of the thermal head 9 from the ROM 83, and reads out a data value L of the "IC chip pitch length L" from the RAM 85. The CPU 81 executes determination processing of determining whether or not the tape feeding amount after the margin at the front end portion in the feeding direction of the printed label tape 28 is cut off reaches (L−(l1+l2)). Then, when the tape feeding amount after the margin at the front end portion in the feeding direction of the printed label tape 28 is cut off does not reach (L−(l1+l2)) (S117: NO), the CPU 81 executes processing subsequent to S116 again.

On the other hand, when the tape feeding amount after the margin at the front end in the feeding direction of the printed label tape 28 is cut off reaches (L−(l1+l2)) (S117: YES), in S118, the CPU 81 stops the tape feeding motor 92 to stop feeding of the printed label tape 28 and stops driving of the thermal head 9. After that, it cuts the printed label tape 28 at the rear end side in the feeding direction, that is, the rear end side of the print area 207 (see FIG. 20) by driving the cutting motor 96 and after that, completes the sub-processing and returns to the sub-processing of the print processing 3. Consequently, a printed label tape 28 is created by printing a print data in the first print area 208 and the second print area 209 excluding a portion in which the wireless tag circuit element 32 is to be disposed of the printing object tape 533 of 16<12 and storing data about product price and the like in the wireless tag circuit element 32.

Figure 47:
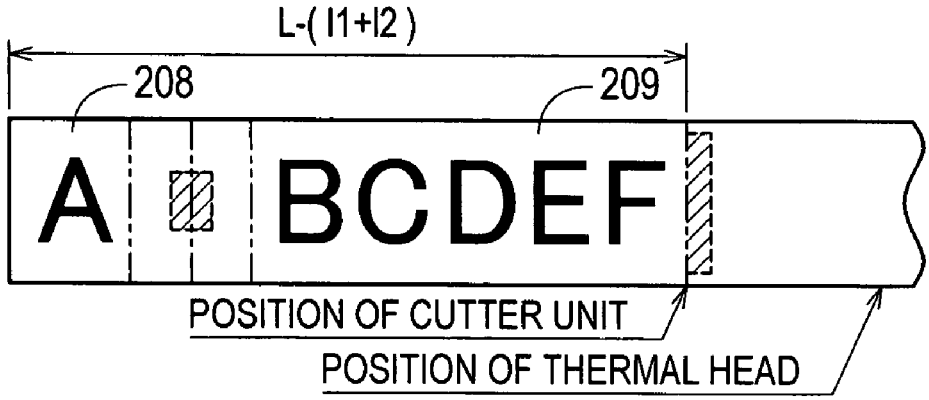
FIG. 47 is a diagram showing a condition of the printed label tape when the rear end side is cut off, continued from FIG. 46.

For example, as shown in FIG. 47, when the tape feeding amount after the margin at the front end portion in the feeding direction of the printed label tape 28 is cut off reaches (L−(l1+l2)), the CPU 81 stops the tape feeding motor 92. After that, the cutting motor 96 is driven to cut the rear end side in the feeding direction of the printed label tape 28, that is, along the front end portion in the feeding direction of the sensor mark 65, so that the printed label tape 28 is discharged from the label discharge port 16.

Next, the sub-processing of the "print processing 32" will now be described with reference to FIGS. 48 and 55.

Figure 48:
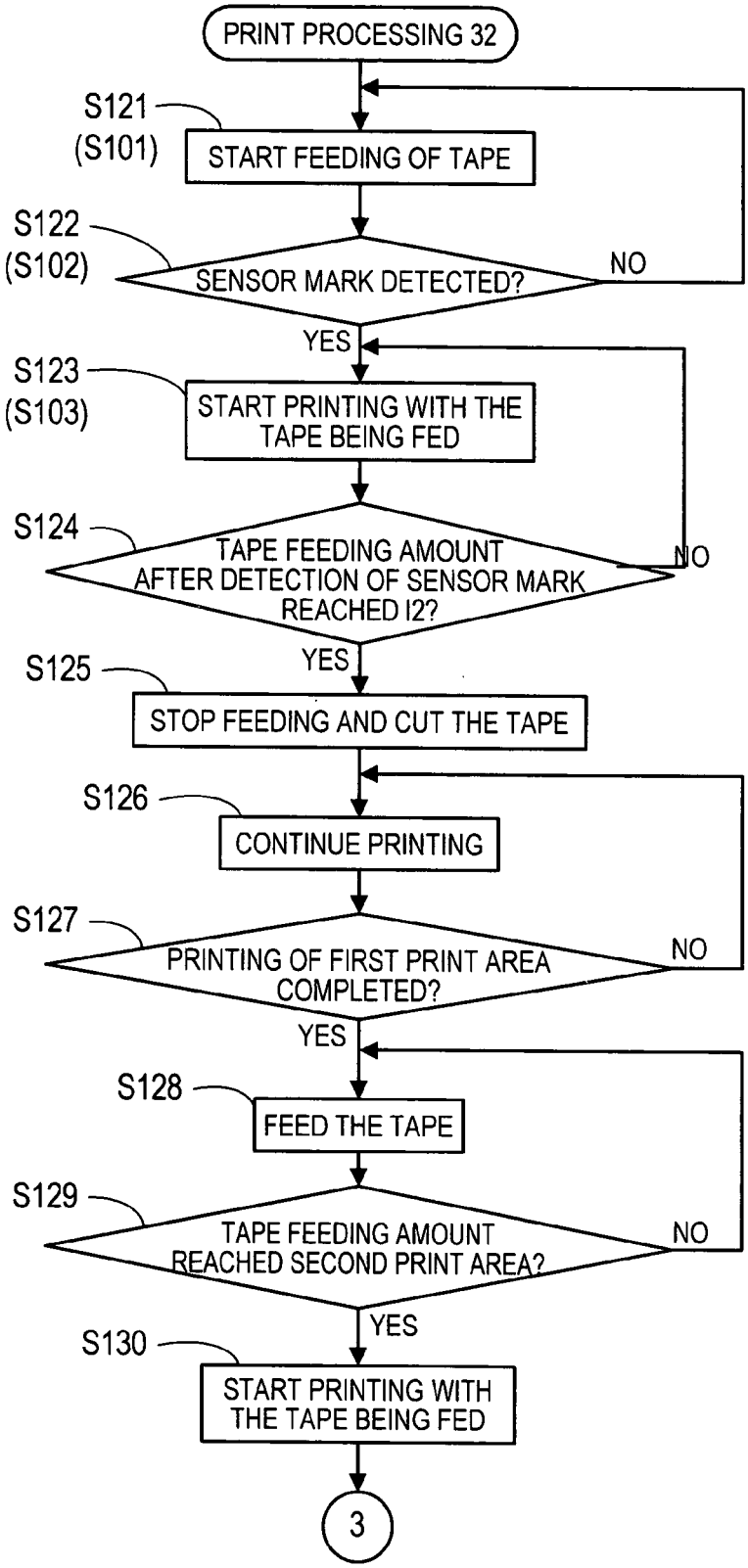
FIG. 48 is a sub-flow chart showing sub-processing of print processing 32 of the tape printing apparatus of this embodiment.
Figure 49:
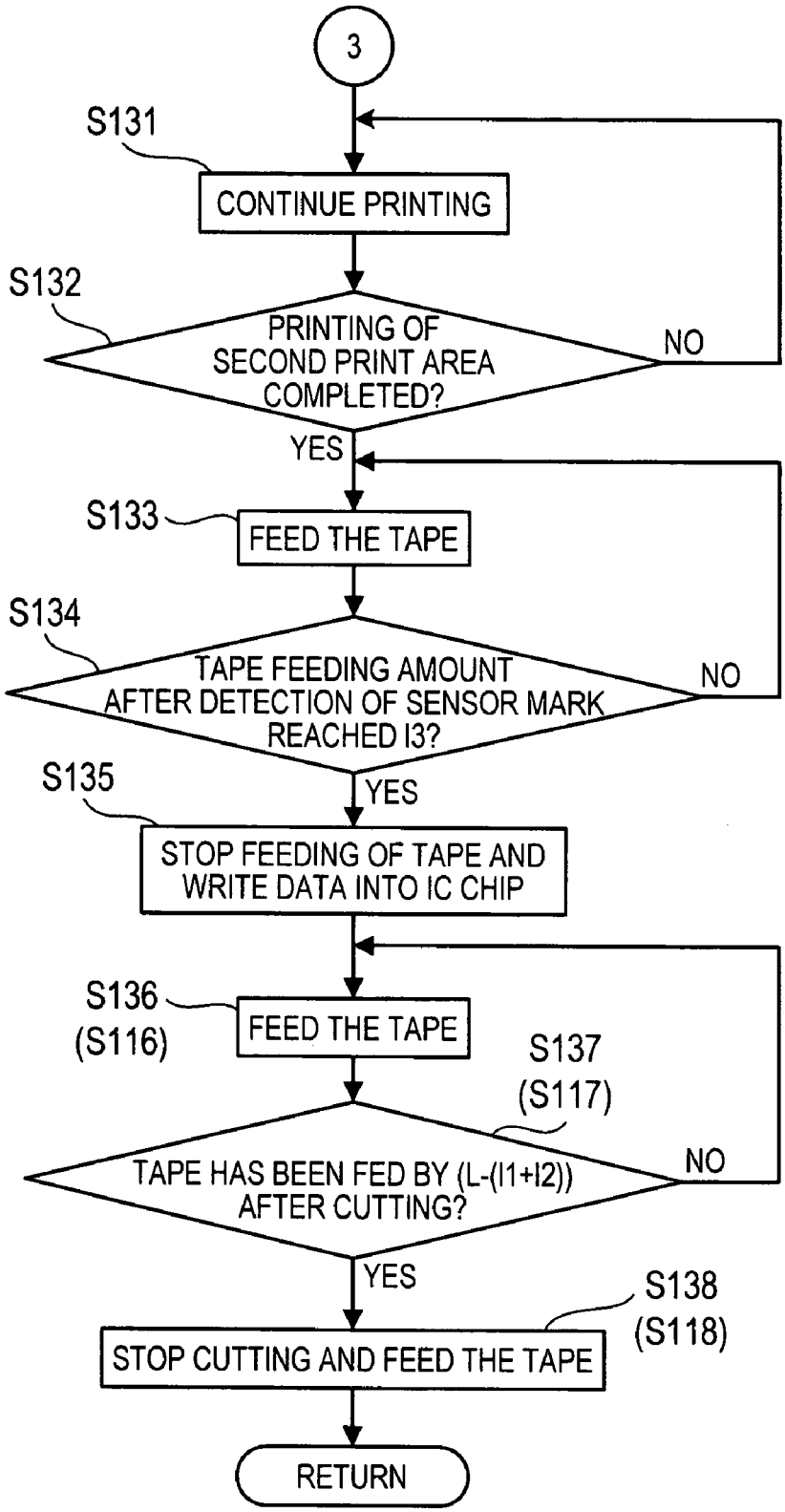
FIG. 49 is a sub-flow chart showing sub-processing of print processing 32 of the tape printing apparatus of this embodiment.
Figure 50:
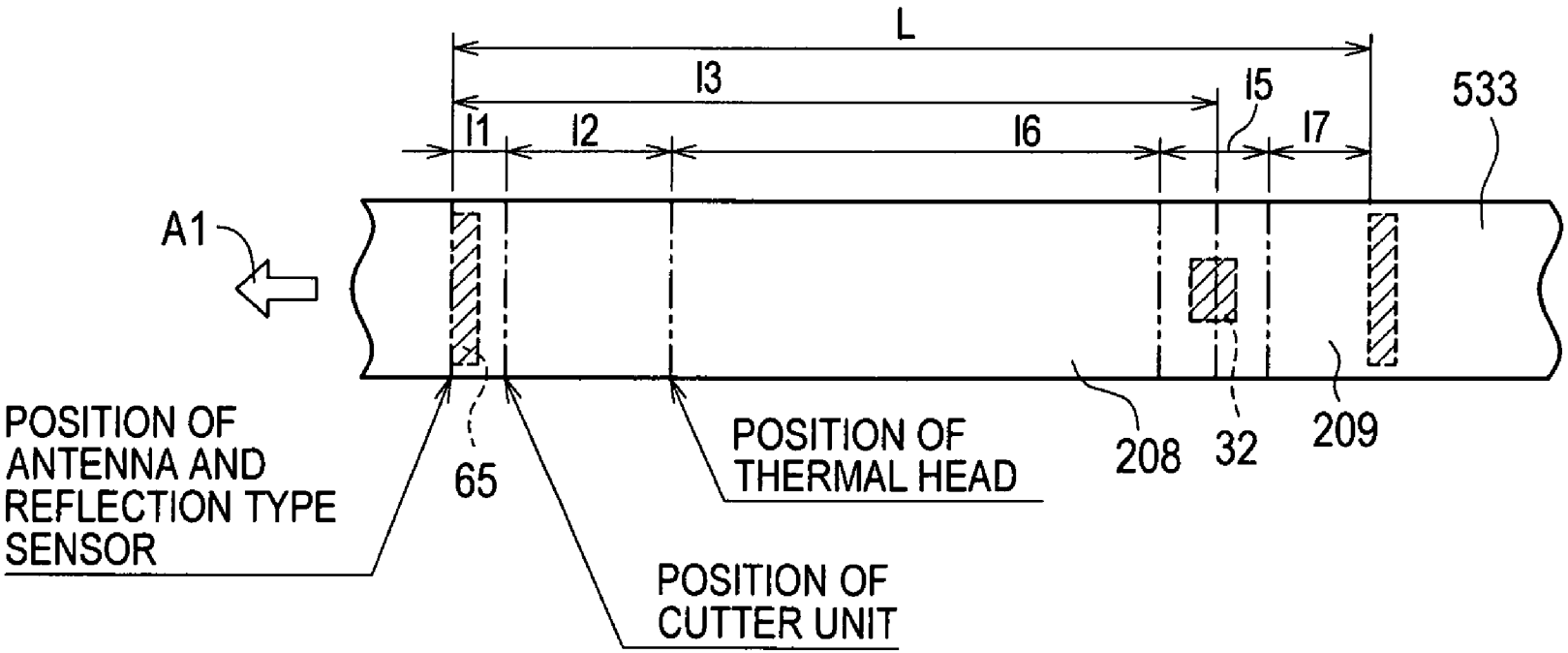
FIG. 50 is a diagram for explaining schematically an example of a printing object tape in which the tape feeding direction length l7 of the second print area is smaller than the feeding direction distance l2 between the cutter unit and the thermal head in the printing object tape of type 3 of this embodiment, and also showing schematically the positional relationship between the sensor mark and the wireless tag circuit element.

As shown in FIGS. 48 and 49, in S121 to S123, the CPU 81 executes processing of the above S101 to S103.

Figure 51:
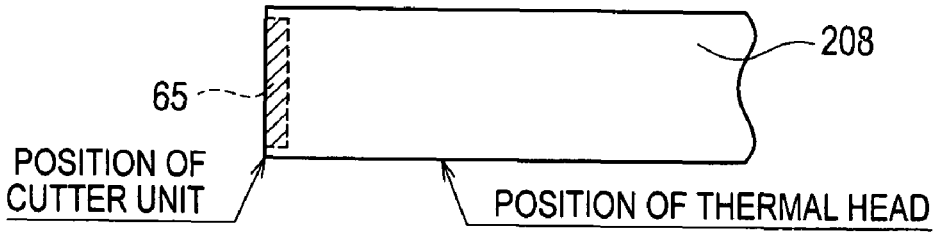
FIG. 51 is a diagram for explaining schematically an example of production of the printed label tape of the tape printing apparatus provided with a tape cassette accommodating a printing object tape in which the tape feeding direction length l7 of the second print area is smaller than the feeding direction distance l2 between the cutter unit and the thermal head in the printing object tape of type 3 of this embodiment, and also showing a condition of the printed label tape in a waiting condition.
Figure 52:
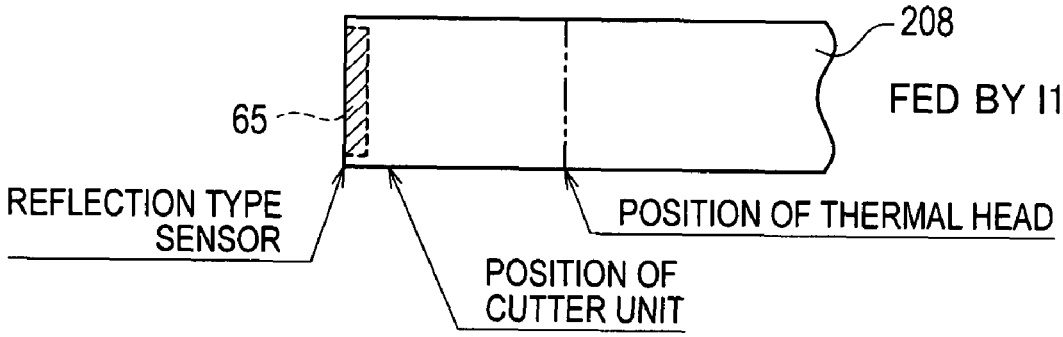
FIG. 52 is a diagram showing the condition of the printed label tape at the time of printing start, continued from FIG. 51.

For example, as shown in FIGS. 51 and 52, if the front end portion in the feeding direction of the sensor mark 65 is opposite to the cutter unit 30 when the print key 3 is pressed, the tape feeding motor 92 is driven to rotate the tape feeding roller 63, so that feeding of the printed label tape 28 is started by the tape feeding roller 63 and the tape sub-roller 11. Then, when the feeding amount of the printed label tape 28 reaches the feeding direction distance l1 between a position of the antenna 33 and the reflection type sensor 35 and a position of the cutter unit 30, the front end portion in the feeding direction of the sensor mark 65 is detected by the reflection type sensor 35, so that printing of the print data in the first print area 208 (see FIG. 20) through the thermal head 9 is started.

In S124, the CPU 81 reads out the feeding direction distance 12 between a position of the cutter unit 30 and a position of the thermal head 9 from the ROM 83, and executes determination processing of determining whether or not the tape feeding amount after the front end portion in the feeding direction of the sensor mark 65 is detected through the reflection type sensor 35 reaches the feeding direction distance l2. When the tape feeding amount after the front end portion in the feeding direction of the sensor mark 65 is detected does not reach the feeding direction distance l2 (S124: NO), the CPU 81 executes processing subsequent to S123 again.

On the other hand, when the tape feeding amount after the front end portion in the feeding direction of the sensor mark 65 is detected reaches the feeding direction distance l2 (S124: YES), in S125, the CPU 81 stops the tape feeding motor 92 to stop feeding of the printed label tape 28 and stops the thermal head 9. After that, the printed label tape 28 is cut at the front end side in the feeding direction by driving the cutting motor 96. That is, the edge portion on the front end side of the first print area 208 (see FIG. 20) is cut off.

Consequently, the margin of the front end portion in the feeding direction of the printed label tape 28 corresponding to the feeding direction distance (l1+l2) between a position of the antenna 33 and the reflection type sensor 35 and a position of the thermal head 9 can be automatically cut off, so that a user does not need to cut off the margin at the front end portion in the feeding direction after creating the label tape 28, thereby improving working efficiency.

Figure 53:
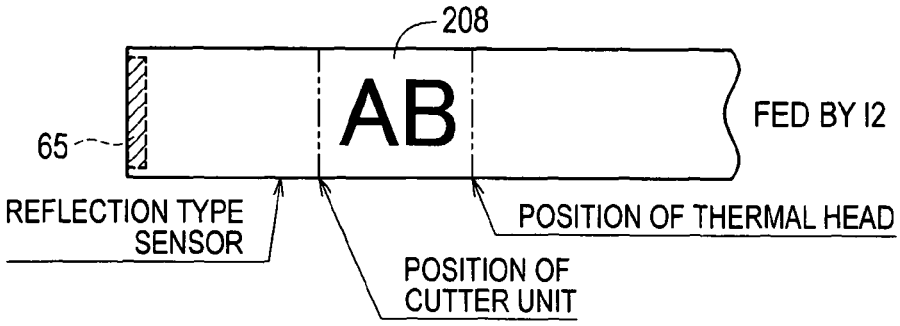
FIG. 53 is a diagram showing a condition of the printed label tape when the front end side is cut off, continued from FIG. 52.

For example, as shown in FIG. 53, letters of the print data "AB" of the print data "ABCDE" in the first print area 208 is printed after printing to the printing object tape 533 through the thermal head 9 is started, and when the feeding amount of the printing object tape 533, that is, the feeding amount of the printed label tape 28 reaches the feeding direction distance l2 between a position of the cutter unit 30 and a position of the thermal head 9 from the print starting position, that is, when the edge portion on the front end side of the first print area 208 is opposite to the cutter unit 30, the tape feeding motor 92 is stopped and the thermal head 9 is stopped. After that, the cutting motor 96 is driven to cut off the margin at the front end portion in the feeding direction of the printed label tape 28.

Subsequently, in S126, the CPU 81 starts driving of the tape feeding motor 92 again and continues printing of a print data in the first print area 208 through the thermal head 9.

In S127, the CPU 81 executes determination processing of determining whether or not printing of the first print area 208 is completed. Then, when printing of the first print area 208 is not completed (S127: NO), the CPU 81 executes processing subsequent to S126 again. Consequently, the print data continues to be printed in the first print area 208 of the printing object tape 533.

On the other hand, when printing in the first print area 208 is completed (S127: YES), the CPU 81 moves to processing of S128. In S128, the CPU 81 stops driving of the thermal head 9 and continues driving of the tape feeding motor 92 to feed the printed label tape 28.

In S129, the CPU 81 executes determination processing of determining whether or not the thermal head 9 reaches the edge portion on the front end side in the feeding direction of the second print area 209 (see FIG. 20). In this determination, the CPU 81 reads out the data of the "print range" from the RAM 85, obtains length data on the front end side from data of the print range of the second print area 209, determines whether or not the feeding amount of the printed label tape 28 after the sensor mark 65 is detected reaches this length data. Then, when the thermal head 9 dose not reach the edge portion on the front end side in the feeding direction of the second print area 209 (S129: NO), the CPU 81 executes processing subsequent to S128 again.

On the other hand, when the thermal head 9 reaches the edge portion on the front end side in the feeding direction of the second print area 209 (S129: YES), in S130, the CPU 81 continues driving of the tape feeding motor 92 to feed the printing object tape 533 and starts printing of the print data of the second print area 209 through the thermal head 9.

In S131, the CPU 81 continues driving of the tape feeding motor 92 to continue printing of the print data in the second print area 209 through the thermal head 9.

In S132, the CPU 81 executes determination processing of determining whether or not printing of the second print area 209 is completed. When printing of the second print area 209 is not completed (S132: NO), the CPU 81 executes processing subsequent to S131 again. Consequently, the print data is printed continuously in the second print area 209 of the printing object tape 533.

On the other hand, when printing of the second print area 209 is completed (S132: YES), the CPU 81 moves to processing of S133. In S133, the CPU 81 stops driving of the thermal head 9 and continues driving of the tape feeding motor 92 to feed the printed label tape 28.

In S134, the CPU 81 reads out the data of the "from sensor mark to the IC chip center position l3" indicating the distance l3 between a position of the sensor mark 65 and a position of the wireless tag circuit element 32 from the RAM 85, and executes determination processing of determining whether or not the tape feeding amount after the front end portion in the feeding direction of the sensor mark 65 is detected through the reflection type sensor 35 reaches the distance l3, which is the "from the sensor mark to the IC chip center position l3". Then, when the tape feeding amount after the front end portion in the feeding direction of the sensor mark 65 is detected does not reach the distance l3 (S134: NO), it executes processing subsequent to S133 again.

On the other hand, when the tape feeding amount after the front end portion in the feeding direction of the sensor mark 65 is detected reaches the distance l3 (S134: YES), in S135, the CPU 81 stops the tape feeding motor 92 to stop feeding of the printed label tape 28 and stops driving of the thermal head 9. After that, it reads out a write data from the RAM 85 and stores this write data into the memory portion 125 of the wireless tag circuit element 32 through the read and write module 93.

Figure 54:
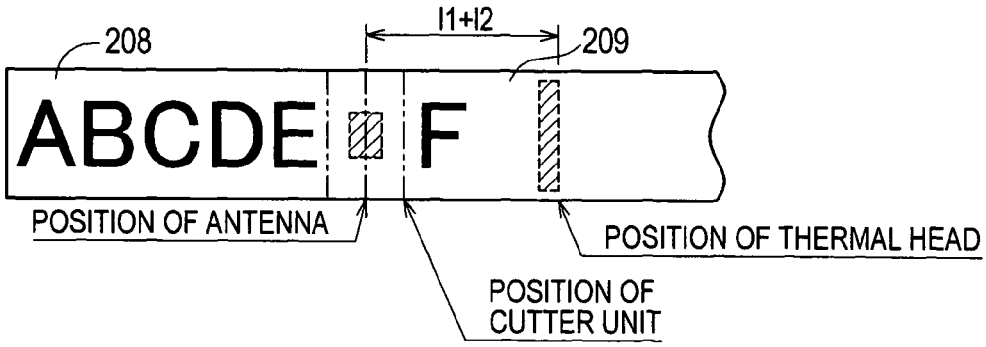
FIG. 54 is a diagram showing a condition of the printed label tape at the time of writing information into the wireless tag circuit element, continued from FIG. 53.

For example, as shown in FIG. 54, when the tape feeding amount after the front end portion in the feeding direction of the sensor mark 65 is detected through the reflection type sensor 35 reaches the distance l3 (for example, 78 mm), the CPU 81 stops the tape feeding motor 92 to stop feeding of the printed label tape 28 and stops driving of the thermal head 9. Then, it reads out a write data from the RAM 85 and stores this write data into the memory portion 125 of the wireless tag circuit element 32 through the read and write module 93. In addition, in this case, the antenna 33 and the wireless tag circuit element 32 are opposite to each other across a space. The print data "ABCDE" in the first print area 208 of the printing object tape 533 and a print data "F" in the second print area 209 are printed.

Subsequently, in S136 to 138, the CPU 81 executes processing of the above S116 to S118, after that, completes the sub-processing and returns to the sub-processing of the print processing 3. Consequently, a printed label tape 28 is created by printing the print data in the first print area 208 and the second print area 209 excluding a portion in which the wireless tag circuit element 32 is to be disposed of the printing object tape 533 of l7<l2 and storing data about product price and the like in the wireless tag circuit element 32.

Figure 55:
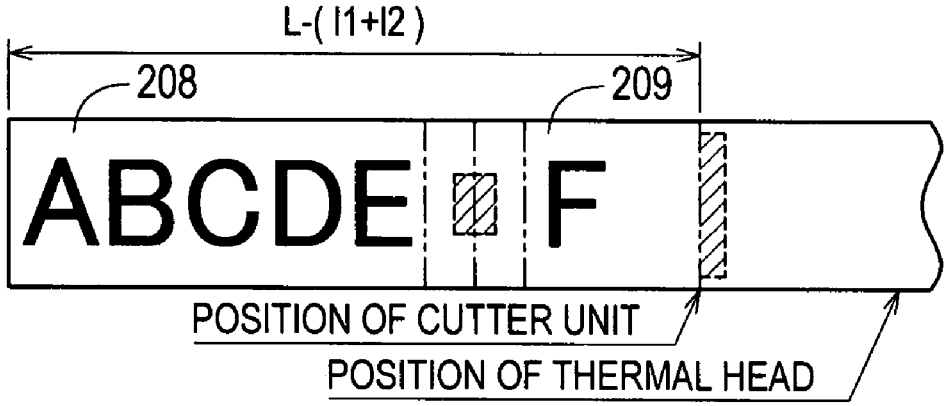
FIG. 55 is a diagram showing a condition of the printed label tape when the rear end side is cut off, continued from FIG. 54.

For example, as shown in FIG. 55, when the tape feeding amount after the margin of the front end portion in the feeding direction of the printed label tape 28 is cut off reaches (L−(l1+l2)), the CPU 81 stops the tape feeding motor 92. After that, the cutting motor 96 is driven to cut the printed label tape 28 at the rear end side in the feeding direction, that is, along the front edge portion in the feeding direction of the sensor mark 65 and then, the printed label tape 28 is discharged from the label discharge port 16.

Next, the sub-processing of the "print processing 33" will now be described with reference to FIGS. 56 to 63.

Figure 56:
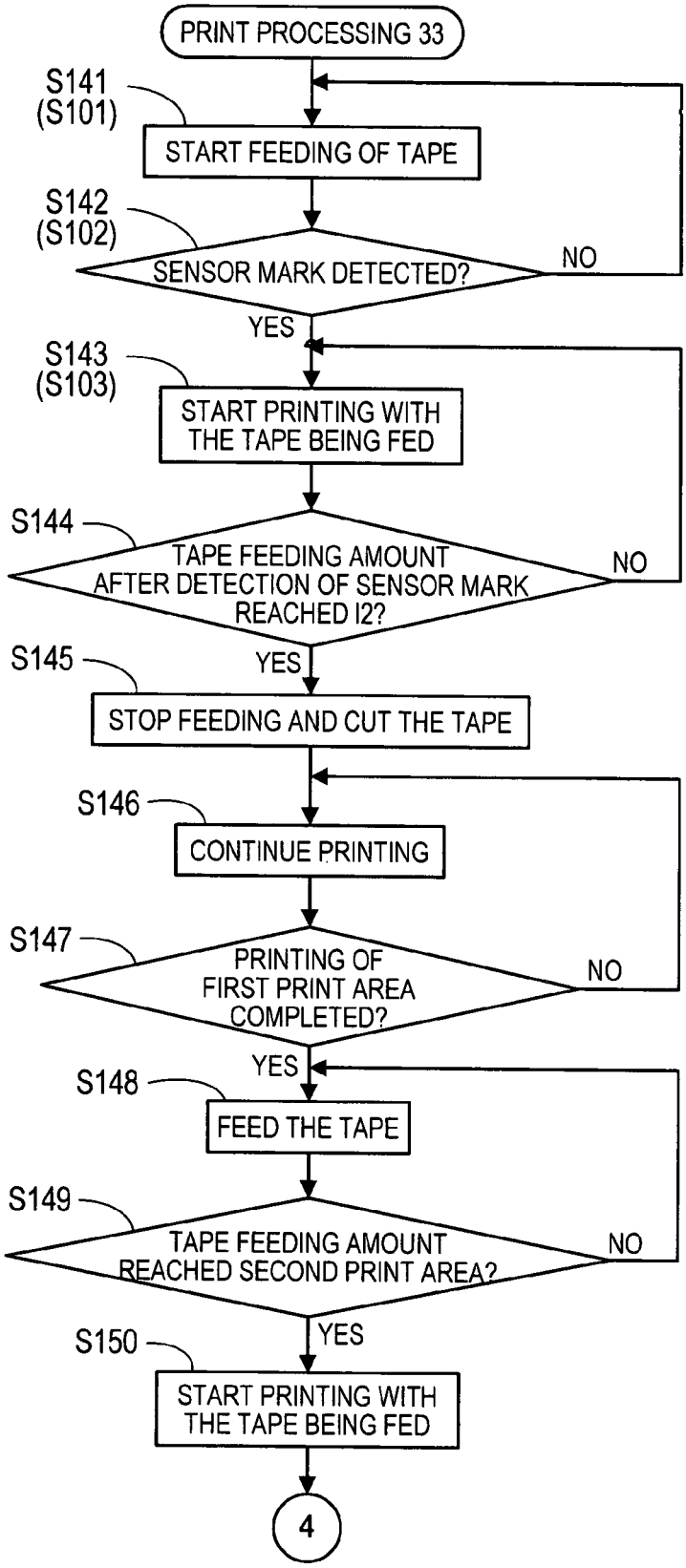
FIG. 56 is a sub-flow chart showing sub-processing of print processing 33 of the tape printing apparatus of this embodiment.
Figure 57:
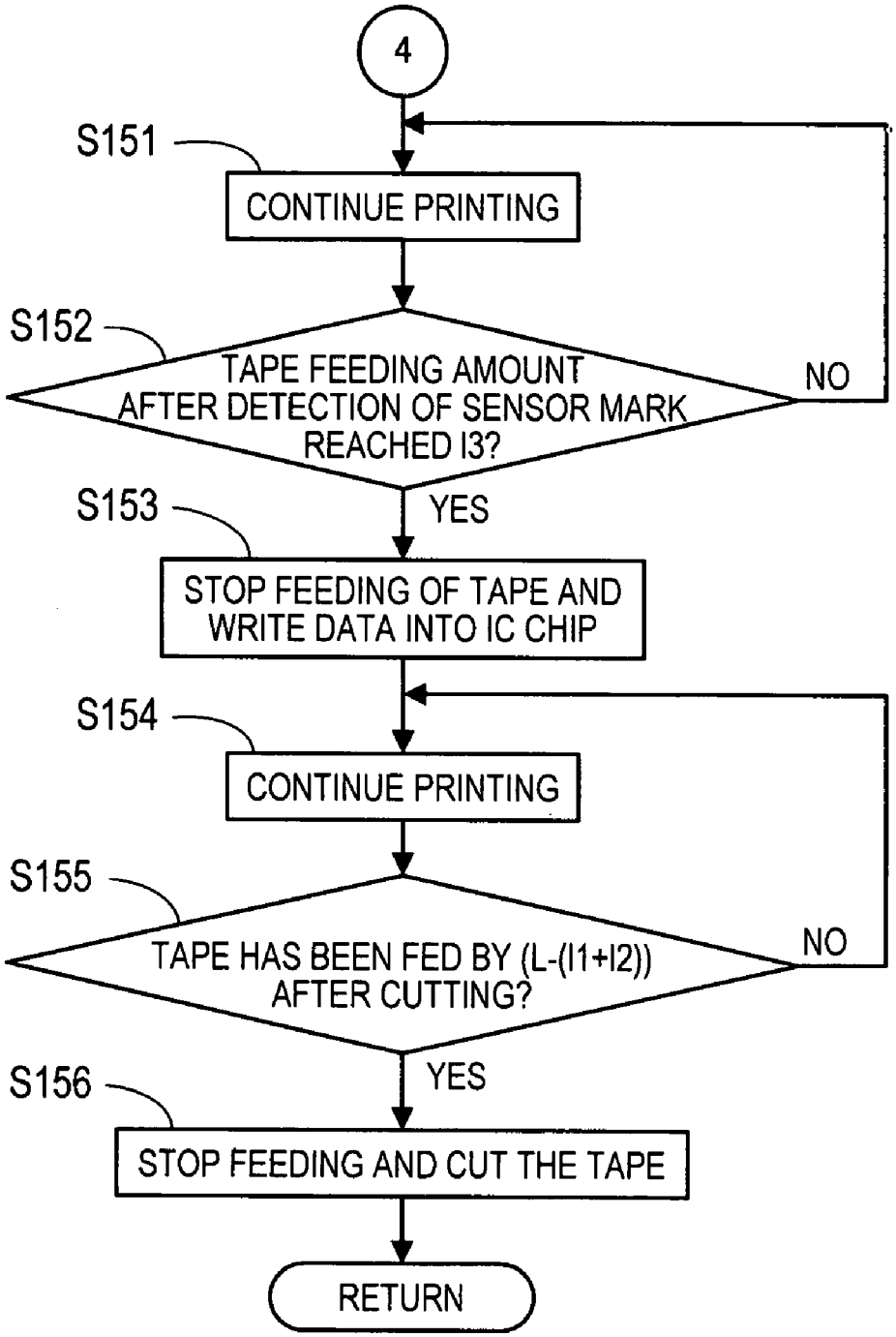
FIG. 57 is a sub-flow chart showing sub-processing of print processing 33 of the tape printing apparatus of this embodiment.
Figure 58:
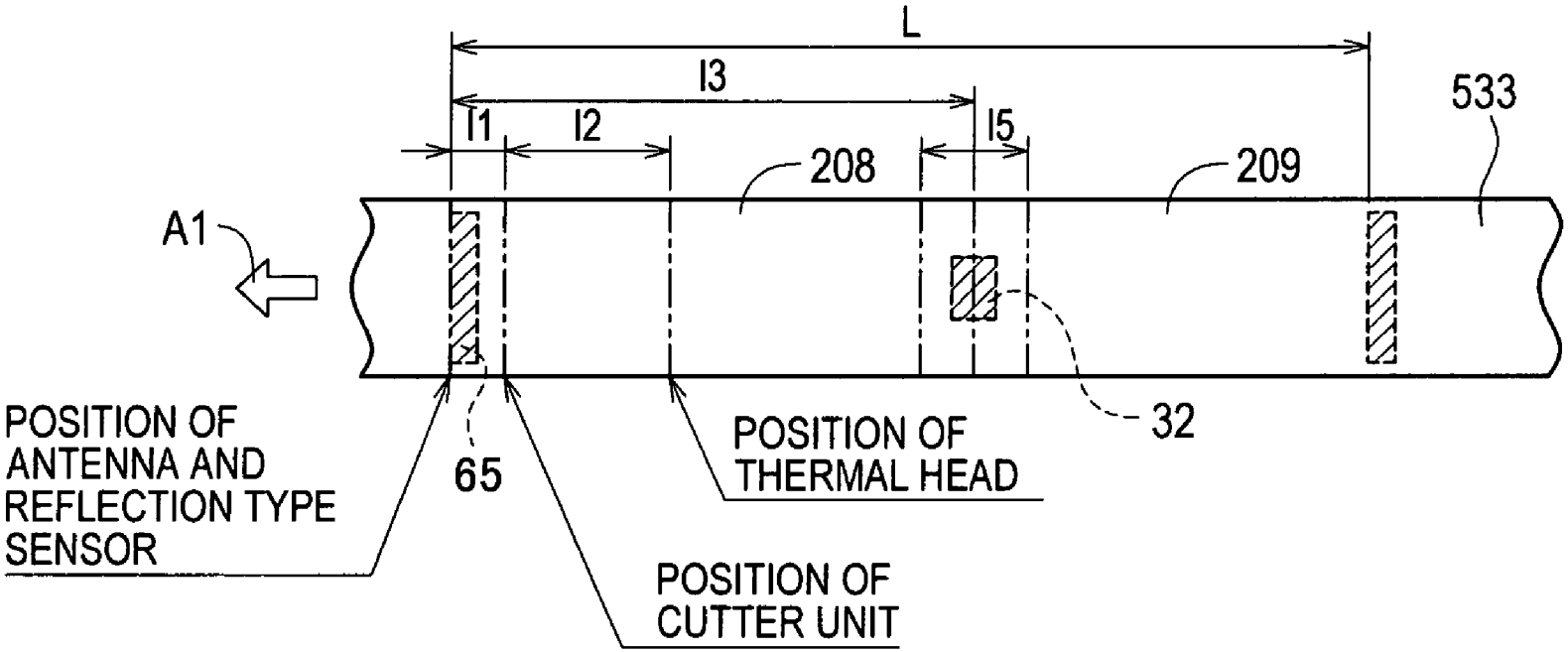
FIG. 58 is a diagram for explaining schematically an example of a printing object tape in which the tape feeding direction length l6 of the first print area is larger than the feeding direction distance l2 and the tape feeding direction length of the second print area is larger than the feeding direction distance l2 in the printing object tape of type 3 of this embodiment, and also showing schematically the positional relationship between the sensor mark and the wireless tag circuit element.

As shown in FIGS. 56 to 57, in S141 to S143, the CPU 81 executes processing of the above S101 to 103.

Figure 59:
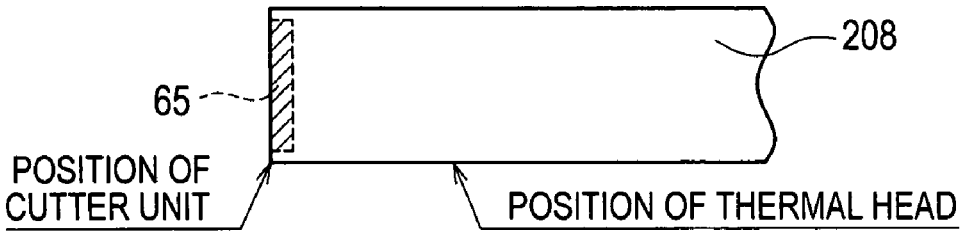
FIG. 59 is a diagram for explaining schematically an example of production of the printed label tape for the tape printing apparatus provided with a tape cassette accommodating a printing object tape in which the tape feeding direction length l6 of the first print area is larger than the feeding direction distance l2 and the tape feeding direction length of the second print area is larger than the feeding direction distance l2 in the printing object tape of type 3 of this embodiment, and also showing a condition of a printed label tape in a waiting condition.
Figure 60:
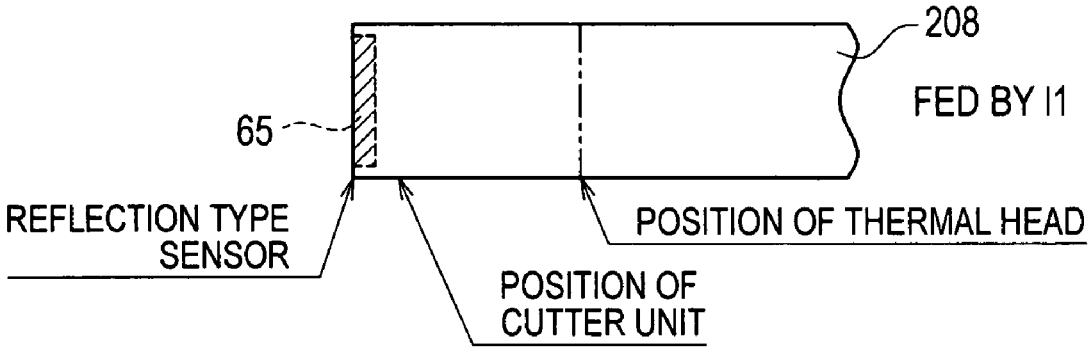
FIG. 60 is a diagram showing the condition of the printed label tape at the time of printing start, continued from FIG. 59.

For example, as shown in FIGS. 59 and 60, if the front end portion in the feeding direction of the sensor mark 65 is opposite to the cutter unit 30 when the print key 3 is pressed, the tape feeding motor 92 is driven to rotate the tape feeding roller 63, so that feeding of the printed label tape 28 is started by the tape feeding roller 63 and the tape sub-roller 11. Then, when the feeding amount of the printed label tape 28 reaches the feeding direction distance l1 between a position of the antenna 33 and the reflection type sensor 35 and a position of the cutter unit 30, the front end portion in the feeding direction of the sensor mark 65 is detected by the reflection type sensor 35, so that printing of the print data in the first print area 208 (see FIG. 20) is started through the thermal head 9.

In S144, the CPU 81 reads out the feeding direction distance 12 between a position of the cutter unit 30 and a position of the thermal head 9 from the ROM 83, and executes determination processing of determining whether or not the tape feeding amount after the front end portion in the feeding direction of the sensor mark 65 is detected through the reflection type sensor 35 reaches the feeding direction distance l2. When the tape feeding amount after the front end portion in the feeding direction of the sensor mark 65 is detected does not reach the feeding direction distance l2 (S144: NO), the CPU 81 executes processing subsequent to S143 again.

On the other hand, when the tape feeding amount after the front end portion in the feeding direction of the sensor mark 65 reaches the feeding direction distance l2 (S144: YES), in S145, the CPU 81 stops the tape feeding motor 92 to stop feeding of the printed label tape 28 and stops the thermal head 9. After that, the cutting motor 96 is driven to cut off the printed label tape 28 at the front end side in the feeding direction. That is, the edge portion on the front end side of the first print area 208 (see FIG. 20) is cut off.

Consequently, the margin at the front end portion in the feeding direction of the printed label tape 28 corresponding to the feeding direction distance (l1+l2) between a position of the antenna 33 and the reflection type sensor 35 and a position of the thermal head 9 can be automatically cut off, so that a user does not need to cut the margin at the front end portion in the feeding direction after the printed label tape 28 is created, thereby improving working efficiency.

Figure 61:
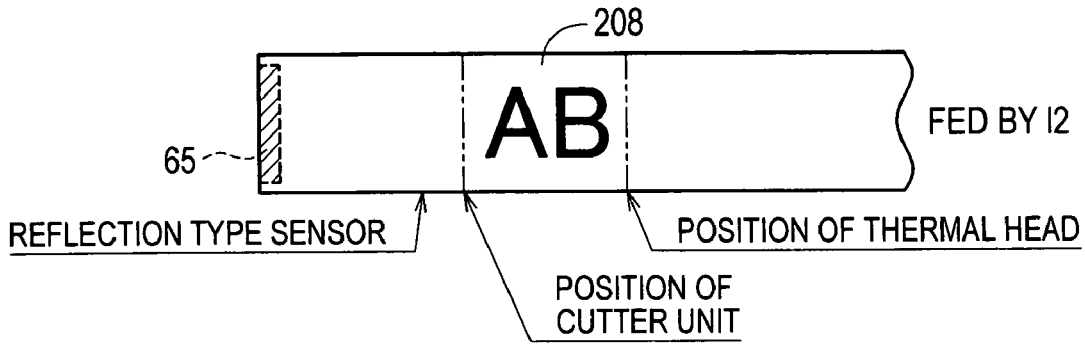
FIG. 61 is a diagram showing a condition of the printed label tape when the front end side is cut off, continued from FIG. 60.

For example, as shown in FIG. 61, letters of the print data "AB" of the print data "ABC" in the first print area 208 are printed after printing to the printing object tape 533 is started through the thermal head 9, and when the feeding amount of the printing object tape 533, that is, the feeding amount of the printed label tape 28 reaches the feeding direction distance l2 between a position of the cutter unit 30 and a position of the thermal head 9 from a print starting position, that is, when the edge portion on the front end side of the first print area 208 is opposite to the cutter unit 30, the tape feeding motor 92 is stopped and the thermal head 9 is also stopped and after that, the cutting motor 96 is driven to cut off the margin at the front end portion in the feeding direction of the printed label tape 28.

In S146, the CPU 81 starts driving of the tape feeding motor 92 again and printing of the print data in the first print area 208 is continued through the thermal head 9.

In S147, the CPU 81 executes determination processing of determining whether or not printing of the first print area 208 is completed. Then, when printing of the first print area 208 is not completed (S147: NO), the CPU 81 executes processing subsequent to S146 again. Consequently, the print data is printed continuously into the first print area 208 of the printing object tape 533.

On the other hand, when printing of the first print area 208 is completed (S147: YES), the CPU 81 moves to processing of S148. In S148, the CPU 81 stops driving of the thermal head 9 and continues driving of the tape feeding motor 92 to feed the printed label tape 28.

In S149, the CPU 81 executes determination processing of determining whether or not the thermal head 9 reaches the edge portion on the front end side in the feeding direction of the second print area 209 (see FIG. 20). In this determination, the CPU 81 reads out the data of the "print range" from the RAM 85, obtains a length data of the front end side from data of the print range of the second print range 209 and determines whether or not the feeding amount of the printed label tape 28 after the sensor mark 65 is detected reaches this length data. When the thermal head 9 dose not reach the edge portion on the front end side in the feeding direction of the second print area 209 (S149: NO), the CPU 81 executes processing subsequent to S148 again.

On the other hand, when the thermal head 9 reaches the edge portion on the front end side in the feeding direction of the second print area 209 (S149: YES), in S150, the CPU 81 drives continuously the tape feeding motor 92 to feed the printing object tape 533 and starts printing of the print data of the second print area 209 through the thermal head 9.

In S151, the CPU 81 continuously drives the tape feeding motor 92 to continue printing of the print data in the second print area 209 through the thermal head 9.

In S152, the CPU 81 reads out the data of the "from sensor mark to IC chip center position l3" indicating the distance l3 between a position of the sensor mark 65 and a position of the wireless tag circuit element 32 from the RAM 85, and executes determination processing of determining whether or not the tape feeding amount after the front end portion in the feeding direction of the sensor mark 65 is detected through the reflection type sensor 35 reaches the distance l3, indicated by the data "from the sensor mark to the IC chip center position l3". Then, when the tape feeding amount after the front end portion in the feeding direction of the sensor mark 65 is detected does not reach the distance l3 (S152: NO), it executes processing subsequent to S151 again.

On the other hand, when the tape feeding amount after the front end portion in the feeding direction of the sensor mark 65 is detected reaches the distance l3 (S152: YES), in S153, the CPU 81 stops the tape feeding motor 92 to stop feeding of the printed label tape 28 and stops driving of the thermal head 9. After that, it reads out a write data from the RAM 85 and stores this write data into the memory portion 125 of the wireless tag circuit element 32 through the read and write module 93.

Figure 62:
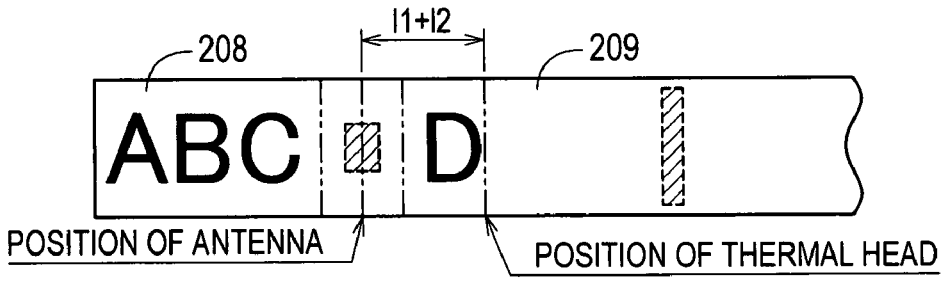
FIG. 62 is a diagram showing a condition of the printed label tape at the time of writing information into the wireless tag circuit element, continued from FIG. 61.

For example, as shown in FIG. 62, when the tape feeding amount after the front end portion in the feeding direction of the sensor mark 65 is detected through the reflection type sensor 35 reaches the distance l3 (for example, 62.5 mm), the CPU 81 stops the tape feeding motor 92 to stop feeding of the printed label tape 28 and stops driving of the thermal head 9. Then, it reads out a write data from the RAM 85 and stores this write data into the memory portion 125 of the wireless tag circuit element 32 through the read and write module 93. In this case, the antenna 33 and the wireless tag circuit element 32 are opposite to each other across a space. The print data "ABC" in the first print area 208 of the printing object tape 533 and a print data "D" of a print data "DEF" in the second print area 209 of the printing object tape 533 are printed.

Subsequently, in S154, the CPU 81 starts driving of the tape feeding motor 92 again and continues printing of the print data of the second print area 209 through the thermal head 9.

In S155, the CPU 81 reads out the feeding direction distance l1 between a position of the antenna 33 and the reflection type sensor 35 and a position of the cutter unit 30 from the ROM 83, and reads out the feeding direction distance l2 between a position of the cutter unit 30 and a position of the thermal head 9 from the ROM 83, and reads out a data value L of the "IC chip pitch length L" from the RAM 85, and executes determination processing of determining whether or not the tape feeding amount after the margin at the front end portion in the feeding direction of the printed label tape 28 is cut off reaches (L−(l1+l2)). When the tape feeding amount after the margin at the front end portion in the feeding direction of the printed label tape 28 is cut off does not reach (L−(l1+l2)) (S155: NO), the CPU 81 executes processing subsequent to S154 again.

On the other hand, when the tape feeding amount after the margin at the front end in the feeding direction of the printed label tape 28 is cut off reaches (L−(l1+l2)) (S155: YES), in S156, the CPU 81 stops the tape feeding motor 92 to stop feeding of the printed label tape 28 and stops driving of the thermal head 9. After that, the cutting motor 96 is driven to cut the printed label tape 28 at the rear end side in the feeding direction, that is, the rear end side of the print area 207 (see FIG. 20). Then, the CPU 81 completes the sub-processing and returns to the sub-processing of the print processing 3. Consequently, a printed label tape 28 is created by printing the print data in the first print area 208 and the second print area 209 excluding a portion in which the wireless tag circuit element 32 is to be disposed of the printing object tape 533 of 16≧12 and 17≧12, and storing data about product price and the like in the wireless tag circuit element 32.

Figure 63:
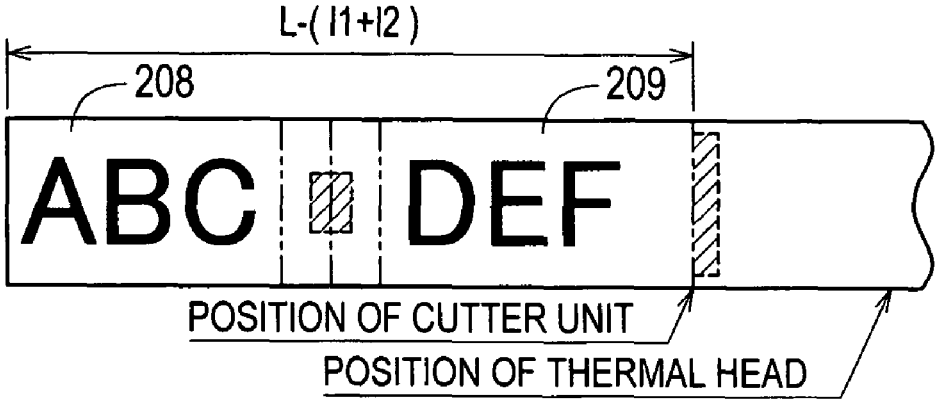
FIG. 63 is a diagram showing a condition of the printed label tape when the rear end side is cut off, continued from FIG. 62.

For example, as shown in FIG. 63, when the tape feeding amount after the margin at the front end portion in the feeding direction of the printed label tape 28 is cut off reaches (L−(l1+l2)), the CPU 81 stops the tape feeding motor 92. After that, the cutting motor 96 is driven to cut the printed label tape 28 at the rear end side in the feeding direction, that is, along the front end portion in the feeding direction of the sensor mark 65 and the printed label tape 28 is discharged from the label discharge port 16.

Here, the tape feeding roller 92, the tape drive roller shaft 14, a cam portion 76, the tape feeding roller 63, and the tape sub-roller 11 constitute a tape feeding means. The thermal head 9 and the platen roller 10 constitute a printing means. The wireless tag circuit element 25 functions as a cassette information specifying means. The wireless tag circuit element 32 functions as a radio information circuit element. The antenna 68 functions as an IC circuit side antenna. The keyboard 6 functions as an input means. When a character data and the like is inputted by connecting with an external personal computer through the connector 18, this personal computer functions as an input means. The liquid crystal display 7 functions as a display means. The reflection type sensor 35 functions as a detection sensor. The cutter unit 30 functions as a cutting means. The antenna 26 and the read and write module 93 function as a cassette information reading means. The CPU 81, the ROM 83 and the RAM 85 function as a virtual tape display control means. The antenna 33 functions as an apparatus side antenna. The read and write module 93 functions as a read and write means.

As described in detail above, the tape printing apparatus 1 of this embodiment enables a user to input a print data while confirming each print area 202, 205, 208, and 209 excluding the wireless tag circuit element 32 of the virtual tape 201, 204, and 207 displayed on the liquid crystal display 7. Consequently, the print data can be inputted easily into each print area 202, 205, 208, and 209 excluding the wireless tag circuit element 32 of the printing object tape 531, 532, and 533. Further, any convex portion in which the wireless tag circuit element 32 exists of the printing object tape 531, 532, and 533 can be prevented from being printed thereby making it possible to create a high quality printed label tape 28. Even if, after the sensor mark 65 of the printing object tape 531, 532, and 533 is detected, the tape is fed for a distance (l1+l2) between a position of the reflection type sensor 35 and a position of the thermal head 9, and the margin on the front end side is cut off, the print area 202,205, 208, and 209 can be left securely on the printed label tape 28.

Further, the tape printing apparatus 1 can write predetermined information into the wireless tag circuit element 32 through the antenna 33 by feeding the printing object tape 531, 532, and 533 at a predetermined distance after the sensor mark 65 is detected.

The tape cassette 21 of this embodiment can obtain a distance data indicating a relative distance between the front edge portion in the feeding direction of the print area 202, 205, 208, and 209 and the sensor mark 65 disposed immediately before on the upstream side in the tape feeding direction of the print area 202, 205, 208, and 209, and a length data indicating the length in the feeding direction of the print area 202, 205, 208, and 209 through the wireless tag circuit element 25. Consequently, each print area 202, 205, 208, and 209 provided at a portion excluding the wireless tag circuit element 32 between the respective sensor marks 65 of the printing object tape 531, 532, and 533 can be printed accurately, thereby preventing the convex portion including the wireless tag circuit element 32 of the printing object tape 531, 532, and 533 from being printed and producing a high quality printed label tape 28.

Further, because a relative distance between the wireless tag circuit element 32 and the sensor mark 65 disposed immediately before the upstream in the feeding direction of the wireless tag circuit element 32 can be obtained through the wireless tag circuit element 25, any arrangement position of the wireless tag circuit element 32 in the upstream in the feeding direction can be specified with respect to the sensor mark 65, thereby preventing the convex portion including the wireless tag circuit element 32 of the printing object tape 531, 532, and 533 from being printed, and producing a high quality printed label tape 28.

Needless to say, the present invention is not restricted to the above-described embodiments and the present invention may be improved or modified in various ways within a range not departing from the spirit of the invention.

For example, it is permissible to provide a tape specifying portion constituted of a plurality of pieces of convex portions and concave portions for specifying the type of the printing object tape 53 at a predetermined position on the main body of the tape cassette 21 instead of the wireless tag circuit element 25, and to provide a sensor means (for example, mechanical switch or the like) for detecting presence or absence of this convex portion or concave portion on a bottom portion of the cassette accommodating portion 8 of the tape printing apparatus 1 instead of the antenna 26. Consequently, the tape printing apparatus 1 can display the virtual tape 201, 204, and 207 having the print area 202, 205, 208, and 209 on the liquid crystal display 7 depending on the types of the printing object tape 53 specified by the tape specifying portion via a sensor means by storing data about the print area 202, 205, 208, and 209 of the printing object tape 531, 532, and 533.

The invention claimed is:

1. A tape cassette for use in a tape printing apparatus having a tape feeding means for feeding a long tape and a printing means for printing on the tape, and for being detachably to a cassette accommodating portion of the tape printing apparatus accommodating the tape, the tape cassette comprising:

a cassette information specifying means for specifying predetermined cassette information about the tape cassette, provided on a tape cassette main body;

a tape spool on which a printing object tape to be printed by the printing means is wound and provided rotatably;

a wireless information circuit element including an IC circuit portion disposed at a predetermined pitch in the longitudinal direction of the printing object tape for storing a predetermined information and an IC circuit side antenna connected to the IC circuit portion for transmitting and receiving information;

a sensor mark formed at the same pitch as the predetermined pitch in the longitudinal direction of one face of the printing object tape; and a print area provided at the same pitch as the predetermined pitch on a portion excluding the wireless information circuit element between the respective sensor marks of the printing object tape, wherein the sensor mark, the wireless information circuit element and the print area are provided apart from one another at a predetermined distance repeatedly in the longitudinal direction of the printing object tape, and the predetermined cassette information includes a print area information which is constituted of a distance data indicating a relative distance between the front end portion in the feeding direction of the print area and the sensor mark disposed on immediately before an upstream side in the tape feeding direction of the print area and a length data indicating the length in the feeding direction of the print area.

2. The tape cassette according to claim 1, wherein the predetermined cassette information includes a circuit element position information indicating a relative distance between the wireless information circuit element and the sensor mark disposed immediately before on the upstream side in the feeding direction of the wireless information circuit element.

* * * * *